United States Patent [19]

Hamilton

[11] Patent Number: 4,666,160

[45] Date of Patent: May 19, 1987

[54] APPARATUS FOR PLAYING

[76] Inventor: Clarence Q. Hamilton, 191 Willoughby St, Suite 15M, Brooklyn, N.Y. 11201

[21] Appl. No.: 760,987

[22] Filed: Jul. 31, 1985

Related U.S. Application Data

[63] Continuation of Ser. No. 165,373, Jul. 2, 1980, Pat. No. 4,569,526.

[51] Int. Cl.[4] ..... A63F 3/02

[52] U.S. Cl. ..... 273/242

[58] Field of Search ..... 273/241, 242, 256, 272

[56] References Cited

U.S. PATENT DOCUMENTS

| | | | |
|---|---|---|---|
| 448,574 | 3/1891 | Richards | 273/242 |
| 1,202,191 | 10/1916 | King | 273/256 X |
| 3,109,652 | 11/1963 | Strand et al. | 273/256 |
| 3,333,654 | 6/1982 | Allain | 273/241 |
| 3,765,682 | 10/1973 | Braude | 273/256 |
| 4,324,406 | 4/1982 | Ocampo | 273/272 |

OTHER PUBLICATIONS

"A History of Board Games", by H. J. R. Murray, 1952, pp. 158–165, 171, 177, 190, 205–207 and 211.

*Primary Examiner*—Anton O. Oechsle

*Attorney, Agent, or Firm*—Michael Ebert

[57] ABSTRACT

Disclosed are two interrelated sets of adult skill-oriented games derived from Vectorial and Mancala-like intelligence. In respect to their structural elements and behavioral dimensions these games evidence numerous improvements over the state of the art. The essential, linking feature common to all games of the invention is the rapid qualitative and quantitative transference of pieces, as defined, within a restricted, vectorial field or matrix with a view toward establishing certain winning formations, values or results. Speed—the Mach Factor—accounts for up to 50% of the total values in the games. Part I of the games of the invention declares what I call Vectorial games and game-systems. This group is divided into three categories: miniature Mancala-like games, pyramidic games and tangramatic games. Part II relates to games which evidence new and improved formats, apparatus and methods for making and playing traditional Mancala type games. Several examples illustrate a variety of simulated scenarios, utility functions, methods of play and commercially feasible embodiments e.g. boards, encasements, video-cartridges, hand-held computers and the like. Finally, a new and improved notation system is disclosed. All in all, the various aspects of the invention, together with the standardization of play at professional levels, should lead to the local and international re-vitalization of interest in Vectorial and Mancala-like games.

1 Claim, 104 Drawing Figures

FIG. 1
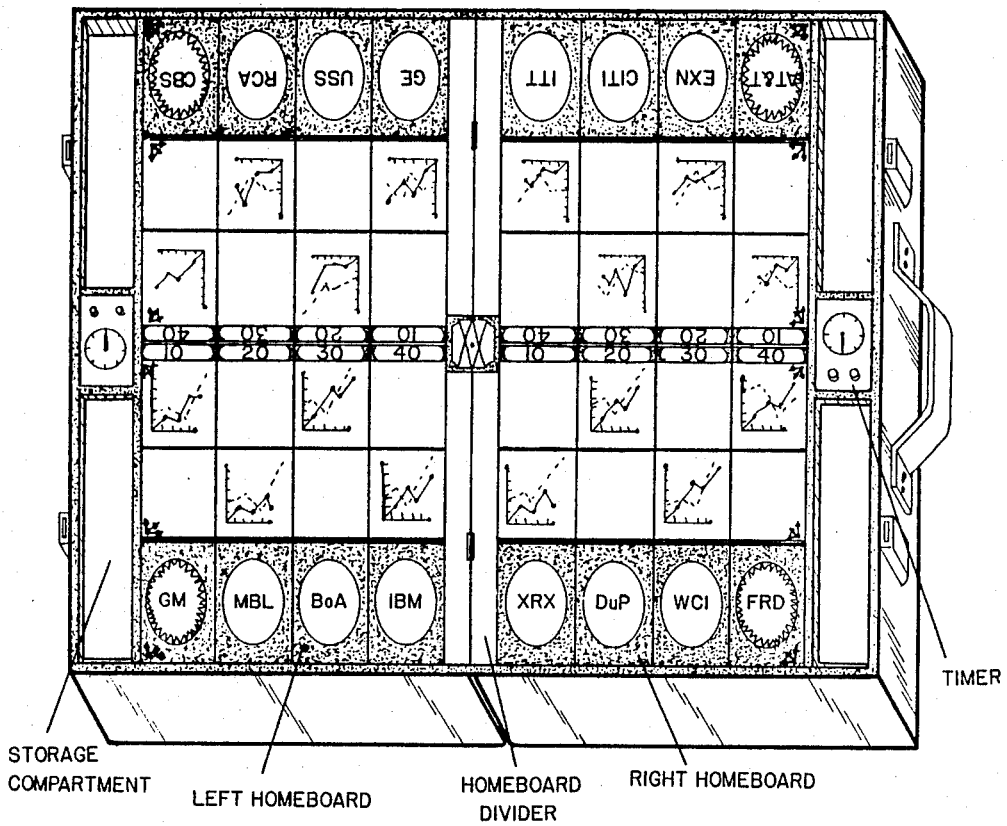
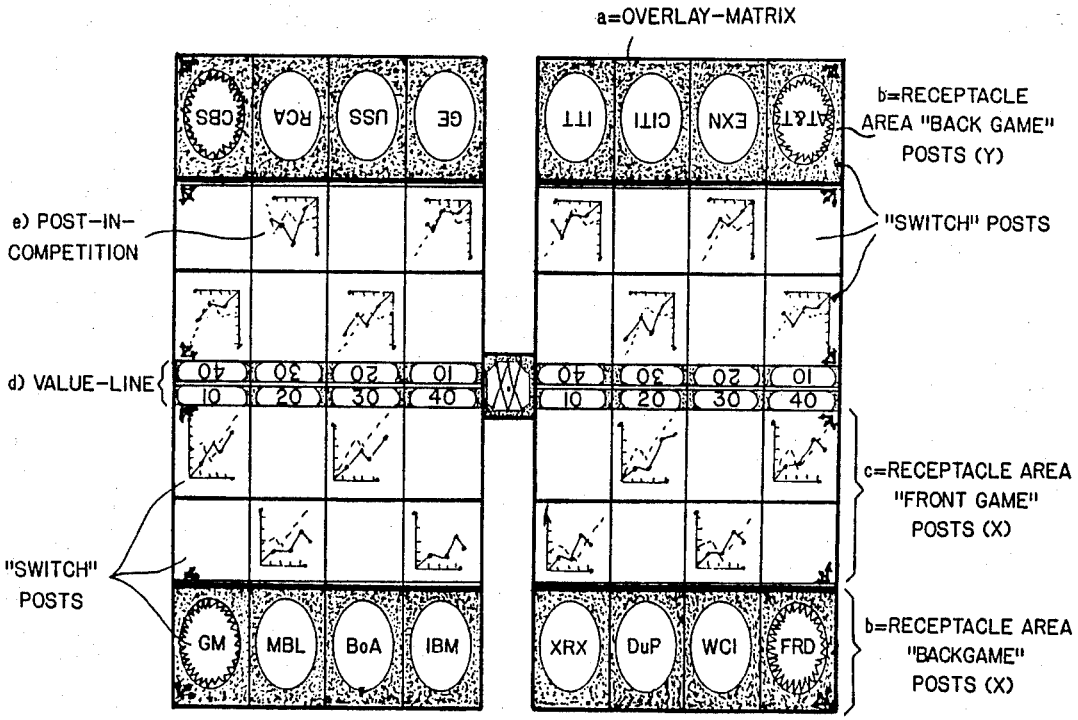
FIG. 2

FIG. 14a
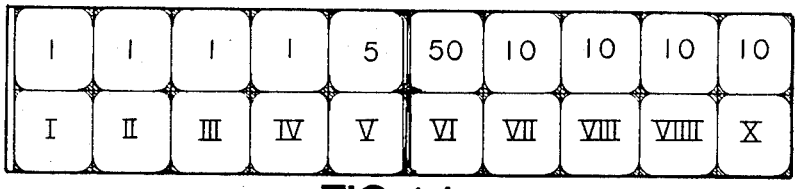
FIG. 14
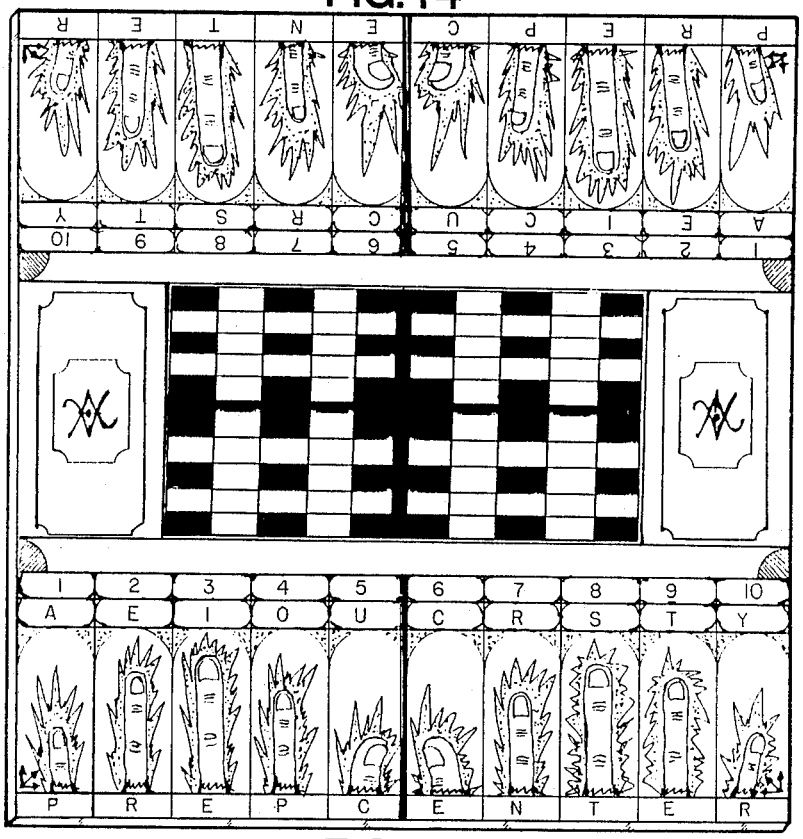
FIG. 14b
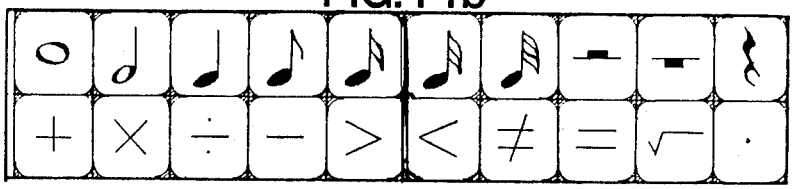
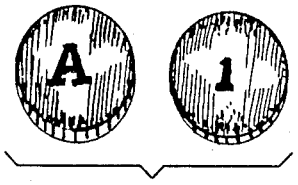
FIG. 14c

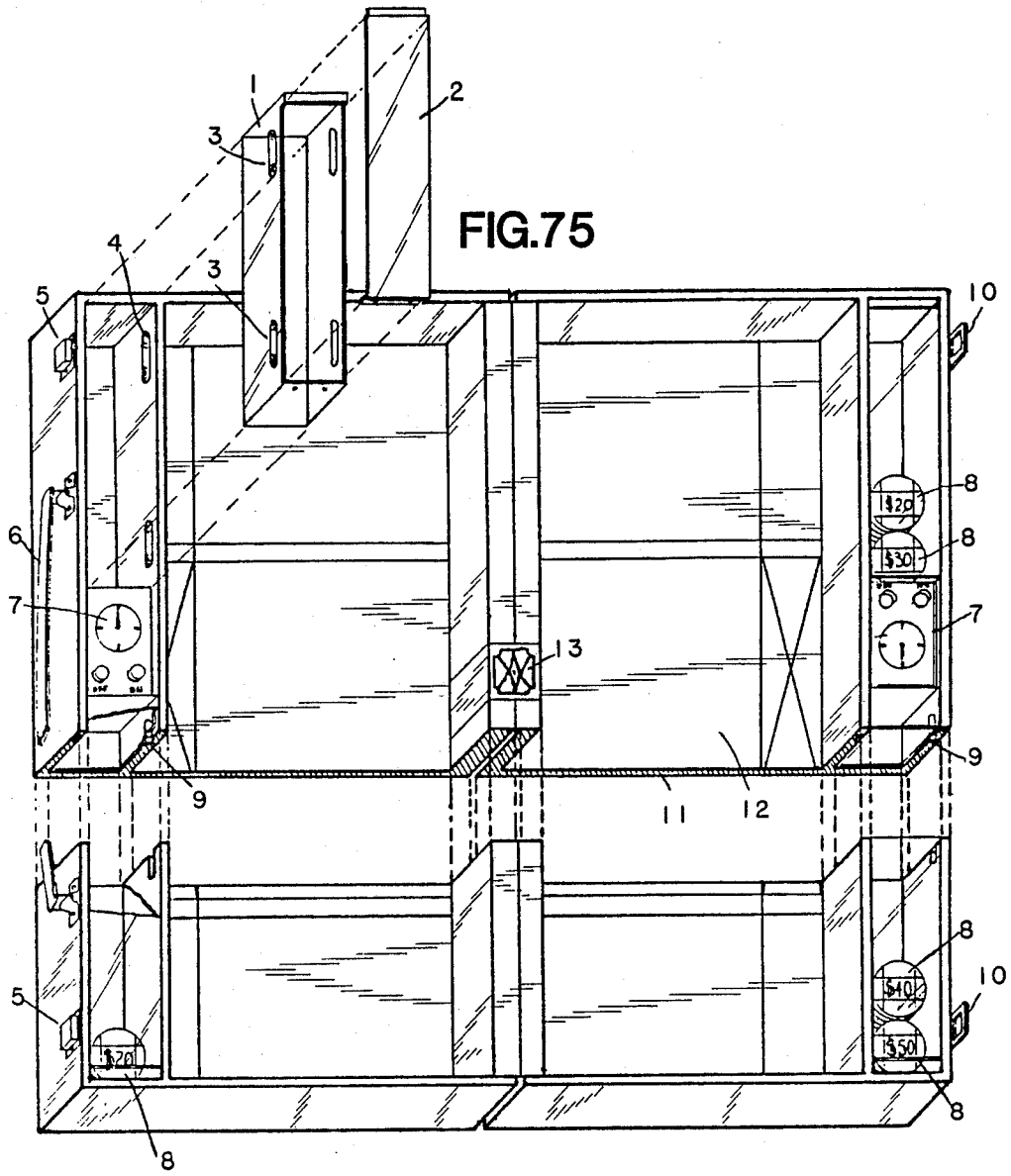
FIG.75
FIG.75A
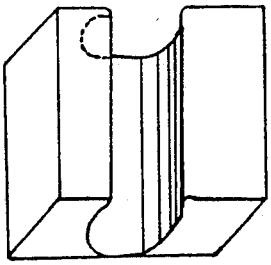
FIG.75B
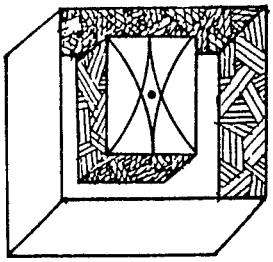
FIG.75C
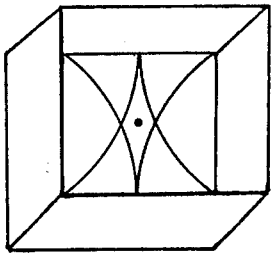

FIG.76
COMPUTA-CALA GAME SYSTEM (4 IN 1)
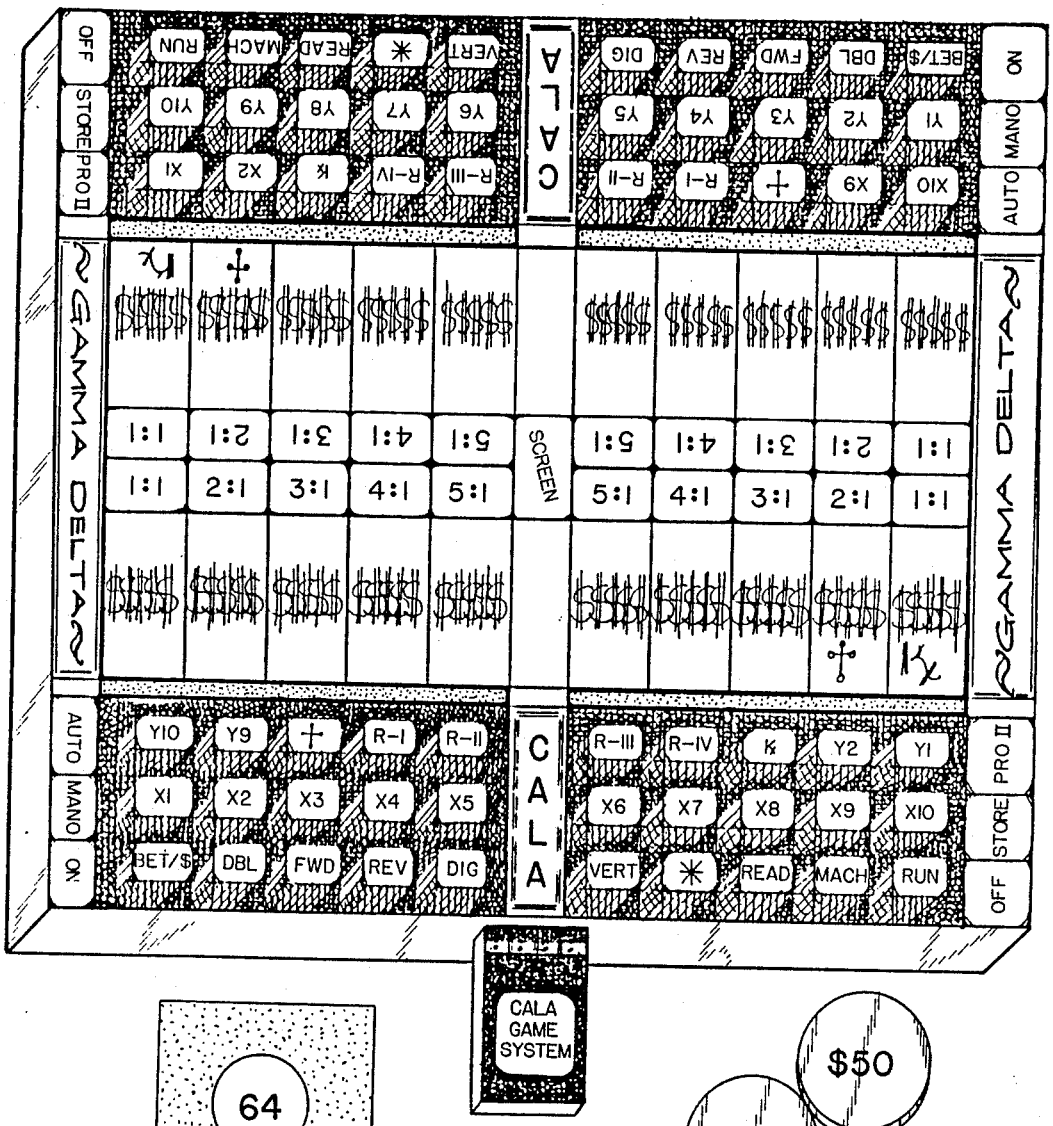
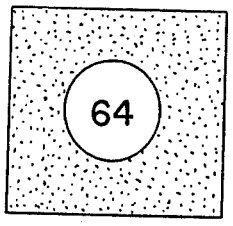
FIG.76A
FIG.76B
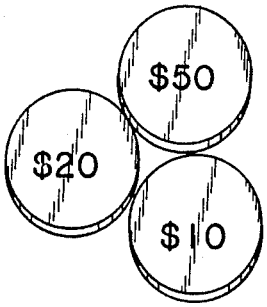
FIG.76C

COMPUTA-CALA : ONE-ARM BANKO

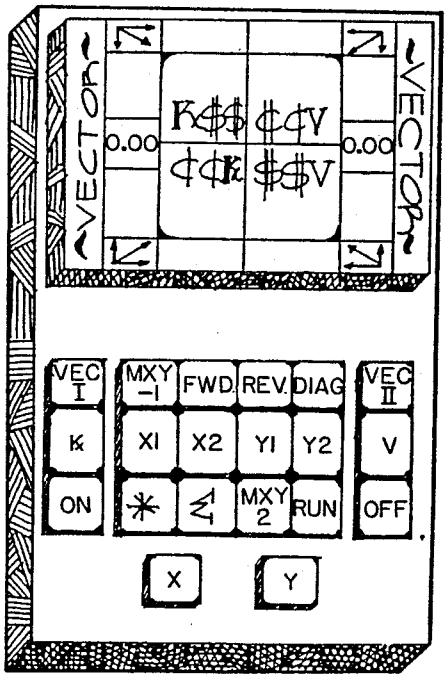
FIG.80
FIG.79A
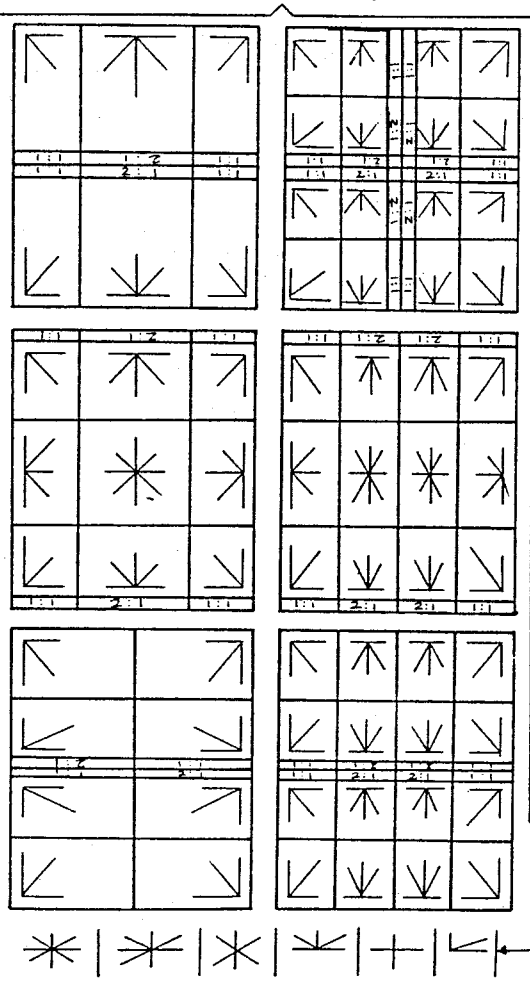
FIG.79
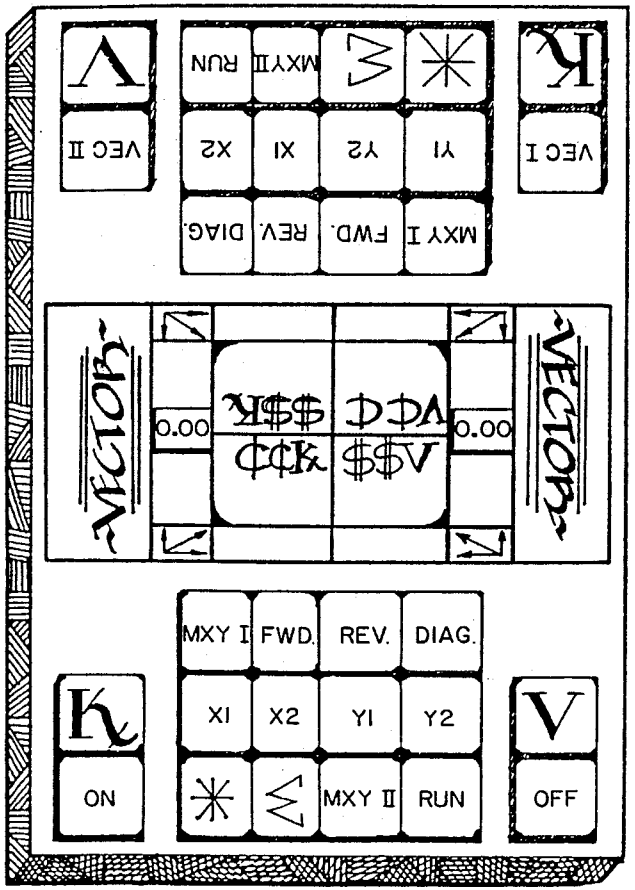

APPARATUS FOR PLAYING

This is a continuation of Ser. No. 165,373, filed July 2, 1980, now U.S. Pat. No. 4,569,526.

CONTENTS

Abstract of the Disclosure
Background of the Invention
Summary of the Invention
Brief Description of the Drawings
Detailed Description of the Present Invention Part I: Game Apparatuses
Detailed Description of the Present Invention Part II: The Basic Cellular "Vectorial" Game
Detailed Description of the Present Invention Part III: Regular Simulation/Scenario Games
Detailed Description of the Present Invention Part IV: Electronical Computerizations
Detailed Description of the Present Invention Part V: The Game Process
Detailed Description of the Present Invention Part VI: Methods of Play Rules of the Game
Detailed Description of the Present Invention Part VII: Evaluation Framework
Claims

BACKGROUND OF THE INVENTION

1. Field of Invention

The present invention is multi-faceted. Its various aspects relate particularly, to preferred embodiments of direction, formation, transference and count and capture games. Significant emphasis is placed on what is called the "MACHTHINK" factor which involves the rapid and skillful setting up of certain winning positions to capture and accumulate value. Speed accounts for up to 50% of the values in the game.

Playing pieces used are color-coded discs, chips, blocks, miniature cards, or 3-D figures and the like, which are differentiated by identifying indicia as to role, value and powers. Opposing players compete to maximize scores by racing against the Mach-1 time frame prescribed—rather than merely making captures. Accordingly, a concerted attempt must be made to expedite moves, captures and settlement transactions in order to earn the maximum Mach-1 speed-of-performance bonus at the stipulated level.

The basic Vectorial game may be described as a miniature directional and formation oriented game which is based on structural behavioral and intellectual aspects represented by the Mancala family games. Such games usually involve the initial setting up of a plurality of seeds in holes on two or four sides of a board and the transference of said pieces with a view toward capturing agreed-upon numerical quantities with the last piece dropped. Games of the present invention improve upon this basic primitive technique by utilization of significantly new means, methods and apparatus to achieve significantly new ends. Games usually represent one of over 1000 "simulated scenarios" and are embodied in a wide range of commercially feasible ways e.g. encasements, Boards, video cartridges, hand-held computerizations, tables and the like.

Improved apparatus for making and playing these Vectorial and Mancala-like games include a game case which contains two built-in timing devices and four storage units for up to two hundred pieces which are differentiated as to color, class, role, power and value; play money which is used to settle financially-related transactions; question and answer cards which contain various types of instructions that bring about unexpected advances and reversals; a doubling device which is used to initiate and increase bets; a standardized, official set of rules governing proper methods of play; and a notation system which may be used to record play for analytical purposes.

2. Description of the Prior Art

The state of the prior art relating to Vectorial and Mancala-like games has remained relatively unchanged in modern times. Several patents have been granted, locally and abroad, but these have not significantly improved the primitive forms underlying techniques, apparatus, embodiments or methods. For instance, none of the patents found disclosed any modification relating to simulation of real-life subjects and events.

The following patents best exhibit the prior art: U.S. Pat. No. 448,574, 1891, assigned to Milton Bradley; U.S. Pat. No. 3,170,696, 1955, Champion; U.S. Pat. No. 1,265,761, Ehrenhardt, 5/15/1918; U.S. Pat. No. 2,119,751, Nichols, 6/7/1935; U.S. Pat. No. 2,292,219, Escaudra, 8/14/42; U.S. Pat. No. 2,319,159, Salomon, 5/11/1943; British Pat. No. 11051, Parsonby, 1902; British Pat. No. 28115, Dyson, 1909 British Pat. No. 476,480, 12/9/1937; South African Pat. No. 751,664, Price, 1955.

A careful study of these and other patents revealed that they all failed to significantly change the conventional structure and methods of playing Mancala games. Undoubtedly, the two most pertinent patents are U.S. Pat. No. 448,574, dated 1891 and U.S. Pat. No. 3,170,696, dated 1955. The first relates to a conventional 4-row Mancala game (called Chuba) and the second to an improved game board, with built-in scoring beads, for 2-row Mancala games. The intelligence that forms the basis for the Vectorial games of the invention are unique. Halma, Mill, Wari and Mastermind, in part, evidence some basic aspects of Vectorial techniques which we have significantly improved.

The basic Vectorial game of the invention is a miniature built on a MX½ matrix, as defined, and may be played with 4 pieces placed in the 4 cells. Structurally, this game is the smallest—and one of the most difficult games of skill. Tic-tac-toe, Totlaspi, Achi, Mu Torre and even the 5 points/4 pieces Pong Hau K'i are larger.

A technical analysis of this basic miniature game—called Vector—reveals that certain dynamics occur directly as a result of the limitation of its syntactical essences. In respect to time the game has no equal as to speed of play in all three phases: opening game, middle game and end game. In space the action takes place on a Vectorial matrix which is limited to four cells, four pieces and forward, reverse and diagonal moves. Rules assign roles and values, moves and captures, and accuracy of thought is almost as important as speed of implementation.

An important aspect of the game is its diversity of forms. The basic, cellular matrix of the miniature game (4 cells) was expanded both in respect to the number of cells, rows and directional sense of the vectors.

Mancala (from the Arabic "naqala", meaning "to transfer") is the generic name for a count and capture type game widely played in Africa and the Middle East. It is known by hundreds of different names among which WARI (a 2-row version) and OMWESO (a 4-row version) are the two best known in the West.

An in-depth study (see H. R. Murray's "History of Board Games", Oxford Press, 1952) reveals that the essential aspects of play common to most forms of Mancala games have remained constant, with few, if any, changes in the state of the art. For instance, in the two-row games called "Wari," the board consists of two horizontal rows of six cells along its edges with two larger depressions for storage to the left and right of the rows. The initial set up calls for four pieces (beans, stones, cowrie shells, etc.) to be placed in each cell. A move begins with one player lifting all the pieces in any hole and "sowing" one in each successive hole, counter-clockwise, until the last piece is deposited in a hole on the player's or his opponent's side of the board. No capture can be made on the player's side of the board and a move ends when the last bean is dropped whether or not capture occurs. If the last bean dropped is in a hole on the opponent's side of the board and if that last bean "made" the contents of said hole two or three, then these beans are captured and placed in the player's storage compartment. Further, if there are additional holes "made" with two and three beans and if these are contiguous to and continuous with the hole captured, then contents of these holes ae also taken by way of bonus capture(s). Even if the beans have different colors, there is no differentiation as to value or powers. Thus, the object of the game is to win the majority of beans, each having the same value of one point.

The four-row game is somewhat more sophisticated. In the game called Omweso, the board consists of four rows of eight depressed, egg-shaped holes. The initial set-up is four seeds per back row hole for a total of 64. In some variations of the game, seeds or beans may be rearranged on making the opening move. A player lifts and sows seeds in any hole with dropping restricted to the front and back row cells on his/her side of the board. Since the object of the game is to de-mobilize or capture all of your opponent's pieces and so transfer them to your own side of the board, there is no need for storage facilities and none are provided on the board. If now in moving along and round these two rows (counter-clockwise), the last bean drops in a loaded front row hole on the player's side with both cells directly opposite loaded, then all the pieces in those two cells are captured. Captures are not removed but "sowed back" with several rounds being possible before the move ends. A move ends when the last piece sowed falls in an empty cell. In some cases, if only the front hole is loaded, seeds in these are taken. A rule variation permits capture of a single back row cell from the player's loaded back row cell directly opposite. A move continues, relay-fashion (as in a race) with all the captured beans until further captures are made or the move comes to an end with the player dropping his last bean in an empty hole. The object of the game is to immobilize your opponent by reducing him/her to "singletons" (which cannot be moved) or to capture and transfer all the pieces to your side of the board. Thus, captured pieces are merely transferred from one player's side to the other and never removed from the board.

In sum, these specific features represent the prior state of the art where the most widely-accepted methods and rules of playing Mancala two and four-row games are concerned. The disadvantages implicit in the prior state of the art account for Mancala's lack of wide appeal in America. These and other disadvantages, summarized hereinafter, are overcome by the wide range of improvements offered by my invention. A careful evaluation of the prior art reveals the following major points:

1. Mancala is played in the ground or on a board, usually with six to eight cup-shaped depressions on either side.
2. The initial set-up is usually one, two, three, four, or more beans in each hole of the two-row game or in the back row holes of the four-row game.
3. Playing pieces are usually seeds, beans, stones, cowrie shells, or marbles, all of the same color, without any value being attached to color variation (if/when they occur), size or shape of the pieces.
4. There are no special pieces, with all the pieces having the same values and powers.
5. Play is usually restricted to two persons or two teams facing each other in north/south confrontation position.
6. There is no official time factor as an integral part of the game. However, an honored tradition does exist wherever Mancala is played: "speed is of the essence."
7. The game carries no penalties or fines in terms of forfeiting pieces; and bonuses, if any, are limited to the contents of en prise cells as described hereintofore.
8. There are no reverse moves in the two-row game.
9. There are no diagonal moves in the two-row game.
10. There are no diagonal moves in the four-row game, although some variances of Omweso permit a reverse move from left corner cells if such a move results in capture.
11. The game is never designed to depict or simulate an event beyond the intrinsic nature and essence of the game itself.
12. There is no standardized method of play or notation for professional tournaments, recording of games for review and analysis, or masters/grandmasters classifications.

With these limitations inherent in all commercialized forms of the game, Mancala predictably failed to capture the imagination of the American consumer. This is so in spite of the fact that several attempts have been made by established toys and games companies to market the game locally. In each case the historical boat-shaped or rectangular board with depressed cup-shaped holes on two or four horizontal rows was used. Playing pieces used have been seeds, stones, beans, or marbles.

Among the firms which have attempted to make and market Mancala games along conventional lines, i.e., on a rectangular or boatshaped board with depressed, cup-shaped holes and with beans or seeds for pieces, are Milton Bradley (Richard's invention, dated 1891) U.S. Pat. No. 448,574; the Mystic Company (Champion's invention dated 1955—U.S. Pat. No. 3,170,696).

All the limiting features of the prior art are overcome by the present invention, in regard to a new and improved form of the game, as well as methods and apparatus. The net effect is enhanced educational and entertainment appeal. Furthermore, standardization of rules and regulations (together with a new system of notation) provide bases for re-positioning the game among the world's best.

Vectorial miniatures and their large Mancala-like variations may be graphically designed to simulate a scenario for any subject-matter with dramatic appeal. This claim is attested to by the drawings and a sampling of examples which exemplify the infinite scope of the process and product line capability.

Prior art achievements may be gleaned from an in-depth study of the available literature of which the following bibliography is highly representative:

1. Alamayahu, S. "The Game of Ghana," Ethnological Society Bulletin, Addis Ababa, 9, 1959, pp. 9–27.
2. Bennett, G. T. "Wari," Religion and Art in Ashanti, (R. S. Rattay, ed), Oxford: Oxford University Press, 1927, pp. 382–98.
3. Chaplan, J. H. "A Note on Mancala Games in Northern Rhodesia," Man, London, 56, 1956, p. 168.
4. Collins, G. N. "Kboo, A Liberian Game," National Geographical Magazine, 21, 1910, pp. 944–948.
5. Courlander, H. "The Ethiopian Game of Gobeta," Negro History Bulletin, Washington, D.C., 7, 1941, pp. 21–23.
6. Herskovits, M. J. "Wari in the New World," Journal of the Royal Anthropological Institute, London, 42, 1923, pp. 23–37.
7. Jobson, R. "Wari," The Golden Trade (1623), London, 1904, p. 48.
8. Martin, G. "Somali Game," Journal of the Royal Anthropological Institute, London, 61, 1931, pp. 499–511.
9. Powell-Cotton, P. H. "A Mancala Board Called Songo," Man, London, 31, 1931, p. 133.
10. Rohrbourgh, R. "Count and Capture: The World's Oldest Game," Delaware, Ohio: Cooperative Recreation Service, 1955.
11. Shackell, R. "Mueso, The Board Game," Uganda Journal, Dampala, 2, 1935, pp. 14–20.
12. Zascavsky, C. "Africa Counts," Prindle, Weber & Schmidt, 1973, pp. 116–136.

A careful study of the above cited sources attests to the fact that all aspects of the inventions described hereinafter represent significant improvements over the prior art.

SUMMARY OF THE INVENTION

Two groups of games are disclosed: one is a miniature set of games evidencing Vectorial techniques; the other relates to new and improved types of Mancala-like games. In sum, the multi-facted aspects of the invention may be classified as follows:

1. Apparatus of the games of the invention
2. Game Process
3. Game Products of the Invention:
   a. Miniature "MachThink" Vectorial games in various forms of embodiments e.g. Boardgames, video and hand-held computerizations.
   b. Machcala Generic boardgames, electro-mechanicals and computerizations.
   c. Machcala Simulation/Scenario boardgames and computerizations: Entertainments, Advertisements, and "Enter-trainments," as defined.
4. New and improved methods of play and descriptive annotation System: focus on standardization and professionalization.

Under 3(c) a number of games are described which simulate real-life subject matters—events, sports, hobbies and lend themselves to diverse forms of commercially feasible embodiments. They are syntactically constructed to draw upon the logical, judgmental and creative abilities of playing pieces in selecting, moving and capturing a plurality of playing pieces which are differentiated by symbolic characteristics as to class, powers, roles and values. The objective of the game is to maximize property accumulation (points, runs, cash, etc.) or create certain assigned patterns and formations within a predetermined Mach-1 time frame speed of-play accounts for 10–50% of the total values in the game and is an intrinsic aspect of play.

The primary objective of the invention, however, goes beyond improvements in apparatus and quality of play. By simulating popular, real-life subjects and events of educational and entertainment value to millions, the game of the invention will serve to assist in the training function in diverse fields requiring technical expertise via mastery of a body of knowledge. Further, they may be used for advertising and promotional purposes with a view toward furthering trade and commerce, establishing goodwill, generating prospects, etc. Obviously, the games meet the expected norms as entertaining devices and have been rated very highly by several consumer testing panels.

The games of the invention utilize a wide range of so-called "game matrices" consisting of one to eight rows of two to twelve cells. The choice of the game matrix is one of the critical variables essential to the simulation/scenario function. Others include: the determination of pay-off odds and vectors for said matrix; the design of the "centerfold" or central motif in the "transaction" area at the center of the matrix; the decoration of the badges for the respective cells (in order to enhance the reach of the scenario); the choice, classification, decoration and valuation of value pieces, special pieces, special "power" pieces and designation of same; the determination of questions and answers for the question and answer (Q & A) cards if necessary to create the educational function; establishment of speed-of-performance or Mach-1 time frame and bonus level; creation, testing and refinement of the rules of play regarding the setup, moving, switching, capturing, scoring, etc. These structural and behavioral aspects are particularly essential to the proper development of promotional objectives.

The simulation effect must succeed in "psyching-in" the player to a fair representation of "real" areas of the subject matter being treated. The establishment of a related glossary of terms and interrelated rules of play are extremely important functions. All other aspects of the "scenario" must be so structured as to heighten the degree of the "simulation" quotient as well as its aesthetic, educational and/or entertainment appeal. The various steps of the simulation process are described in depth and several examples are presented to exemplify the scope of the invention.

New and improved methods of play developed relate to both Vectorial and Mancala-like games vis-a-vis: mach factor and determination of Mach-1 time-frames; standardization of initial set-up; moving and capture rules; new "switch" moves (reverse, vertical, diagonal); a system of fines and bonuses; and, descriptive notation system which is used to record moves and outcomes.

Vectorial techniques perfected led to the improvement of certain mathematical puzzles via inclusion of the game's intelligence in playing tangrams and pyramid formation games. Transfer of all behavioral dimensions to computer-based micro-processing technology was successfully accomplished.

As a direct result of these and other improvements over the prior art, the games of the invention in particular, and Mancala games in general, may now be played at much higher levels of intellectual challenge and with far more suspense. Professional level play—in the category of Chess, Go, Checkers and Backgammon—is directly facilitated by the standardization of official rules and the improvement of the notation system.

Other merits of the invention will become clear from a study of the description of its apparatus, methods and games, as stated in the specification and shown in the accompanying drawings.

BRIEF DESCRIPTION OF THE DRAWINGS

The description herein makes reference to 21 sheets of accompanying drawings wherein like reference numerals refer to similar components throughout the several figures, and wherein:

FIG. 1 is a plan view of the encased playing field of a "scenario" boardgame produced by the process in a preferred embodiment simulating a stock exchange game, hereinafter called Machcala "Stock Exchange" or parent simulation game. Machala Combination (MC III/8) Matrix.

FIG. 2 is an illustration of a Machcala game "overlay" for the game case of FIG. 75. It represents a matrix particularized by 3 rows on either side of a centrally-located value-line and a series of 8 cells per row. The overlay has a second game on the reverse side.

FIG. 14 is an illustration of a non-encased Machcala-like game board for an educational game called 'CALA-PREPCENTER.

FIGS. 14*a* and 14*b* illustrate subject matter of drills indicated on both surfaces of a 2-piece keyboard used to play the game of FIG. 14.

FIG. 14*c* shows both faces of chips used to play this game.

NOTE: The row designations herein relate to the number of rows in each receptacle area on either side of the centrally-located

FIG. 75 is an axiometric view of the game case which is used for encasing the matrices. Note the built-in timers and storage compartments.

FIGS. 75*a*–75*c* illustrate three optimal forms of the receptacle areas: flat, mounded and troughed.

FIGS. 76–80 illustrate electro-mechanical and computerized embodiments of 'Xchange and vectorial games of the invention—for "hand-held", console or casino play.

FIG. 79 illustrate the universe of vectorial moves created for the various games.

DETAILED DESCRIPTION OF THE PRESENT INVENTION

Part I. Game Apparatuses

Figure 3:
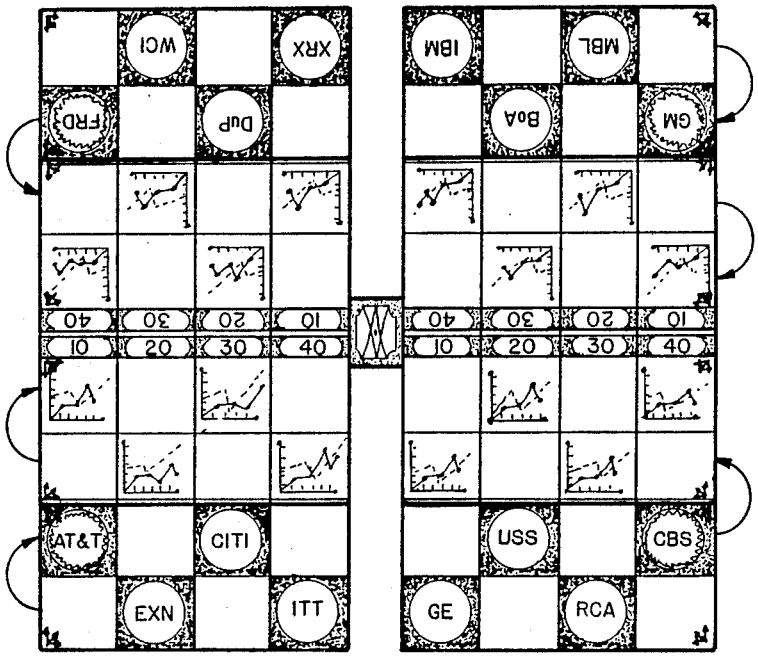
FIG. 3 is a plan view illustrating a variation of the preferred embodiment of the game on a 4-row (MRIV/8) game overlay matrix.

Referring particularly to the invented game case illustrated in FIG. 75, it will be seen that numerous advantages will accure from usage of said game case to embody the game of the invention, in particular, and Machcala games, in general.

A cross-section (9) is shown cut through the case in order to illustrate structural fit of the timing device (7). The field of the case (12) should be regarded as a "stage" on which the drama of the game "scenario" or "simulation" will be staged. The stage should approximate a square 18"×18" with "stage left" and "stage right" separated by the ridge of the case which is usually 1"–1.5" in height and width.

The case consists of its playing field (12), two built-in timing devices (7), four storage units(1) with capacity for a plurality of playing pieces which may be chips, cards, discs, 3-D figures, etc. The four storage units (1) may be made of plastic or compressed cardboard with removable covering (2). Each storage unit (1) is held firmly inside its respective storage compartment by projections (3) along the sides which groove into indentations (4) and thus prevent spillage when opening or closing the game case. At the same time, the storage unit (1) may be pried loose and removed from the case if so desired. The storage units illustrated in FIG. 1 have dimensions of 1.5" deep, 2" wide, and 7.5" long.

The game case used to embody the games of the present invention is similar to the traditional backgammon case except for the above-mentioned improvements. In addition, the receptacle areas (consisting of one to four rows of horizontally-arranged cells) may be flat, troughed or mounded. See FIGS. 75*a*–75*c*. Conventional battery operated timing devices, of suitable dimensions, were secured and glued down, as shown. Thus, the timing devices become a unique feature of the game case, as well as the built-in storage units. In certain variations the usage of non-built-in timing devices, e.g. hourglasses, chess clocks, etc., may be used. This would in no way depart from the essence of the Mach or Speed feature of the exact game and variations of the present invention.

FIGS. 57–65 illustrate a set of four-rowed rectangular matrices containing four to twelve cells per row—so-called MRIV/4-12 matrices. Any of these game matrices may be imprinted on the floor of the Machcala game case (FIG. 75), or on any other surface, to represent the playing field. All MRIV/4-12 matrices consist of four horizontal rows of 4–12 cells or posts on either side of a "value-line" area which serves to separate each player's "home board" from that of his/her opponent.

Numerical designation of matrices relate to the number of rows on each player's "homeboard". Comparison with conventional enumerating system vis-a-vis Mancala games is facilitated by equating Machcala one row to Mancala two-row games and Mancala two-row to Machcala four-row games. Although in the illustrations the maximum number of cells in each row is limited to twelve, it is to be understood that said maximum number may be extended beyond twelve. In fact, an MXIV twenty-four cell configuration for 4 players was successfully tested with minor modifications to the initial set up and capturing rules. Numerous tests have proven, however, that quality of play is highest in the 8–12 cell range. The designation of "switch" or "optional moves" cells which permit changing from regular forward direction to a "vertical", "reverse" or "diagonal" direction is indicated in the respective cells by the 3-way vectors. See FIGS. 30, 39, 48 and 57.

FIGS. 48–56 are illustrations of a series of nine three-row Machcala "combination" (MCIII/4-12) game matrices consisting of *three* horizontal rows with a series of 4–12 cells or posts on either side. The centrally-located "transaction" area separates each player's homeboard from that of his/her opponents. In most "scenario" games the value-lines are separated by this "transaction area" which serves as the main "design field" for simulation purposes. Although in the illustration the minimum number of posts is limited to four and the maximum is twelve, it is to be understood that the maximum number of cells may be extended.

FIGS. 39–47 are illustrations of a series of nine two-row Machcala (MRII/4-12) game matrices, each consisting of two horizontal rows of 4–12 cells or posts on either side of a "transaction area" which serves to separate each player's "home board" from that of his/her opponents. Although in the illustration the minimum number of posts is limited to four and the maximum to twelve, it is to be understood that the maximum may be extended and the minimum reduced to two.

FIGS. 30–38 are illustrations of a series of nine one-row Machcala (MXI/4-12) game matrices, each consisting of one horizontal row of 4–12 cells or posts on either side of a "transaction area" or design plane which serves to separate each player's "home board" from that of his/her opponents. Again, although in the illustration the minimum number of posts is limited to four and the maximum to twelve, it is to be understood that the maximum number of cells may be extended beyond twelve and the minimum reduced to two.

The game matrices of FIGS. 30 to 65 are rectangular playing field matrices. They may be made from various materials, including but not limited to paper, cardboard, glass, plastic, leather, leatherette, wood, etc., and may consist of one, two, or more pieces. When a matrix is not pasted down, there is usually an additional game field on the reverse face.

FIGS. 66–74 show alternative designs of Machcala game matrices. These may be used to vary the design function for aesthetic purposes. The game's playing field may therefore be of diverse form or shape other than the preferred rectangular design. Games have been made with playing fields in the shape of a circle, diamond, square, triangle, oval, pentagon, hexagon, septagon, octagon, as well as other irregular shapes.

FIGS. 16–29 illustrate various playing pieces used to play the basic game and variations of the present invention. Playing pieces are of different kinds—various-colored chips, mini-cards, discs, 3-D figures, etc. The playing pieces used are always differentiated by way of symbolic indicia as to class, color, power, value, and role, and vary in size as per dimension of the receptacle areas of the playing field. Regular plastic and casino poker chips were used as playing pieces, with identifying characteristics on each face. Colors used were, in order of value, gold, silver, blue and red. Miniature cards used are much smaller and thicker than conventional American or westernized playing cards. Thus, so-called Machcala cards used were 1/10" to ⅛" thick, 2" long and 1½" wide. For discs the dimensions and 1/16" to ¼" in thickness, and 1"–2" in diameter. In the main, miniature 3-dimensional figures are 1" wide and 2"–3" high and are usually magnetic-based.

Indicia on both faces of chips or cards usually vary and provide for the playing of other variations of the game. (Playing pieces are also used to play other games included in specially designed "super" sets which usually contain three or more basic variations). In that chips, cards, and discs allow for stacking, ready and easy recognition, "sight" counting or "measuring", the speed and mathematical exactitude of playing Machcala is far greater and more exciting than Mancala.

Figure 28:
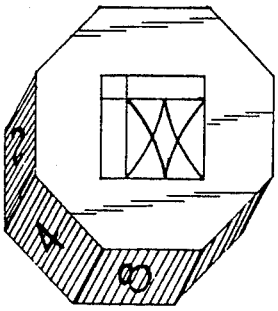
Figure 29:
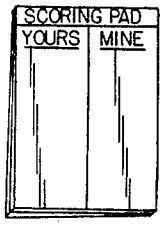
Figure 30:
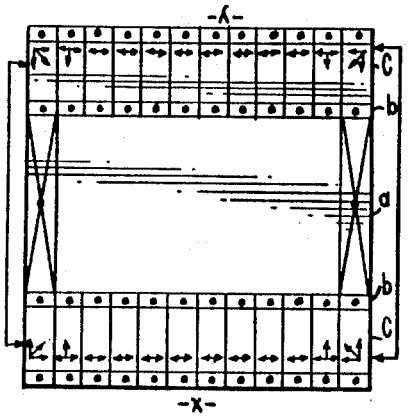
FIGS. 30–38 are illustrations of one-row Machcala "Xchange" (MXI/4-12) matrices. Switch (vectorial) options are shown completely in FIG. 30.
Figure 31:
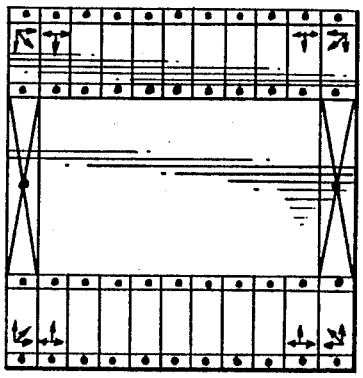
Figure 32:
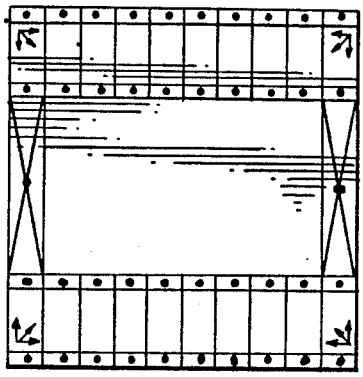
Figure 33:
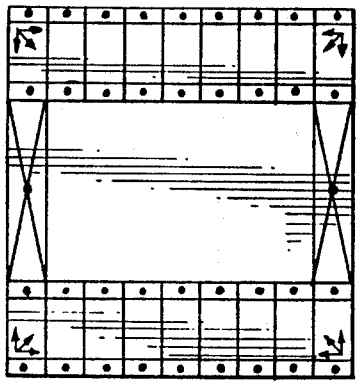
Figure 34:
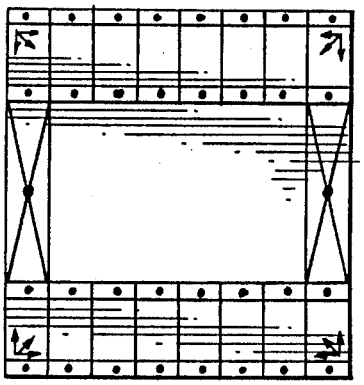
Figure 35:
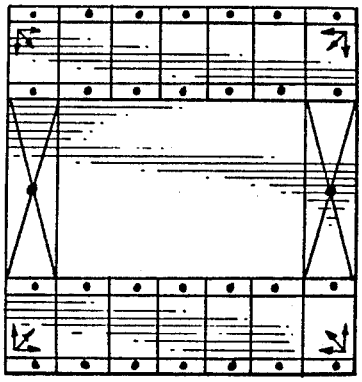
Figure 36:
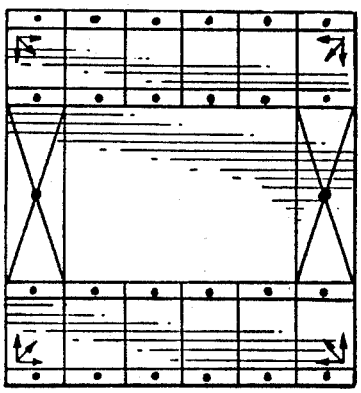
Figure 37:
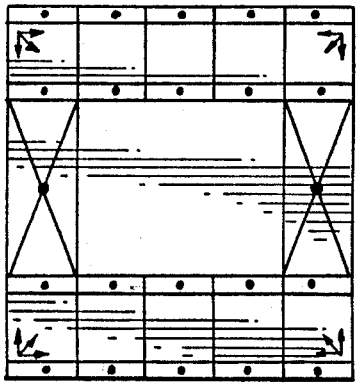
Figure 38:
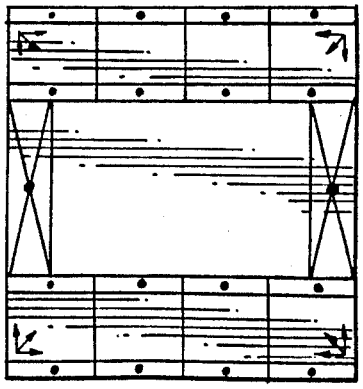
Figure 39:
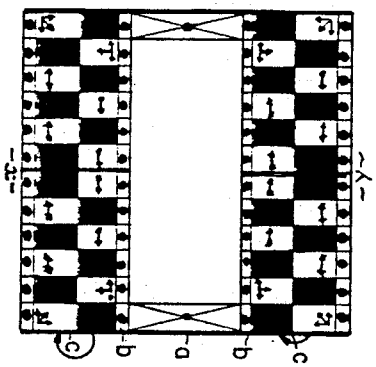
FIGS. 39–47 are illustrations of two-row Machcala "Relay" (MRII/4-12) matrices with full vectorial options shown in FIG. 39.
Figure 40:
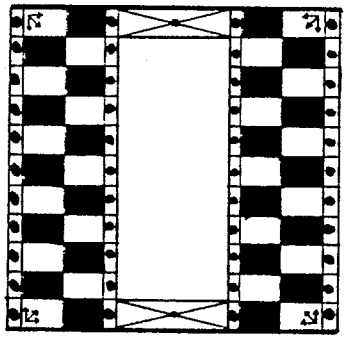
Figure 41:
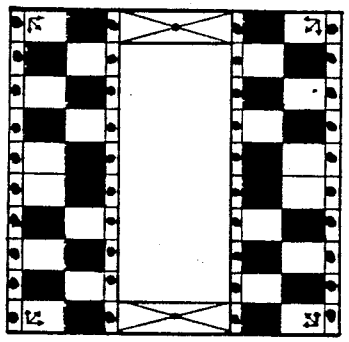
Figure 42:
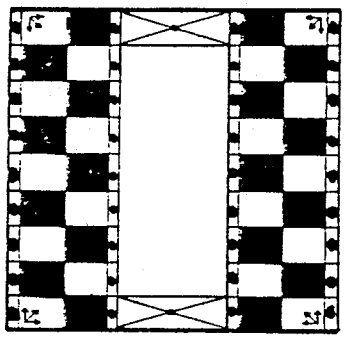
Figure 43:
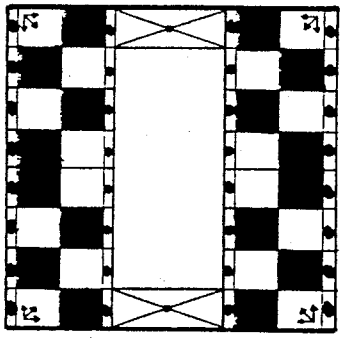
Figure 44:
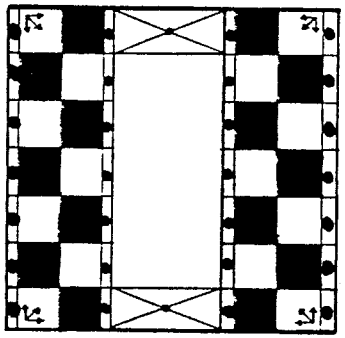
Figure 45:
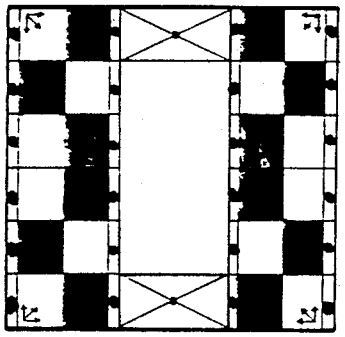
Figure 46:
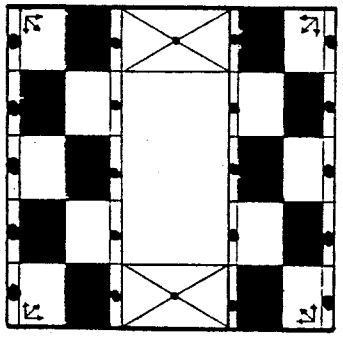
Figure 47:
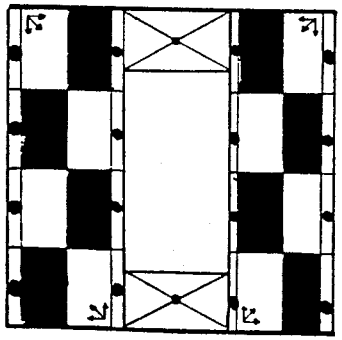
Figure 48:
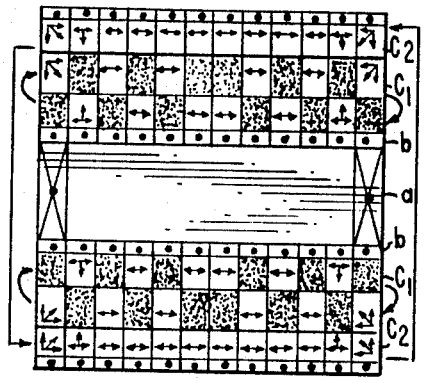
FIGS. 48–56 illustrate three-row Machcala "Combination" (MCIII/4-12) matrices with full vectorial options shown in FIG. 48.
Figure 49:
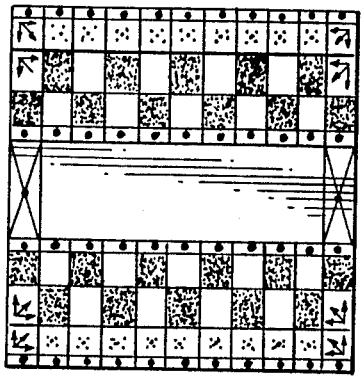
Figure 50:
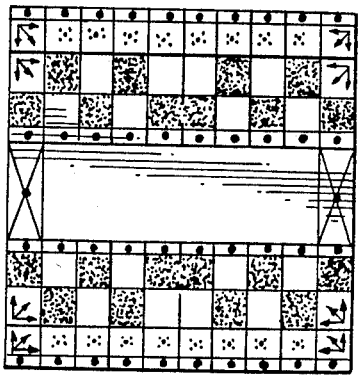
Figure 51:
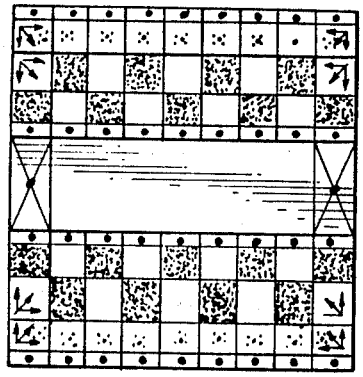
Figure 52:
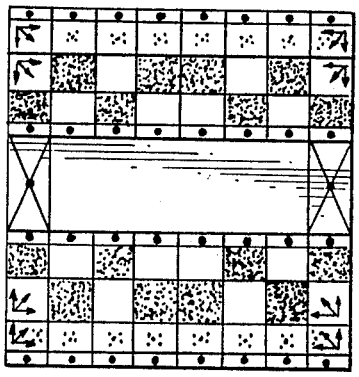
Figure 53:
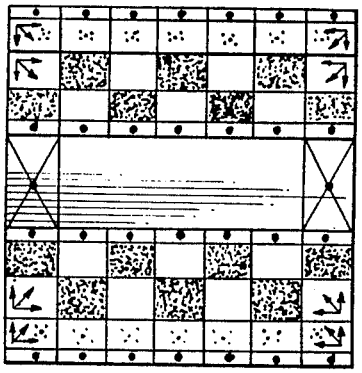
Figure 54:
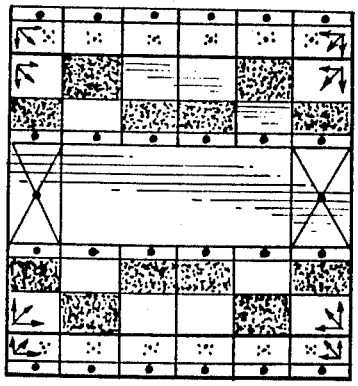
Figure 55:
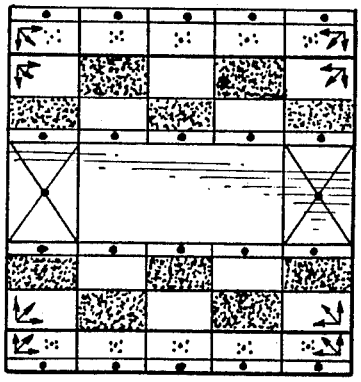
Figure 56:
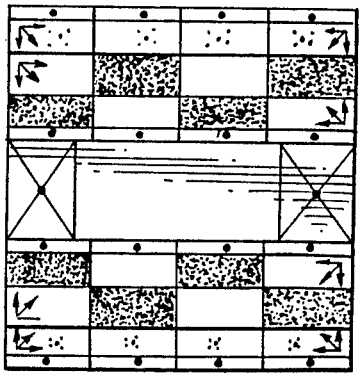
Figure 57:
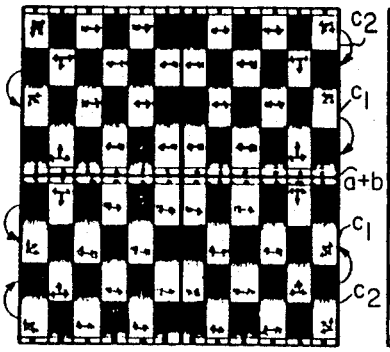
FIGS. 57–65 are illustrations of four-row Machcala "Double Relay" (MRIV/4-12) matrices with full switch options, shown in FIG. 57.
Figure 58:
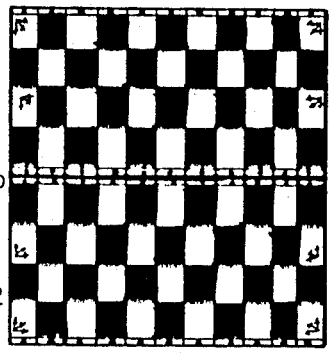
Figure 59:
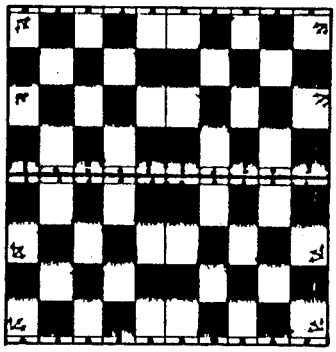
Figure 60:
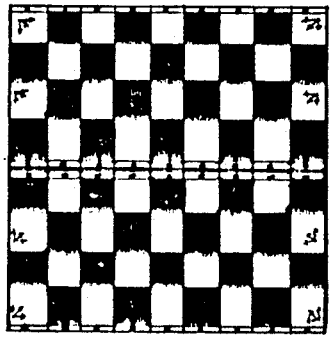
Figure 61:
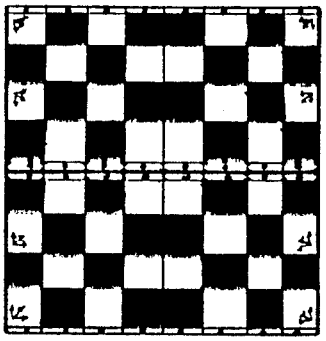
Figure 62:
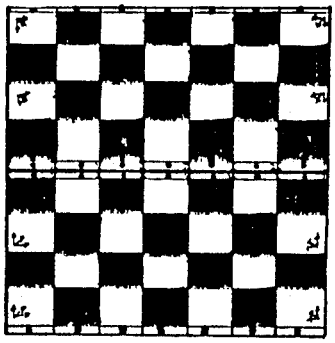
Figure 63:
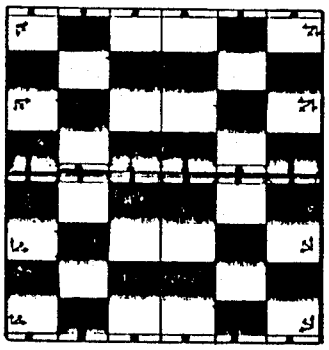
Figure 64:
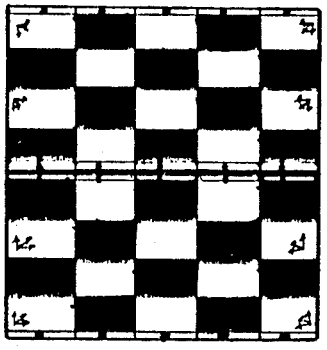
Figure 65:
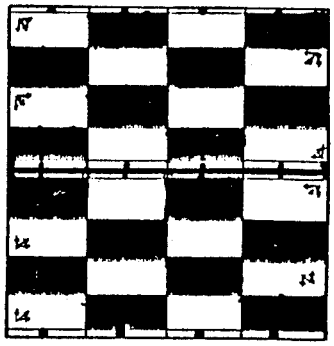
Figure 66:
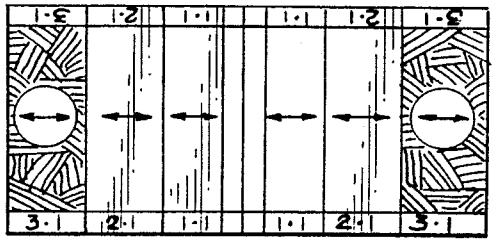
FIGS. 66–74 illustrate several design variation of the matrices used to make some of the "vectorial" games. Refer to FIGS. 30–65.
Figure 67:
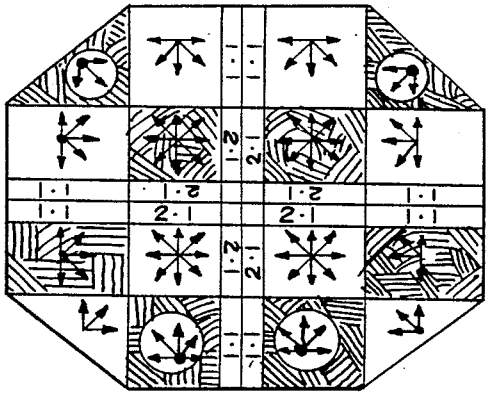
Figure 68:
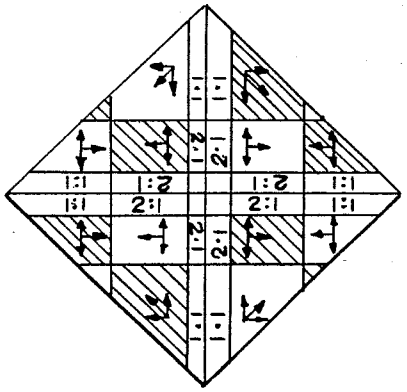
Figure 69:
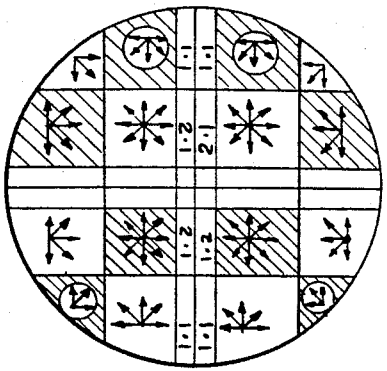
Figure 70:
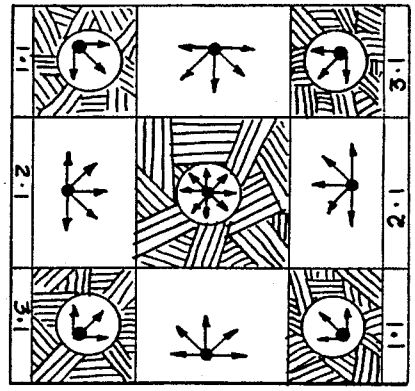
Figure 71:
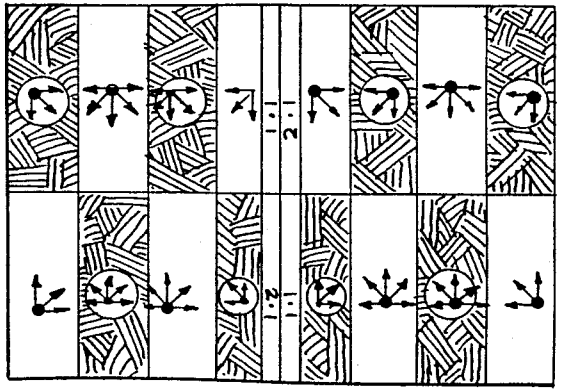

FIGS. 26–29 illustrate various accessories which are used to play the basic game of the invention and other variations. FIG. 28 is a rendition of the doubling device used in the game called the Machcala "Wheel-of-Fortune" Doubler. It is used to initiate, then double and redouble bets from twice to two-hundred and fifty-six times the original amount of the wager.

Another apparatus which plays a critical role in the game is the regular 3- or 5-minute "egg timer" or hourglass. These may be used as "timers" when a case with built-in timing devices is not used to embody the game.

Questions and answers and/or "chance" are used to introduce an educational and risk function into the game. Question and answer cards prevent the removal of captured pieces if questions are not correctly answered. See Methods of Play section. Chance cards contain directives of two kinds: those which positively affect the player's position or score and bring about unexpected advances; and those which have a negative effect and bring about reversals. The over-all effect of this element is about 20% of final score.

Play money is a critical ingredient for all financially-oriented games and is used to settle captures at pay-off value immediately when made or as post-capture transactions. Denominations included are $1–$100 for "low budget" games and $1000–$100,000. Settlement transactions involving payment of captive value and/or fines and bonuses to opponent are usually conducted off the timer and do not affect Mach-1 time frame. Because the color-coded value-pieces indicate value, a scoring pad is not required unless the pay-off factors on the value-line are in play.

In sum, the above-described apparatus was used to meet the structural requirements of the games of the invention and to improve the quality of play. As a result, the games of the invention are far more dynamic and intellectually challenging than conventional Mancala and compare favorably with Backgammon, Go, Chess and other classical games. Most of the apparatus in the game serve to enhance the state of art relating to the structural embodiment of Mancala and Mancala-like games and the way said games are played. How this is brought about will be clearly revealed by an explanation of the syntactical and behavioral aspects of the basic game of the invention and the numerous variants spawned.

DETAILED DESCRIPTION OF THE PRESENT INVENTION

Part II: The Basic Cellular 'Vectorial' Game

The game products of the invention fall under three primary categories: (i) Vectorial Games; (ii) Simulation/Scenario Games; and, (iii) Computerized Games.

In particular, the so-called basic "vectorial" game was reduced to a cellular game on a MCII/2 "miniature" matrix. This game—a vectorial "banking" game called "Banko"—is financially oriented in regard to its scenario.

The basic game encompasses the fundamental structural elements and behavioral dimensions present in the Machcala "Xchange" and "Relay" games, as described hereinafter. Revealed are several unique features which are entirely new to Mancala and Mancala-like games. FIGS. 48–56 show the range of the combinatorial game matrices—from 6 rows of 4 cells to 6 rows of 12 cells. From the smallest of these the (MCIII/4 Matrix) we derived a MCIII/2 Matrix—one with only 2 cells per row. This matrix was used to develop the miniature combinatorial version of the basic game of the invention. See FIGS. 72 and 74.

Figure 72:
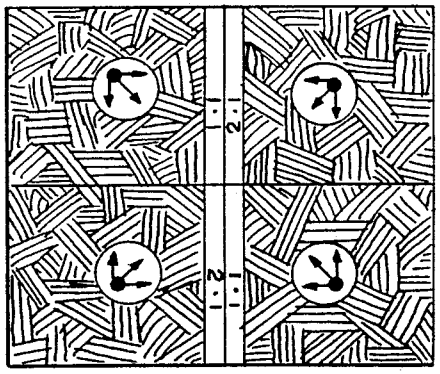
Figure 73:
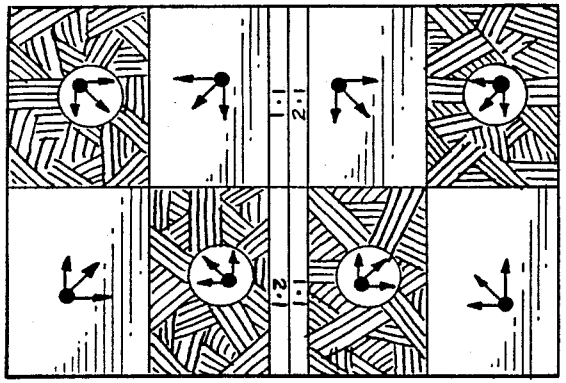
Figure 74:
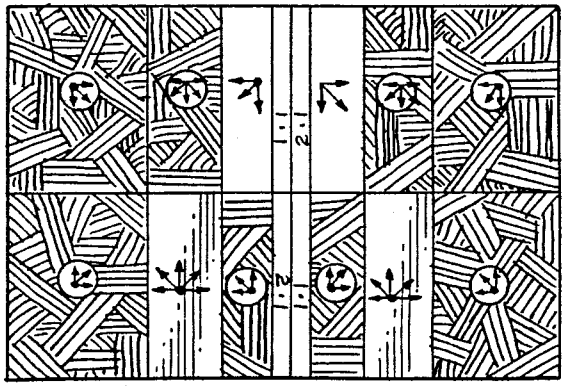
Figure 77:
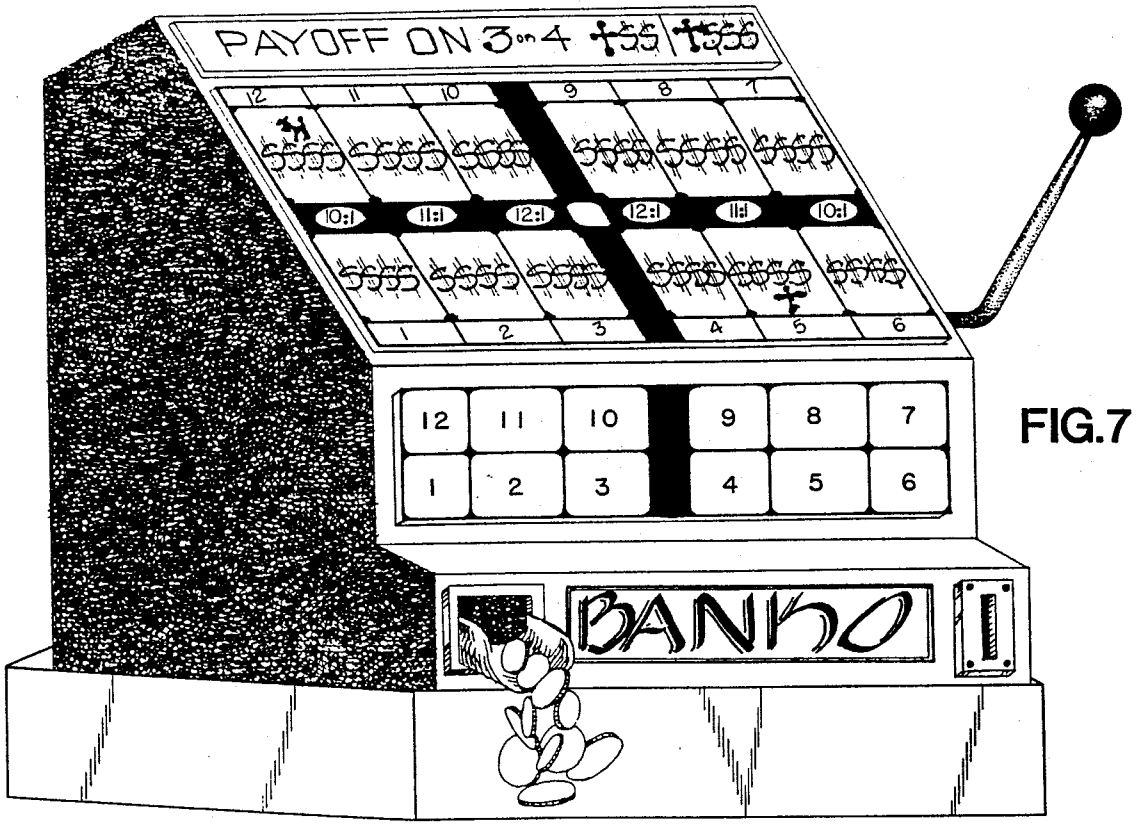

A full and clear understanding of this, the so-called basic game of the invention, is essential to comprehension of the wealth of Machcala games which it generates. Anyone with skills in the field of game design will readily see that several features of this parental and cellular game represent significant advancement over the prior art vis-a-vis games dealing with count and capture techniques and pattern formations e.g. Tic-tac-toe, Morris, Chinese Checkers, and Mancala. FIG. 72 a spinout of the front game of MCIII/2—when played with 4 pieces is alleged to be the "smallest" skill and speed game in the world.

The structural elements of the basic Vectorial game are as follows:

1. The Vector Board a. The Board and receptacle cells (called banks)

b. The "Front" game—played on the first two rows on either side (called X and Y)

c. The 'Back' game—played on X's and Y's back row.

d. The Value-line/Pay-off rations: 1:1 and 2:1 e. Switch Moves Indicators—called Vectors f. Ad-spots for gaming and financial institutions-as shown 2. Playing Pieces and Accessories a. Playing Pieces:

(i) Class "A"—Value Pieces: 4 Silver pieces at $10 each and 4 Gold pieces at $20 each.

(ii) Class "B"—Special "Power" Pieces: 2 "Banko" or "Vector" pieces; 2 killer pieces.

b. Play Money—in $10 and $20 denominations c. A Doubling device for initiating and increasing wagers.

d. Two timing devices—3-minute "hour-glass" may be used.

e. Score pad and pencil—optional.

The Behavioral Dimensions of the game may be classified as follows:

a. Game scenario or setting—financially-oriented; relates to a number of "Banks" or "Casinos" competing for deposits or patronage and offering different levels of pay-off—1:1 and 2:1—on the player making certain winning combinations (pairs).

b. Game objective: to accumulate wealth by placement of the pieces as quickly and skillfully as possible toward "forming" or "hitting" certain winning combinations (pairs, as defined) on opponent's side. A 50% bonus (of accumulated "win") is earned if the player completed the game within the prescribed MACH-1 time frame, as prescribed.

c. Value or Point Pieces: These represent property to be accumulated and are differentiated color-codings as follows: Gold pieces=$20 each; Silver pieces=$10 each. In sum each player has 4 Gold and 4 Silver pieces.

d. Special "Power" Pieces: These are the "Banko" and "Killer" pieces. They have no value when captured. However, they are empowered to make or negate capture as follows: the Banko piece is "Wild" and can form a pair with any other piece when dealt last (see Capturing); Killer negates capture by any piece in the bank it occupies. Only Banko can capture Killer to form a zero-valued "pair." Each player has one each.

e. Initial Set-up—Front game: players place a pair of gold and a pair of silver pieces in two front game (first two rows) Banks-in-competition, and as designated, Banko and Killer in same loaded banks. Initial Set-up—Back game: 2 Gold and 2 Silver in each bank (back row) and Banko and Killer in each of said banks. An audit of both set-ups (front and back game) should reveal that each player initially controls 12 pieces—4 Silver at $10+4 Gold at $20+2 Bankos at $0+2 Killers at $0. Total value in both front and back game is $120—disregarding pay-off factors. Total factored value with gold placed in 2:1 banks would be $200. For this reason each player is given an "opening" bankroll of $200–$1000. The game ends when one player goes bankrupt and cannot meet the call for payment. See End-game rule.

f. MACH or Speed Factor: A player completing the game within a 3-minute (MACH-1) time frame earns a 50% bonus-of accumulated money at the end of the game. The timing device must be started before commencing the move (called deal) in the front game and stopped following the end of the deal in the back game. When captures are made settlement is made "off" the timer. Thus the MACH-1 time frame relative to move-time (deal-time) only. A player completing the game in more than 3 minutes is said to have "finished" in MACH-0 time and earns a reduced 25% bonus of his/her accumulated win.

g. Moving or Dealing: To initiate the first move in the *front* game, the player lifts all the pieces (called set) in either bank and deposits one in each successive bank moving clockwise from one row to the other. Deals are confined to both rows. If the last piece falls in a loaded bank, that set is lifted and then dealt, as in a relay race, until the last piece falls in an empty bank or capture is made, as defined. The first drop must be FORWARD (FRD); the second may be a switch drop in a reverse or diagonal direction. The move or deal in the *back* game is FORWARD (counter clockwise) on the first drop, then Reverse or Diagonal on the next. Forward deal is from X1 to X2 and onto opponent's Y1, Y2.

h. Switch Moves Limitation: A player can only exercise the option to switch (reverse or diagonal) after making a deposit in a forward direction. Only 2 Forward moves, 1 Reverse and 1 Diagonal are allowed per deal. The lift of a new set in a front game relay combination constitutes a new deal. Note too that in "vectorial" games a player may initiate a switch from his own second bank (X2, Y2). See Methods of switching in "regular" Machcala games.

i. Empowering/Swapping & Converting: This procedure involves the exchange of value pieces for power pieces and is not included in the vectorial series of games. See methods of play—regular games.

j. Capturing in the Front Game: No capture may result from the first ("opening") deal in either game. Capture is made therefore when the last piece dealt is not a Killer and said piece lands in a loaded bank-in-competition with opponent's bank directly opposite containing a "Banko pair," or Silver or Gold pair or a pair of specials, as defined. Pay-off value would be determined by the color of the pair and pay-off factor. A pair of specials has no value. If the bank behind that captured also contains a pair these are taken by way of bonus capture. Settlement is not made until the deal in the back game is completed.

k. Capturing in the Back Game: Capture is made in the back game if the last piece deposited on any one of opponent's banks is not a killer and makes a banko, silver, gold or "special" pair (Banko and Killer). If a deposit(s) was made in the other bank and said bank contains a pair, as defined, these are taken by way of bonus capture. Pay-off value is factored 1:1 or 2:1.

l. Settlement Transaction: Captures are evaluated and paid at the end of the deal in the back game. This is usually done "off" the timer. A pair of Silvers captured in a 1:1 pay-off bank is worth $20. A pair of Golds, $40. A pair of Silvers captured in a 2:1 pay-off bank is worth $40 and a pair of Golds, $80. A pair of Specials has no value.

m. Chance Cards: These are usually picked following a move that ends in capture—limited to two. Directives on these cards being about unexpected financial reversals or advances. Not recommended for advanced level play. See rules of play section.

n. Betting/Doubler: Bets may be made and doubled by use of the doubling device, as described, e.g., best time, final outcome, etc., as legal bases for betting.

o. End Game: Both the Front and Back Game end when all value pieces have been captured or players are reduced to one piece each. Pay off is made as per value and position of the piece at 1:1 to 2:1. This may be a mutual exchange.

p. MACH-1 "Speed" Bonus: A bonus of 50% of accumulated "win" is earned if the player completes the game within the MACH-1 time frame of 3 minutes. Completion over 3 minutes is called MACH-0 and earns a reduced bonus of 25%. Speed of play, therefore, approximates 25–50% of the values in the game.

q. Scoring: The score for each player is the sum of his/her accumulated cash win, end-game pay-off cash and MACH bonus. Players start with $200 or $1000 play money ($10 and $20 notes) and play until an agreed-upon total is accumulated or one goes broke. Side bets are usually settled at the end of each game. A score card may be used but is not necessary.

Commentary: It is of interest to note that banks-in-competition bear logos of well-known gaming or financial institutions. Thus, apart from being a useful and entertaining article of manufacture, the game serves as an advertising medium directed toward the furtherance of trade and commerce. The cellular (MCIII/2) Banko game, as defined, is a combinatorial game: the front game is a 2-row (MRII/2) "Relay" game and the back game a 1-row "Xchange" "game, as defined hereintofore. The following variants were developed from the basic combinatorial (MCIII/2) game:

1. MXI/2 (See FIGS. 72–80): This is an isolation or spin-off of the 4-celled back game of the MCIII/2 vectorial. It is played exactly as described for the combinatorial game. Mach-1 is reduced to 100 seconds or 10 seconds per move. Fine for "speed-fault" is $10.

2. MXI/3 and MXI/4: These variants are expansions of the MXI/2—FIGS. 66–74. It will be observed that the cells between the first and last (called corner cells) offer a 5-way option on the next drop, as indicated by the vector (⊻). The maximum number of switch options is represented by the 8-sided vector (✳) in "relay" or combinatorial relay-xchange games. Machcala vectorials are usually limited to 2–4 cells per row in regulation "Xchange" games i.e. ∠ & ⊥.

3. MRXI/3 (See FIG. 70): This is a modification of the so-called front game of the MCIII/2 combinatorial. The center row is "commonly" or "jointly" owned. Thus both players may lift and deal any set in any bank on the center row or on their own row. Capture of a pair of the same color can be made from the back or center row. Vectorial options are limited to the 3- and 5-way switch, as shown.

4. MRII/3 and MRII/4: These variants are extensions of the MCIII/2's front game and are played exactly as described hereintofore. All cells between the four corner cells offer the player a five-way vectorial option as shown. See FIGS. 66–74. Mach-1 is 180 and 240 seconds respectively.

5. Special shapes and sizes: Machcala vectorials were rendered and successfully tested on matrices containing as few as four and as many as 144 cells. See FIGS. 66–74 and 79–80.

6. Two-in-One Combinations: The MXI or MRII matrix may be combined with several popular dice and card games; e.g., MXI/2 vector plus centennial dice game. The placement of numerals from 1 to 12 in the center of the board suffices to provide the field for the dice game. The MXI/2 matrix is drawn on either side.

7. MXI/2+Vector Chess Variant: The vector-chess game is played on 16 cells placed on either side (north and south) of the MXI/2 matrix and the game is played with 10 pawns each and the two Kings and Queens. The object of this variance is to move pieces in such a way as to form pairs, as defined. The King is invested with negative powers of Killer (K) and the queen has the power of vector (V).

8. Vector Game-Cards: Vectorial games may be embodied on any device normally used for making arithmetic calculations. In fact, one variant (MXI/2) was successfully concluded in a credit-card sized calculator and so constitutes what we believe is the smallest rendition of a skill-game ever made.

9. Vectorial "Drill Formation" Games: These variance take one of two forms: (a) toys which are activated by micro-circuitry to move in any of eight directions; e.g., miniature pinball machines, toy soldiers, target-shoots, and the like; and (b) military drill and/or field exercises in which human beings (soldiers, cheerleaders, etc.) act out the intelligence of the game as described for MX or MR series. This is done with great virtuosity and includes dance movements, gymnastics, acrobatics, and the like.

10. Vectorial Game Systems: These embodiments provide the capability for playing up to 12 vectorial games in one set. Capability is achieved via use of game overlays. Another embodiment which achieves the same end is the multi-game TV cartridge for video computer game systems.

DETAILED DESCRIPTION OF THE PRESENT INVENTION

Part III: Regular Simulation/Scenario Games

The simulation capability of the invention is aptly demonstrated by a game derived from the basic "Scenario" or Banko game. It is rendered as a MCIII/8 matrix (in the form of a combinatorial game) and represents the "parent" simulation game of the invention. The difference between the basic scenario game and the simulation game is one of degrees—the depth of treatment vis-a-vis the game's representation of the subject treated. Let us examine the game of FIG. 1 called the "Machcala "Stock Exchange" simulation game. Note that the game case has two built-in timing devices which serve to facilitate the "speed" aspect of the game. See FIG. 75.

The game setting relates to a day's activity on the "floor" of a National Stock Exchange and pits two players ("members of the Exchange") against each other. Both players are in charge of 24 "posts"—the three horizontal rows of 8 cells each on either side of the value-line in FIG. 1. The playing pieces are color-coded chips bearing indicia which assign value as blocs of shares. The price per share in each post is indicated ($10–$40) on the Value-line. The first two rows on either side of the Value-line represent "X'"s and "Y'"s "front" or "Sell" game; and the third row represents the "back" "Buy" game.

The objective of the game is twofold: in the front game, players attempt to "corner" and "sell" shares; i.e., effect capture at the *highest* prices; in the back game, the goal is to buy shares at the *lowest* prices. The net effect is the realization of gains or losses on invested capital. Mach-1 is 15 minutes and earns a 50% bonus.

The "initial set-up" is made by each player selecting a plurality of value chips (colored gold, silver, blue, and red) sufficient to place four (one of each color) in each of the eight *un-charted posts* of the "sell" game on the first two rows; four value chips are also placed in each of the eight cells of the back row or "buy" game. There is a total of 64 value chips in each player's set-up; 16 gold chips (or cards) bearing identifying numerals which stipulate value as blocs of 10,000 shares each; 16 silver chips representing blocs of 7,500 shares each; 16 blue chips representing blocs of 5,000 shares each; and 16 red chips representing blocs of 2,500 shares each. Each "point" chip (6*a*) bears indicia on one face indicating its value. The initial set-up continues with each player entering the special pieces called Macks (M) Big Mach or 'Cala (Cx) and Rex or Killer (Rx). One Mach (called Dealer) is entered in each loaded post. Finally, "Cala (called "Chairman of the Board") and Killer (called "Commissioner of the Xchange") are entered in each game in four different loaded posts—2 in the front game and 2 in the back. This completes both players' "initial Set-Up". An audit is then conducted to ensure that each player has 84 pieces on his/her side of the floor—42 in the front game and 42 in the back.

The total number of shares represented by the 128 blocs on both sides is 800,000 and the average value per share is $25. Therefore, the total value of shares traded by both players is $20,000,000—$25×800,000. Accordingly, each player "activates" a 100% credit line (secured by shares managed) and borrows $10,000,000 (in play money) from Central Bank. Funds of the Central Bank are held in cash—$1,000–$100,000 bills.

If an educational function is desired players place a deck of Q & A cards beside the board. Questions relate to the Street Market and finance. If not a special deck of chance cards with "Head Office" instructions is shuffled and placed on the table beside the recommended doubling device.

Directives on the chance cards contain both "pro" and "con" instructions affecting financial positions. With verification and setting of the MACH-1 time frame and the fixing of the "price for the seat" on the Xchange (first bet), the game is formally setup for the opening "ceremonies" to commence.

Before the opening move may be made certain preliminaries have to be attended to; e.g., drawing for first deal; (b) exercising option for initial rearrangement; and, (c) bidding on the first contract or capture.

The flip of a chip or coin usually decides first move. The winner, however, has the right to forfeit the first move if he/she so desires. After this is decided the first player states if he elects to play with the initial set up, as is, or with a "rearrangement" of pieces in the front and/or back game. These rearrangements have been tested and are somewhat similar to "opening moves" in chess. Both players then negotiate the "opening contact" which must be for at least 10,000 shares for each game, i.e., a silver and red, or two blues, etc., as prescribed by the system of valuation. No captures can be taken from the floor until this "opening contract" is made. Once it has been made, however, all captures are "open" as described hereinafter.

To begin: the player activates his/her timer, and, lifting all the pieces in any of the 8 loaded front ("sell") game posts, deals one in each successive post in a *clockwise* direction. Moves in the "sell" game are confined to the players' first two rows and may involve several relay-type "runs" or "laps" before the move finally ends, as described hereintofore. See Switch Move Options.

Next, the move in the back or "buy" game is made by the same player lifting all the chips in any of the eight loaded (third-row) posts and dealing one in each post in a *counter-clockwise* direction. Moves in the back game are from the last post of X's back row to the first post of Y's and vice versa—in the manner of two-row Mancala games described hereintofore. Generally, pieces are dropped as lifted. However, rules for this game require that special pieces be dealt last.

The order of the deal is (a) any kind of value piece in the order as arranged before the deal begins; (b) Machs (aka dealers or brokers); (c) Big Mach (Chairman of the Board); and, (d) Killer (Commissioner of the Xchange). While the Specials are being repositioned the order of the pieces ("set") may be changed. This is the only time a player may change the order of the pieces prior to his/her lifting said pieces to make the deal. This option to change the order of pieces prior to dealing provides the player with an opportunity to re-position value pieces, Big Mach and Rex, as he/she sees fit. When overt counting is forbidden it also enables the player to covertly assess the number of pieces in each set under the guise of claiming to be "only rearranging" or "stacking" while, in fact, counting.

Capture is made in the front ("Sell") game in any instance in which the last piece dealt is a Mach or 'Cala that lands in any loaded in-competition post of the player's first two rows, as indicated. If said post is loaded with one or more pieces (value or special) and if the charted post directly opposite on the same file on opponent's side is loaded with two, three or four pieces (of any kind), these are said to be "hit" or captured.

Once the opening contract of 10,000 shares or more has been made, all subsequent captures maybe made without regard to value, provided the number of pieces hit is two, three of four. Thus, such captures could be as low in value as 5,000 shares (2 blocs of 2,500 shares each) or as high as 40,000 shares (4 blocs of 10,000 shares each). Prior to settlement value pieces captured in the front ("sell") game are stacked before the post(s) from which they are brought (captured).

A bonus capture is earned as follows in the front ("sell") game: If the non-charted post before/behind opponent's In-competition post from which capture has been made also contains two, three, or four pieces, these are taken by way of bonus or "proxy" captures. A player may elect to continue or stop dealing after capture is made. All "sell" game captures are mandatory. However, transactions are not settled until after the back game move has been completed.

After the "sell" game move ends (whether in capture or non-capture) the player makes the "buy" game move with the timer still running. Capture is made in the "buy" game whenever a "dealer" or the "Chairman" lands in any of the opponent's loaded back game posts which contains one, two, or three pieces—making total contents thereof two, three, or four pieces. (These pieces are said to be "made" as against "hit" in the "sell" game.) If other posts in which chips were dropped in that deal or "run" also contain two, three, or four pieces, and if these are "chained" or linked" (i.e., contiguous to and continuous with the first post from which capture was made) then these chips are also captured. All captures in the back game are classified as "offers" or "buy opportunities" and are *optional.* If the "offer" is accepted, the player keeps pieces captured (including specials) and pays for value pieces only, as per "Price Per Share" stated on the Value-line for the respective posts: $10, $20 , $30, $40.

In that all shares "brought" are worth $25 each when cashed in at *end of play,* the object is twofold: (a) to sell high for case in the "sell" game; and, (b) buy low in the back or "buy game." *The Player stops his/her timer whenever the back game move is completed.* The opponent then "settles" all outstanding "transactions", if any, and the player picks one or two chance cards and follows "orders" which may relate to paying or collecting outstanding loans (margins), interest, etc. Opponent then starts his/her timer and attempts to set up winning positions as described hereintofore for the MCIII/8 Banko game.

When all the value pieces have been captured, the Stock Xchange "closes" for the day and the players then proceed to ascertain their "closing" positions. All captures would have impacted on each player's financial position in one of two different ways: some capture transactions would have resulted in a gain being realized; others would have caused a loss to be sustained. For instance, all "sales" at $10 and $20 per share and all "purchases" at $30 or $40 per share constitute "loss" Transactions. It becomes obvious after playing this "Stock Exchange" variant a few times that "playing the posts" (maximizing "pay-off" capture values) is of vital strategic importance.

In many instances a player may "sacrifice", i.e., give up certain "low-valued" captures, in order to "set up" opponent for more ruinous losses.

Next in strategic importance to command of the value-line is the corner game—called "playing the corners". To switch or not to switch? Which switch? These and other aspects of strategic play are discussed hereinafter in the sections dealing with Methods of Play.

The object of the game is to maximize wealth at the end of play—as a percentage return on the $10,000,000 stock portfolio held at the start of play. Therefore, a player may well be advised to "expose" high priced "sacrifices" and/or forego high-priced "buy opportunities". The most critical area of proficiency, however, may well be mastery of the "corner game", i.e., effective usage (both offensive and defensive) of the "switch" options from the indicated corner posts.

These then are the important procedural and strategic aspects of playing the so-called "Stock Market" simulation game. I feel that it is fair to say that the various innovations described in this game and elsewhere in the specification, represent a new and significantly improved process for making and playing Mancala games, in general, and Mancala-like simulation games in particular.

Figure 4:
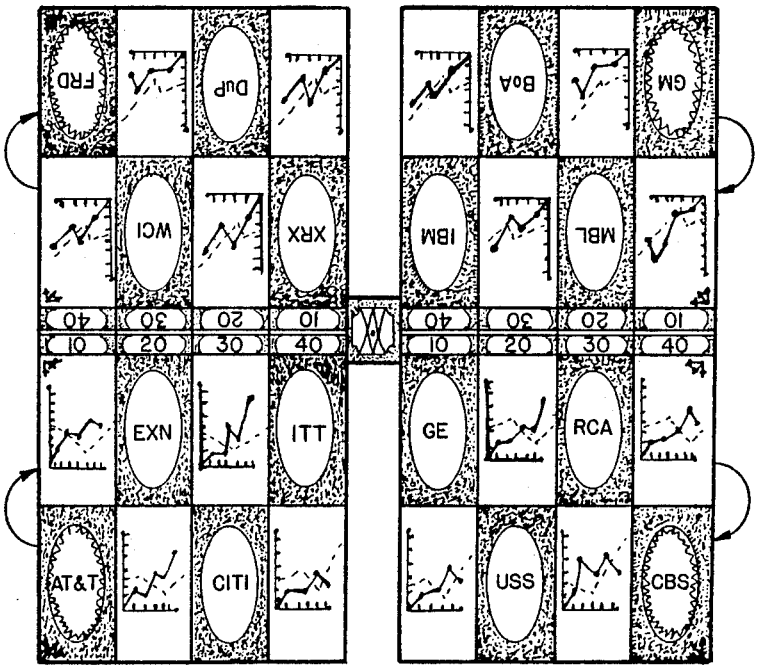
FIG. 4 is a plan view illustrating the same game on a 2-row (MRII/8) matrix. Note that optional moves from the "switch" cells are indicated by the 3-way arrows shown.
Figure 5:
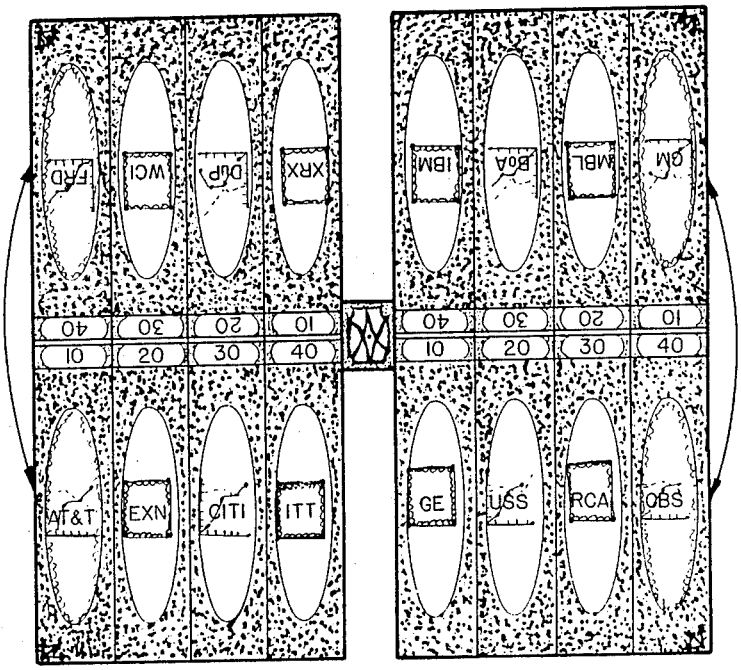
FIG. 5 is a plan view illustrating the same game on an MXI/8 overlay-matrix.
Figure 5A:
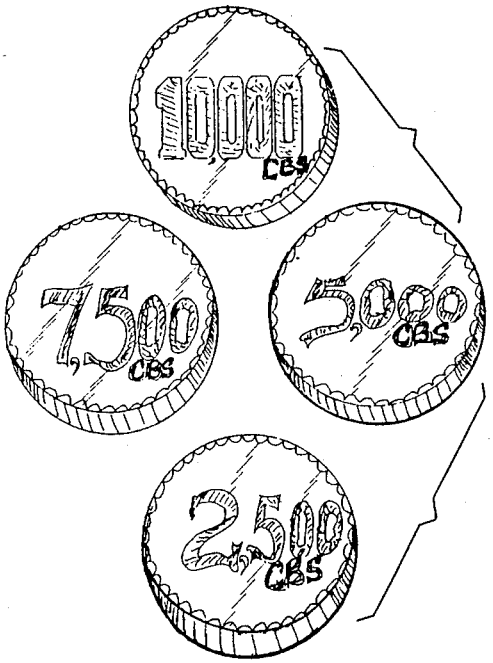
FIGS. 5*a* and 5*b* are examples of playing pieces used to play these and other games of the invention.
Figure 5B:
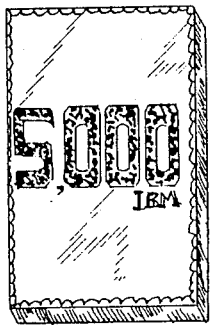

The preferred embodiment of the parent simulation game (FIG. 1) is shown on a MCIII/8 cell matrix. Although this format is recommended as that which provides the highest quality of play, it is not to be regarded as the only way to render the game. FIGS. 3, 4 and 5 show other variations of the same game on the MRIV/8, MRII/8 and MXI/8 matrix. These three variations are played as follows:

The variation shown on the MRII/8 matrix (FIG. 4) is an abbreviated version. The eight charted posts of both rows represent the "front" or "sell" game and the *eight* "logoed" posts of both rows represent the "back" or "buy" game. The price per share on the value-line is the same—$10–$40 per share—for an average price of $25 per share. Rules (moves and captures, etc.) are similar to those as described for the front game of the Stock Exchange variant. In this version, however, all posts are "in competition" and all captures are compulsory. As a result, this version is a much faster game than the full (MCIII/8) game and Mach-1 time frame is prescribed at 10 minutes. Machcala cards (FIGS. 20–23-)—bearing pertinent indicia as to class, values, power, and roles, may be used for playing pieces instead of poker chips or counters.

Machcala Xchange may also be rendered on the MRIV/8 game matrix. In this variation, players' moves are confined to their own side of the floor with the "sell" game represented by the action on the first two rows and the "Buy" game by the third and fourth rows, as indicated in the drawing. See FIG. 3. Chips or cards may be used as pieces as described hereintofore. This version of the game is, in fact a doubled MRII/8 rendition and is played substantially as prescribed for the front game of the "parent" simulation.

FIG. 5 is an illustration of a variation on a one row (MXI/8) matrix. The charted posts represent the "Sell" game and those logoed represent the "Buy" game, as shown. In this version of the game, all captures are mandatory. The game is played substantially as prescribed for the "back" or "buy" game of the basic game and the parent simulation game. Mach-1 is 10 minutes per player.

All time frames for Machcala Xchange games and variations were pre-tested and established in order to emphasize this critical aspect of play. Numerous tests at different levels of proficiency proved that these levels of "speed" can be achieved with practice. As a result, it is felt that a ten-minute Mach-1 time frame for MXI and MRII versions is within the reach of most players who adhere to the caveat that speed counts. All MCIII/8 and MRIV/8 games require a Mach-1 time frame of at least 15 minutes—excluding time used for post-capture transactions.

DETAILED DESCRIPTION OF THE PRESENT INVENTION

Part IV: Electronical Computerizations

All the vectorial and Mancala-like games of the invention may be rendered in electronic and computer-based embodiments. See FIGS. 76–80. The microprocessor incorporated in any of these games is a miniature electronic system with a computer program which supplies the intelligence for memory, response, and detection. When used in conjunction with other electronic elements in a circuit, lights and sounds are actuated to promote additional dimensions of play.

The following description exemplifies this capability by way of several examples: (1) Computerization of MachCala Xchange and Relay games; (2) Computerization of Vectorial Games (Vector: MX1/2) and certain variations.

Computa-Cala Game System: FIG. 76 embodies the capability of all forms of MachCala. It will be recalled that the objective in these games is to make or hit 2's, 3's, and 4's as defined hereintofore, and so maximize the accumulation of wealth as quickly as possible. In the MX1/10 "Banko" game of FIG. 76, a move is made by a player programming the computer to transfer all pieces from any one of his/her 10 banks, one by one (counterclockwise prior to switching) in each successive cell until the last piece is dealt. Capture situations arise when the *last* piece of any set dealt is deposited in one of opponent's cells which contains one, two, or three pieces of any value or classification. The deposit of this *last* piece will therefore increase total contents of that bank to two, three, or four pieces. Capture-value is "stored" by the computer or transactions may be "settle" as they occur—with chips or play money. The capturing player's "win" is increased by the pay-off ratio for the respective banks, from 1:1 to 5:1, as shown in FIG. 76.

For purposes of this illustration, only FWD, REV, and DIAG moves will be used and from corner banks only. Macs are omitted and only the two power pieces will be used, with powers vested as stated heretofore. Big Mac (called "Banko" or "Chairman of the Board") captures and earns a bonus of 100% of value captured. Rex is called "Commissioner of the Xchange" or "Killer" and prevents capture by *any* piece. There are two levels of play—PRO I and PRO II. Pro-I excludes all switch moves, multiple capture limitation, and Mach bonus. It is recommended for beginners. At PRO-II level all aspects of advanced play are involved, including switch moves, multiple capture limitations, Mach bonus, betting, etc.

The game ends in one of two ways: (i) when the total contents of one player's cells is reduced to zero and he/she cannot be "fed," at least one piece by his/her opponent; (ii) when the number of pieces remaining in play on each side is such that there is no possibility of a capture.

Components of the Game (i) The Console

As shown in FIG. 76, the game board console consists of two keyboards, a screen, value-line with pay-off odds and two rows of 10 cells, numbered X1–X10 and X1–Y10. Although in this case $n=10$ cells, the game plays out as well with $n \geqq 4 \leqq 12$ cells.

(ii) Value Line Pay-off Odds

Each cell pays a different ratio of dollars to capture-value as shown. The pay-off ratio for cells ranges from 1:1 to 2/n:1.

(iii) Playing Pieces

There are two classes of playing pieces: Value pieces represented by dollar signs ($); and special power pieces represented by the symbols "+" (Big Mac) and "K" (Killer). The value of each "Value piece" may be set at $1, $10, $100, or $1000.

The Special ("power") pieces restrict or enhance capture capability. (Although these pieces have no value, they do count in the number of pieces in a cell for capture purposes.)

Big Mac must be computerized as a "positive" force. Thus, when it makes a capture the capturing player is "credited" with a 100% bonus of capture-value. Killer, on the other hand, represents a "negative" force. Whenever this piece occupies a cell, no piece therein may effect capture. A captured "killer" may be "recalled" from "STORE" and brought back into play for defensive purposes. Big Mac, however, may not be recalled. Both power pieces have no value.

(iv) Programming Moves

All moves begin forward (counter-clockwise) with the transfer of the total content of the set dealt to each successive bank or cell. There are four legal moves which may be programmed:

(i) 1st Forward (FRD) Compulsory
(ii) Reverse (REV) Optional
(iii) Diagonal (DIAG) Optional
(iv) 2nd Forward (FRD) Optional The player must "start" his/her timer (MACH) before inputting the "move-program." The first drop of any deal *must* be in a FORWARD (counterclockwise) direction. After this has been done the player has the option to "switch" the direction of the next drop or drops, subject to certain limitations. At the end of programming the deal the player must *stop* his/her timer (MACH) and instruct the computer to "RUN". The sequence for programming a move is therefore [MACH—to start timer, +FORWARD—move of set selected; +switch moves, if any, +MACH—to stop timer; +RUN].

The first switch option (Reverse or Diagonal *must* be "initialed" from opponent's first or last ("corner") bank. On the 10-cell matrix (MXI/10) "X" can only initiate a switch move from Y1 to Y10 and "Y" from X1 to X10. Thereafter all 4 corner cells (X1, X10, Y1 and Y10) are open. The second switch move (Diagonal or Reverse) can be made from any of the 4 corner cells—following a switch move. Example: Illustration of Programs for a move:

Y: Forward with set in BAND #9 (Y-9); Reverse from X1 to Y10; Diagonal to X10; Forward to completion. PROGRAM: MACH . . . Y-9 . . . FRD . . . X1 . . . REV . . . Y10 . . . DIAG-X10 . . . FRD . . . MACH . . . RUN.

X: FORWARD deal from X8 and Reverse from Y1. PROGRAM: MACH . . . X8 . . . FRD . . . Y1-REV . . . MACH . . . RUN.

Example of Some Legal Switch Moves for "X"

1. FRD/REV from Y1
2. FRD/REV from Y10
3. FRD/DIAG from Y1
4. FRD/DIAG from Y10
5. FRD/REV from Y1/FRD from X10
6. FRD/REV from Y1/DIAG from X10
7. FRD/REV from Y10/FRD from Y1
8. FRD/REV from Y10/DIAG from Y1
9. FRD/DIAG from Y1/REV from X1
10. FRD/DIAG from Y10/REV from X10
11. FRD/DIAG from Y1/REV from X1, 2nd FRD
12. FRD/DIAG from Y10/FRD to Y1/REV from Y1

Example of Some Illegal Switch Moves ("X")

1. FRD to X10, REV from X10
2. FRD to X10, DIAG to Y10
3. FRD to X1, REV to Y10, DIAG to X10
4. FRD to Y1, REV to X10, FRD to Y1, REV to X10, FRD to Y1

Switch Move Limitations

During the course of a deal a player has one "Reverse" and one "Diagonal" switch option. Further, as stated, all switch options must be initiated from opponent's first or last call. After the first switch all corner cells are "open". In this particular version the vertical (up/down) switch move from the X2, X9 and Y2, Y9 have been omitted.

Initial Set-Up

Each player begins with 50 value pieces (Dollar Signs) which are apportioned five to each bank and two special pieces (1 K and 1+) which are placed in the last two "loaded" banks on each side. Thus each player initially "controls" 52 pieces. It must be remembered that the two special pieces (K and +) count as pieces, but have no value.

Captures

Captures occur when the last piece in a set dealt "lands" in a cell on opponent's side which contains 1,2, or 3 pieces (making the total content 2,3, or 4).

Multiple captures in the 10-row game are limited to 5 sets of 2,3, or 4 which form an unbroken "chain" on opponent's left or right "homeboard." This occurs when the player's last 2,3,4, or 5 pieces are dropped on opponent's side in consecutive banks containing 1,2, or 3 pieces. Multiple captures are not limited if player captures in all ten banks in the course of the same deal.

Mach or Speed-of-Performance Bonus

There are two speed ("Mach") time frames:

(i) Mach-1—Any player completing the game within the alloted 15 minutes "moving" time frame earns 50% of the total value he/she has accumulated at the end of the game. Note that moving time does not include "settlement" time used to make payments with chips or play money.

(ii) Mach-O: This relates to any speed slower than Mach-1. The bonus earned is such that Mach-1: Mach-0=2:1. Thus a completed game in Mach-0 time frame (15 minutes) earns a bonus of only 25% of the player's accumulated value at the end of the game.

The Keyboard Controls

As illustrated in FIG. 76 there are two separate keyboards, one for each player. The thirty-six (36) symbols represent the following functions:

1. "ON"—Switches "on" the computer.
2. "OFF"—Switches "off" the computer
3. "STORE"—Performs several storing functions:
   (a) Storage of player's capture-values
   (b) Storage of special pieces
   (c) Storage of Mach time elapsation
   (d) Storage or "deep freeze" of the game for subsequent re-call.
4. "Auto"—Enables one or more players to play against the computer
5. "MANO"—Enables two or more players to play against themselves with the computer acting as "work-horse" (making moves, reading out status reports, making captures and capturing sound, etc.)
6. "PRO-II": Increases the level of difficulty when playing "Auto", i.e., against the computer 7–26. X's and Y's banks, rows and power pieces (+and $K_x$)

27. The sign "*" (asterisk) commands clearance of a program before "run" is made.
28. "Rev" Key—Commands the "Reverse" switch move.
29. "DIG" Key—Commands the Diagonal switch move.
30. "Vert" Key—Commands the Vertical swtich move.
31. "MACH"—Initiates and terminates time used to "think and write" the program for the deal
32. "FWD"—Commands first and second forward moves
33. "BET/$"—Initiates bet and doubles same—$1.00–$2.00, $10–$20, $100–$200, etc. ala the doubling cube in Backgammon
34. "DBL KEY"—Doubles bet, if any
35. "READ"—Commands the computer to read-out various status reports, e.g., capture-value accumulation in any bank or all banks, number of pieces in a bank, accumulated "mach" time used, etc.
36. "RUN"—Commands the computer to effect the moves as programmed by the player.

The Cala Cassette

Computa-Cala game cassettes contain all the basic games plus one or more sim/scen variations, e.g., basketball. The formats depicted in FIGS. 76–80 illustrate a selection of generic scenarios which were used in conducting tests.

Casino Gaming Variants

Two variations of the computerized Machcala BANKO game have been successfully developed for casino gaming purposes:

(i) Slot-Machine (or one-arm) BANKO. This is embodied in the traditional manner with push-button or lever control. See FIG. 77.

(ii) Casino (Table) BANKO—This variation is represented on a "computerized" table decorated with disco-type lighting effects (not illustrated).

These games are ideally suited for this kind of embodiment and would seem to generate very high levels of interest amount game lovers at all intellectural levels.

Critical Variables and Lists

The Computa-Cala games program was written in BASIC language and run on a XEROX SIGMA-9 computer. The critical variables and lists used are dimensioned in steps 100 to 130, and are as follows:

(1) A$ = text string array containing the contents of the cells, at the start of the game:
A$ (1) = contents of X1 = "$$$$$"
:
:
A$ (10) = contents of X10 = "$$$$$R"
A$ (11) = contents of Y1 = "$$$$$"
:
:
A$ (20) = contents of Y10 = "$$$$$R"

(2) Y$1 – 36 and X$1 – 36 are arrays containing the commands:

| | |
|---|---|
| X1/Y1 | + (Cala) |
| X2/Y2 | $K_x$(Killer) |
| X3/Y3 | RI |
| X4/Y4 | RII |
| X5/Y5 | RIII |
| X6/Y6 | RIV |
| X7/Y7 | BET |
| X8/Y8 | DBL |
| X9/Y9 | FWD |
| X10/Y10 | REV |
| Y1/X1 | DIG |
| Y2/X2 | VERT |
| Y9/X9 | * |
| Y10/X10 | READ |
| | MACH |
| | RUN |

(3) O = Array which determines in which order pieces will be dropped in the cells. Thus, if:
O (1) = 16 (J = Array which is used during each move as a copy of O)
O (2) = 17
O (3) = 18
O (4) = 19
O (5) = 20
O (6) = 1
O (7) = 2
Pieces would be dropped in cells Y6, Y7, Y8, Y9, Y10, X1, X2.

(4) X = Array which contains the total # of captures in each cell.
X(1) = captures in cell X1
X(2) = captures in cell X2
.
.
.
X(11) = captures in cell Y1
.
.
.
X(20) = captures in cell Y10
X(21) = Total of X's money
X(22) = Total of Y's money (5) Q = Array which is kept temporarily to record cells which are captured.
If Q (1) = 16
Q (2) = 17
Q (3) = 18
Cells Y6, Y7 and Y8 were captured.

(6) C$ = text string array which contains the order of each move. Thus:
MACH,Y10 FRD X2,MACH,RUN -continued would be stored as:
C$ (1) = "MACH"
C$ (2) = "Y10"
C$ (3) = "FWD"
C$ (4) = "X2"
C$ (5) = "MACH"
C$ (6) = "RUN"

(7) E$, F$, H$, M$ are text strings used to store only temporarily information. They are changed during each move.

(8) B$ = text string array used temporarily during printing of the board.
B$ (1) is also used as a text input string. In other words, upon each command input, B$(1) is set equal to the command.

VARIABLES (1) K1—the number of "Killers" in the chosen cell.

(2) B1=the number of "Bankos" in the chosen cell.

(3) R=can we Reverse? If R=0, we can reverse; if R=1, we have already reversed and cannot reverse again.

(4) D=can we diagonal? If D=0 we can diagonal. If D=1, we have already diagonaled and cannot diagonal again.

(5) S1=Have we Switched Yet? If S1=0 we have not switched yet and must initiate our first switch move from opponents corner cell. If S1=1 we have already switched and can make the second switch from any corner cell.

(6) S=where are we in the 0 array? Originally, S=1 which means that the number of the first cell we move is put into 0(1); next S is incremented by 1 which means that the next cell we move to is put into 0(2), etc.

(7) C1=can we capture? If C1=0, we can capture with a move from the cell chosen. If C1=1, the cell we chose can't capture because of the number of pieces therein or Killer's presence.

(8) C5=where we are in the C array.

(9) C2=number of the current command; every time we input a command, the value of C2 changes.

(10) V1=Value of the chosen cell (factored at pay-off ratio)

(11) M1=Length of the chosen cell: If we chose cell X1 which="$$+K" then M1=4, etc

(12) G=Indication of whose turn it is to move:
If G=1 then its X's turn to move
If G=−1 then its Y's turn.

A copy of the program and print-out which provide the basis for microprocessing of the "intelligence" of this and other electro-mechanical and computer-based games of the invention, if needed, will be forwarded under separate cover. Said games include, but are not limited to the basic game of the invention ("BANKO") and all "scenario" and simulation games described hereinafter. See, in particular FIGS. 76–80. Thus, anyone with skills in the field of computer games and microprocessing technology will agree that I have resolved the "software" problems which hitherto precluded the advancements in the state of the art. Accordingly, the games of the invention may be used as models to reduce several strategic games to computerized format if they are based on vectorial and ManCala-like concepts, as defined.

Computerization of Vectorial Games

Figure 78:
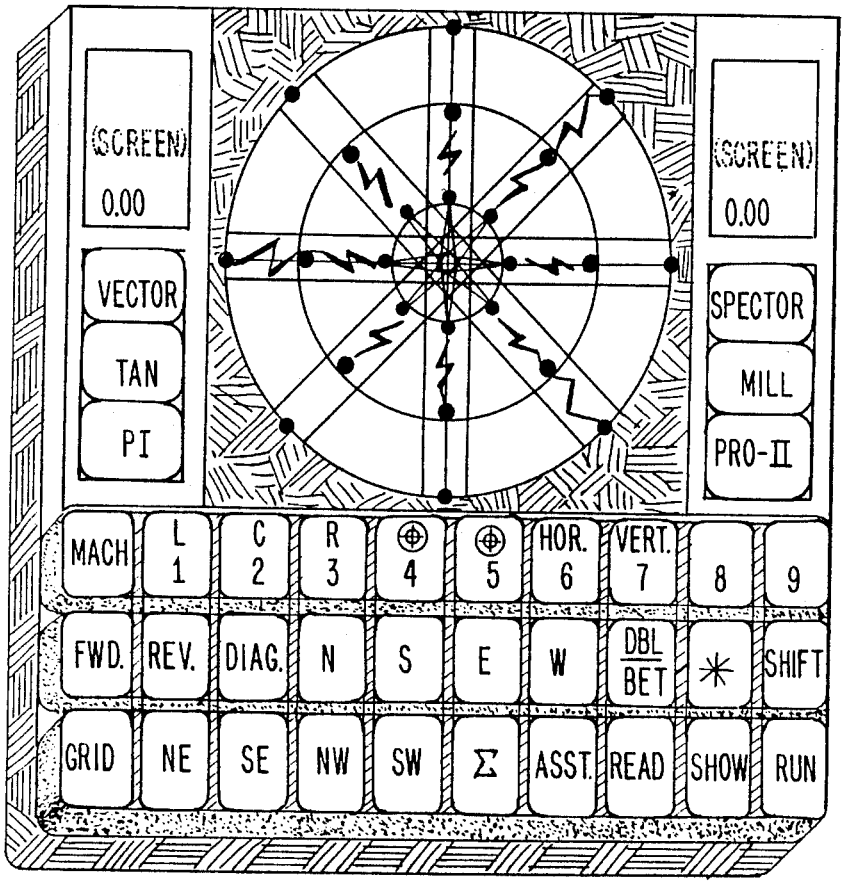
Figure 78A:
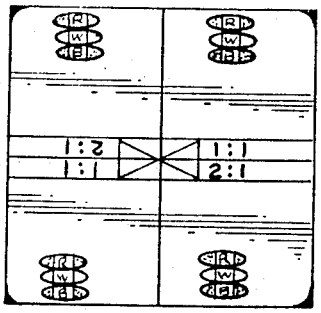
Figure 78C:
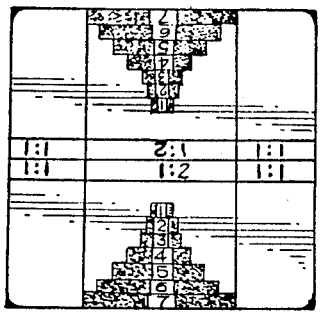
Figure 78B:
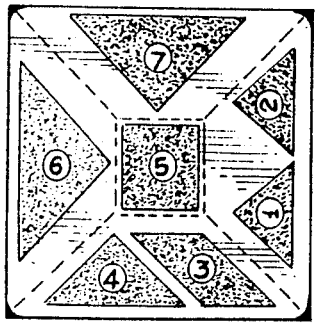
Figure 78D:
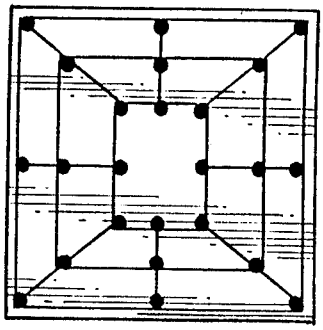

FIGS. 78–80 are illustrations of computerized vectorial game variations. FIGS. 79–80 are, in fact, compressions of the so-called "corner" game of the MXI/10 with the vectorial (switch) options ranging from 3–8. The related computer program was derived from that created for the MXI/10. The program supplies the intelligence, memory, response and detection capability which are used with other electronic elements in a circuit to facilitate the creation of lights and sounds which enhance the behavioral dimensions of play.

Structural and Behavioral Aspects

1. Name: VECTOR BANKO (Financial Scenario)
2. Value Pieces—$=$20 and ¢=$10 (any 2:1 ratio will do)
3. Special "Power" Pieces: Vector (V) and Killer ($K_x$)
4. Payoff Folders: 1:1 and 2:1
5. Mach-1 Time Frame: 100 seconds
6. Bankroll—as required Doubler—used to initiate and increase side bets re: final outcome, speed, etc.

8. The Keyboard—as illustrated in FIGS. 79 and 80 whereby the following keys represent different functions:
   a. MXY-I/MXY-II record time used between "Start" and "Run/Stop" Commands
   b. FWD, REV, and DIAG Keys=Forward, Reverse, and Diagonal moves
   c. X1, X2, Y1, Y2=cells (banks)
   d. "*"=Correction
   e. =Summation of capture-value or time lapsation
   f. "X" and "Y"=Players
   g. Run=move/program implementation
   h. VEC-1 and VEC-II=Levels of play, as defined.
   i. "K" and "V"=Special power pieces, as defined.

1. Initial Set-up: Both players are represented by X and Y. At start, the game board is as shown in FIGS. 79 and 80.

2. Values in the Game: Initially each player "manages" six pieces—2@$+2@¢+V and K. Value assignment is optional on 2:1 ratio; e.g., $2:$1, $10:$20.

3. Moves: There are 4 legal moves ("drops") in the game:

1st FORWARD (Compulsory): FWD;
REVERSE: REV;
DIAGONAL: DIAG;
2nd FORWARD: FWD.

4. Programming Moves: The procedure for programming moves is similar to that used in playing the computerized MXI/10 game. All moves must be programmed to include the start/stop Mach (MXY-I/MXY-II) factor. For example: X:MXY-1, $X_2$, FRD, REV, DIAG, FRD, MXY-II, RUN.

5. Vectorial Limitation: Players are allowed two forward moves (1st and 2nd), one Rev, and one Diag. The first move, however, MUST BE FORWARD COUNTERCLOCKWISE. Thereafter a player may "switch" from any cell (Bank) in REVERSE or DIAGONAL direction. The objective at all times is to make a pair, as defined, on opponent's side.

6. Mach (Speed) Plus: Players attempt to "move" as quickly as possible to maximize speed-of-performance bonus, as prescribed, at the 25% or 50% (Mach-1 or Mach-2) level.

7. Killer Power: K represents a "wild" negative force. It prevents capture by any piece in the "set" occupied. Killer may be captured even though it can't capture. Thus, Vector or any value piece can capture Killer by forming a "special" pair.

8. Vector Power: Vector (V)is a "wild" positive force which can make a pair with any value piece or Killer. It may also be captured and "paired" by any value piece. Both K and V have no value when captured.

9. Fines: Fines are imposed, as defined, for correcting move-programs; mis-settlement (under or overpayment), speed fault (if moves are "mached" at 10/20 seconds each); etc.

10. Moving/Capturing: A player determines his/her move and then programs the computer to implement the required commands. If X moves a set in $X_1$ containing 4 pieces (V¢¢$|. . . ) it is understood that the piece nearest the vertical line ($) is at the bottom and will be dealt first by the computer. Thus a straight forward deal of the above-cited V¢¢$ set would entail a first "drop" (from the bottom) of the "$" "counterclockwise," and so on. After a first drop, FORWARD COUNTERCLOCKWISE, a player may maintain that direction or switch the next drop to REVERSE or DIAGONAL. No. player may repeat a REVERSE or DIAGONAL move. (See Sample Move-Program). The objective of each move is to form a pair on the opponent's side, as defined, with the last piece dealt and collect pay-off value. If two separate pairs are formed, both are taken-called multiple capture.

11. Legal Pairs: Under the rules governing legal pairs are as follows:
   a. 2 Golds @ 1:1 or 2:1 (Gold pair)
   b. 2 Silvers @ 1:1 or 2:1 (Silver pair)
   c. Vector+Gold (Vector gold)
   d. Vector+Silver (Vector silver)
   e. Vector+Killer (Power pair—no value)
   f. Gold+Vector (Gold Power)
   g. Silver+Vector (Silver Power)
   h. Gold+Killer (Gold Power)
   i. Silver+Killer (Silver Power)

12. Settlement: A player collects the pay-off value for any pair made on opponent's side, as defined. Although the computer records all capture values most players prefer to demand settlement in cash (play money) as captures are made.

13. Endgame The game ends when there are no pieces left in play. Three phases of play are defined:
   a. The opening game—before the first capture is made.
   b. The middle game—from first capture to that which reduces the number of pieces left in play to ≧4
   c. The end game—≧2 pieces in play 14. Endgame Settlement: If the game ends with ≧2 pieces left in play, they represent "collectibles" for the player *on whose side they remain.* This is so even if each player has one piece. Settlement is at pay-off value of 1:1 or 2:1.

15. Mach Bonus: A player completing the game within the 100 seconds Mach-1 time frame earns a "speed-of-performance" bonus of 50% of his/her total cash position. Mach-1 (more than 100 seconds) earns a reduced bonus of 25%.

16. Scoring: The player with most funds at the end of the game is the winner. Score card is not required unless moves are annotated.

This MXI/2 (Vector) represents the modular computerized game of the invention. The back game of the MCIII/3 matrix (MRII/2 relay) was programmed via slight modifications of the basic program. Anyone skilled in the art of computer game technology will readily see that the approach perfected may be modified to computerize all vectorial and Mancala-type games. Four examples will suffice to illustrate this capability. See FIGS. 78*a–78d.*

VECTORIAL VARIATIONS: OTHER GAMES

The success achieved by the perfection of the vectorial concept implicit in VECTOR, the basic cellular game, led to the adaptation of the essential techniques to create or improve new computer-based games. The following examples merely serve to exemplify this capability and in no way defines or limits the scope of the invention:

1. PI-MACH is a Vectorial Variation which can be played by one or two players with seven to eleven blocks of slightly different sizes. Thus, when stacked sequentially, a pyramidal structure is formed. The initial set-up may be a traditional pyramid or any of 5,000–40,000,000 re-arrangements (ur-pyramids) programmed and stored in the computer.

The object of the game is to break down the assigned pyramidal structure and rebuild a proper pyramid without placing a larger piece atop a smaller. The number of cells is limited to three. Speed of play is a critical element and the central motive is to establish a race to beat the Mach-I time frame, as determined. Speed accounts for up to 50% of the total values in the game.

To initiate play, a play removes the topmost piece from the stack and places it in any of the two empty cells. The second piece is then removed and placed in the third cell. Then the third piece or one of the two pieces already moved is transferred. And so on, bearing in mind the two constraints relating to size of pieces and number of cells to which transfers may be made. Phase I consists of breaking down the form constructed; Phase II is building or rebuilding a proper pyramid.

Score for the player who succeeds in accomplishing this task is the sum of the values of the pieces. Value is assigned relative to size. This score is doubled if the pyramid is re-formed in the central cell, which pays off 2:1. The losing player's score is the value of those which are not. Both scores are increased by Mach bonus points: Mach-I=50% and Mach-II=25%.

Adaptation of computer technology to the playing of Pi-Mach (a vectorial board game in its preferred emobidment) is brought about by establishing a series of arrays, each of which represents a cell. The seven (or more) pieces of the pyramid are initially set up in the central cell. This is best secured by using a PL/1 stack system wherein elements may be "pushed" onto or "popped" from the stack. Thus, with P1=7:

| STACK "LEFT" | STACK "CENTER" | STACK "RIGHT" |
|---|---|---|
| L(1) = NULL | C(1) = P1 | R(1) = NULL |
| L(2) = NULL | C(2) = P2 | R(2) = NULL |
| L(3) = NULL | C(3) = P3 | R(3) = NULL |
| L(4) = NULL | C(4) = P4 | R(4) = NULL |
| L(5) = NULL | C(5) = P5 | R(5) = NULL |
| L(6) = NULL | C(6) = P6 | R(6) = NULL |
| L(7) = NULL | C(7) = P7 | R(7) = NULL |

Each block is represented by a number associated with its value. If a piece is selected to be moved from Stack C to Stack L ("center cell" to "left cell"), a test is made comparing the top elements of each stack. Should the top element of Stack C be less than the top element in Stack L, the move may be made and the element is popped off C and pushed onto L. If the converse is true, the move may not be made since a larger piece would come on rest on a smaller piece.

Example:

| LEFT "L" | CENTER "C" | RIGHT "R" |
|---|---|---|
| | P2 | |
| | P3 | |
| | P4 | P1 |
| P7 | P6 | P5 |

P2 at C to R is not allowed; P2 at C to L is allowed; P1 at R to C or L is allowed; P7 at L to C or R is not allowed.

It will be observed that at any one time, there will only be three legally permissible moves for each player. The question is: which is the correct (logical) move? In that speed is a critical factor in determining score, it behooves the player to think, structure, and program his/her decision as quickly as possible.

Various methods may be used to keep track of the time expended by each player. Score for a "full" Pi is the sum of the values times the payoff factor of 2:1 if formed at center. The loser's score is the sum of the values in his/her largest pyramidal stack (≧3) pieces times the value of the payoff factor, if applicable. The winner is the first to accumulate a pre-determined number of points.

2. TAN'MACH mirrors the advanced state of the artistic technology in computer graphics and stereoscopics. It also bridges the gap between jig-saw puzzles and vectorial board games. Aesthetics, however (shape, sound, music) is more pertinently involved, seeing that a vast array of figures may be sculpted.

The game is played by manipulating and qualitatively positioning 7–15 pieces (called Tans) of various sizes and shapes to form recognizable figures which are assigned randomly by the computer: squares, triangles, art objects, people, machines, sculptured forms, letters of the alphabet, and the like. The object of the game is to arrange the tans to form the shape shown on the screen, and to do so as quickly as possible.

To initiate play, a player commands the computer to "show" a figure. This is called the "assignment". The figure first appears at center screen and then, in significantly reduced scale, on a "split" screen, as soon as the player makes the first placement.

Pieces are numbered from 1 to 15 and provide for three levels of difficulty: Tan-I figures consist of 1–7 tans; Tan-II figures, 1–10 tans; and Tan-III figures, 1–15 tans. The assignments, as noted, are permanently shown on split together with time lapsation. The playing matrix for the game is divided into five sections called North (N), South (S), East(E), West(W), and Central(C) grids. See FIG. **78*b***.

Before making his/her first placement, the player carefully studies the assignment at center screen. As soon as the first placement is programmed, the figure transfers to the split screen section. When the player is "lost" or uncertain about the placement of a piece in a certain section, it is possible to have the computer provide an "assist" (See Programming Grid, FIG. 78) as to the correct positioning Two "assists" are allowed, but each request reduces the score by a predetermined number of points. Such "help" takes the form of a correct answer to a query, e.g., "Tan-7, Grid?" would engender a response such as "Tan-7 to Grid N" or "Top", "Center" or "bottom" of the assignment.

The positioning of a tan by the computer (in an empty grid) is always in the position that said piece occupies in the correct solution. This is so whether or not the tan is placed in the correct grid. The positioning of a tan immediately beside another is a random fit selected by the computer. If said fit is incorrect, the player must program a "shift" ("re-position") command, e.g., "Tan-7 at Tan-3, shift".

Each assignment has a pre-established Mach-I time frame, level of difficulty rating, and weighted score value. Thus, the score for completing any assignment is 6, 8, or 10 points+Mach-I or Mach-II bonus or 25–50%, as determined. Game is usually 100 points.

An automatic "Tan Show"—featuring 101 forms in the "Tan Sculpture Garden"—in technicolor and set to music, may be commanded from the computer's memory. This is a highly aesthetic feature—offering hundreds of thematic figures.

3. MACH'MORRIS: Background: Mach'Morris is an improved "vectorialized Machthink" version of an ancient game known as Mill or Morris. As improved, the game matrix consists of three concentric squares or circles and 24 points. (Mach'Morris can be played on the Spect'run matrix.) Each player has 9–11 pieces and the object of the game is to "make" three-in-a-row formations as quickly as possible.

I. Video/Computerization Adaptation: These types of commercially feasible embodiments may be achieved by programming the behavioral intelligence, as follows:

(a) Display of game matrix with numbered points on a TV screen. See FIG. 78.

(b) Phase I Functions: Popping in "pieces" on selected points with a view toward forming 3-in-a-row horizontally, vertically, or diagonally.

(c) Registering one point for each such formation.

(d) Registering and displaying time used for each move.

(e) Phase II Functions: Moving along lines and/or jumping over pieces, as defined. Multiple jumps (checker-like) are permitted.

(f) Registering points (reward function) for each three-in-a-row formed in Phase II.

(g) Mach Bonus—Scoring Mach-I bonus, as defined, for winner only, if within Mach-I time frame, as pre-determined. Usually, one additional point.

(h) Endgame: Game may is won by being the first to make a three-in-a-row formation; forming two or three such before opponent; blocking opponent; and, reducing opponent to two pieces only.

(i) Game Variations: As improved, Mach'Morris may be played on any of the following matrices:

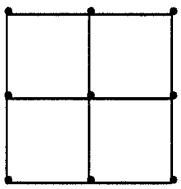
FIG. 1

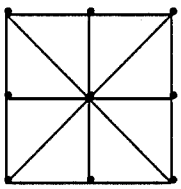
FIG. 2

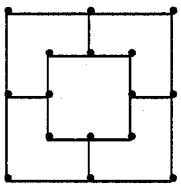
FIG. 3

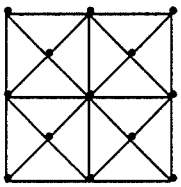
FIG. 4

-continued

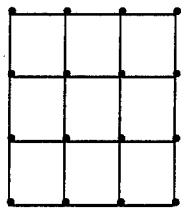
FIG. 5

Figure 6:
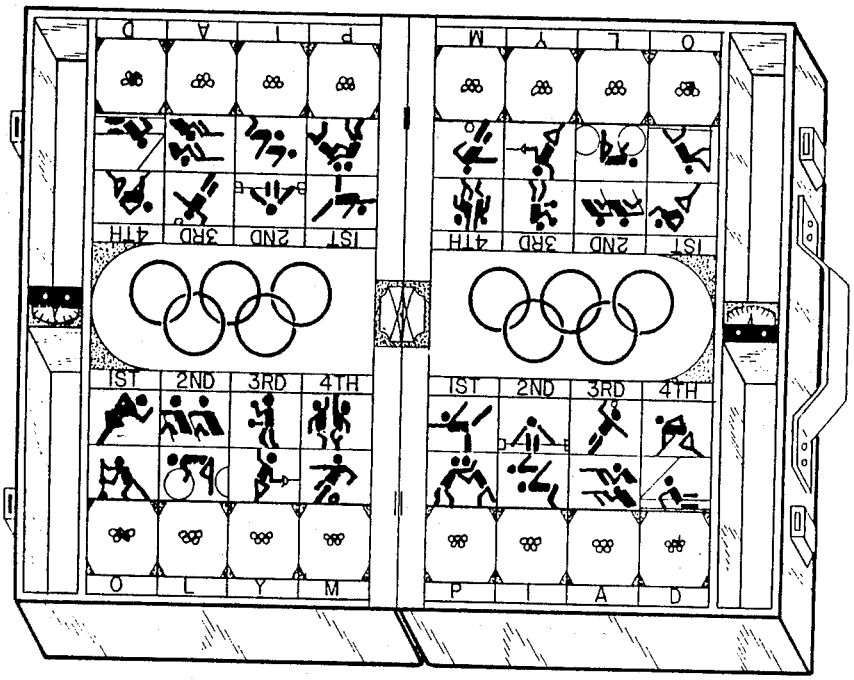
FIG. 6 is an illustration of another subject matter (Sports: "CALA-OLYMPICS) simulated by the game process.

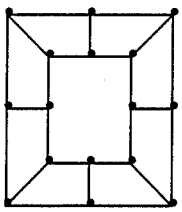
FIG. 6

Figure 7:
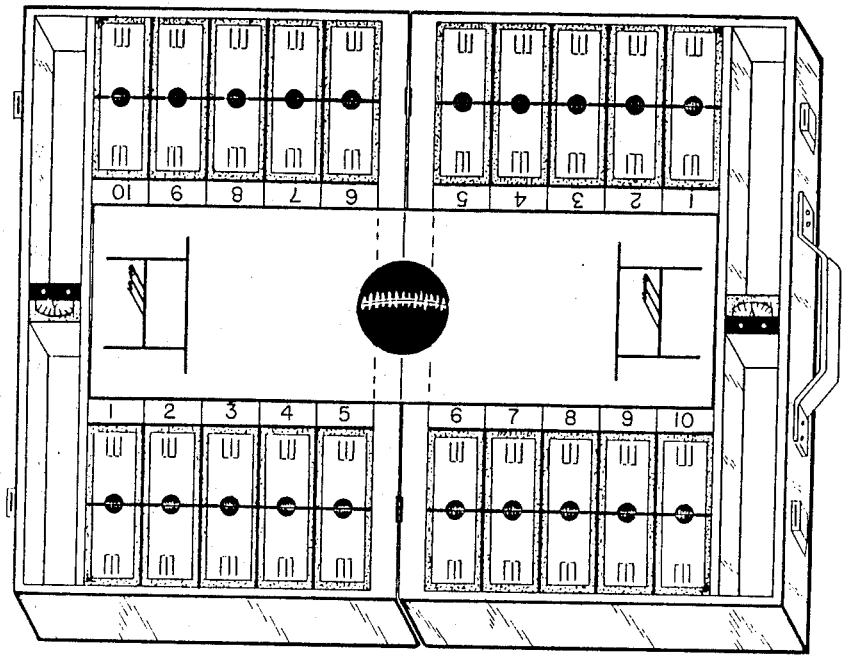
FIG. 7 is an illustration of a popular British Commonwealth field game, CRICKET, simulated by the game process.

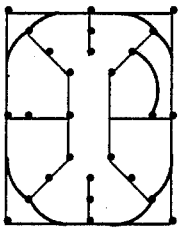
FIG. 7

Figure 8:
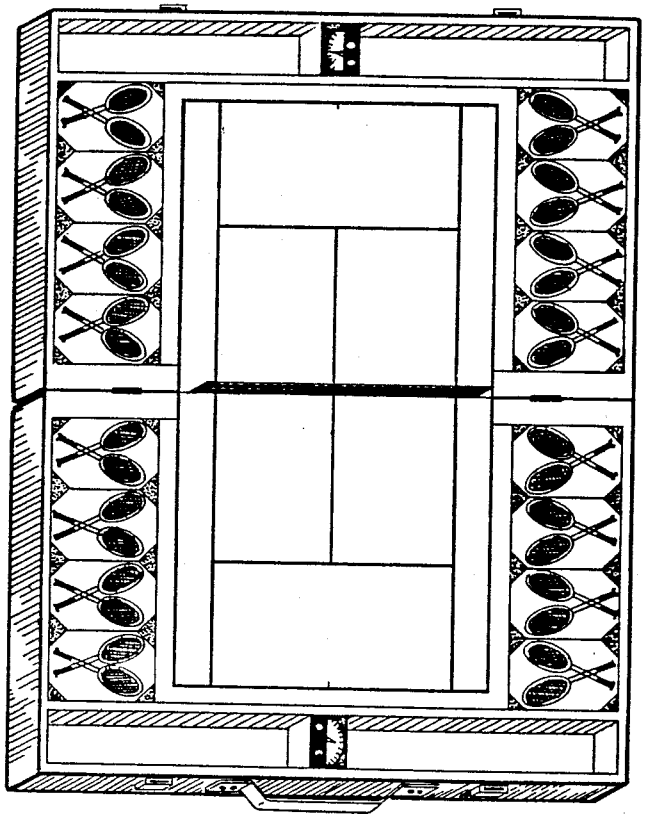
FIG. 8 is an illustration of another product of the game process—'CALA-TENNIS.

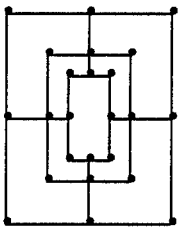
FIG. 8

Games in these matrices offer two–four player capability and are rated by authorities as being among the world's ten best.

II. Rules of Play:

(a) Play is divided into two phases. Phase I: Each player brings in one piece on any vacant point. Phase II: Moving and Jumping—pieces may be moved along lines in any direction and make checker-type jumps.

(b) The objective is twofold: (1) to block opponent and/or (2) to form three-in-a-row.

(c) The same piece may not be moved twice to form a three-in-a-row.

(d) Any three-in-a-row formation may be "broken" and re-formed to score again and again—provided rule "c" is observed.

(e) A player can make two three-in-a-row formations by moving only one piece. (Scores two points and two of opponent's pieces may be removed.)

(f) A player scores one point for each three-in-a-row formation and has the option to remove any one of opponent's pieces which is not in a 3-formation.

(g) A player earns an extra point for Mach-I win, as defined, re time frame and value.

III. Programming Moves:

(a) The programming grid of FIG. 78 suffices for all commands. Pieces are designated "O" and "X" and take on the additional definition of the point occupied, i.e., O's piece at $X_1$ is called $OX_1$. The 24 points of the Mach Morris matrix are numbered $O_1$–$O_9$, $X_1$–$X_9$ and $C_1$–$C_6$ (on O's side, X's side and at Center, respectively).

(b) Both moves and jumps are programmed in respect to start and finish points only. Thus, O1–O3 indicates a jump over piece at O2.

(c) Captures and score are made and recorded automatically.

(d) Reward piece must be programmed as part of the move to avoid forfeiture. See sample moves.

(e) Players are required to Start/Stop Mach timers before implementing move program. If Mach is not started with the first command, the move is *not* implemented. On the other hand, if Mach is not stopped before the "Run" is implemented, it keeps going. Time is a critical dimension of play and accounts for 25–50% of the total values.

IV. Sample of "Written" Move-Programs:

Phase I:

O: M/Strt, $O_3$, M/Stp, Run

X: M/Strt, $X_1$, M/Stp, Run

Phase II:

O: M/Strt, $O_1$–$O_2$: $XO_6$, $XO_6$, M/Stp, Run

X: M/Strt, $XO_5$–$O_2$, M/Stp, Run

O: M/Strt, $C_1$–$C_2$, M/Stp, Run

X: M/Strt, $OX_2$–$O_3$, M/Stp, Run

It will be obvious to those with expertise in the art of computer graphics that Mach'Morris, as improved, would prove to be ideally suited for video/computerization.

4. SPECTRUN (aka VECTORUN) is an adaption which most appropriately exemplifies the vectorial techniques that underpin all the games of the invention—more so, in fact, than Vector, Tan or Pi. This variation encompasses all the ramifications, challenges, frustrations, and rewards involved in the quantitative and qualitative transfer of light waves from one position to another with a view toward forming certain vectorial patterns, which opponent cannot duplicate. Object of the game is to assign opponent a "run" consisting of movements of the light to 4, 6, 8, 10, 12 or more contact points and to challenge a correct response within a given time time frame.

The game matrix consists of 8 paths, 3 ringed ranges, 24 contact points and a centorium. Paths are designated North, Northeast, Northwest, South, Southeast, Southwest, East, and West. Playing pieces are, in fact, colored light waves that are programmed to move along any of the 8 paths to selected contact points. Although the primary focus is visual (color and direction), aural elements augment the aesthetic dimensions of the game.

To initiate play, one player programs a "run" which is flashed and "held" on the screen for 10 seconds. An attempt is then made by opponent to repeat the "run" exactly. The player may make one or more attempts to do so, seeing that score is a function of the number of "tries"]and amount of time used to duplicate a given number of "runs".

These four variants exemplify the flexibility of vectorial and MachThink Mancala-like concepts in creating new games, converting puzzles to games and in improving ancient games in the public domain.

DETAILED DESCRIPTION OF THE PRESENT INVENTION

Part V: The Game Process

The process used to develop the simulated scenario capability involves several technical procedures which I will attempt to describe for practioners in the field of game design. The procedures involved are encompassed in the following flowchart:

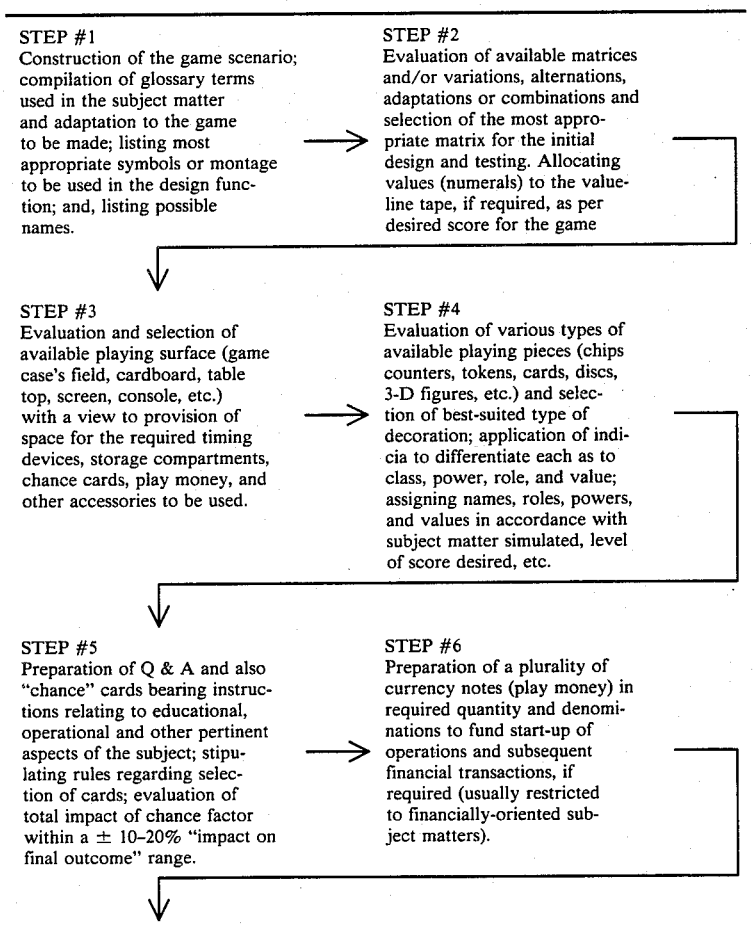

-continued

| | |
|---|---|
| STEP #7<br>Provision of a doubling device to initiate and increase bets from 2 to 256 times the stakes first wagered, setting minimum/maximum limits of such bets, types of "legal" bets, etc. | STEP #8<br>Setting up and testing the "first run" of the game made; conducting further test-runs and adjustments to achieve desired objectives. |
| STEP #9<br>Mach-1 testings at various levels of proficiency--after finalization of test runs for realism and overall quality of play. Setting Mach (speed of performance) time frames for different levels of proficiency. | STEP #10<br>Establishment of the rules of play governing proper notation, moves, captures, use of captures, levels of fines, bonuses, etc. Printing set of said rules, regulations, and instructions; mass production, promotion and distribution of the product created. |

As illustrated in the flowchart, the sequence of operations and procedures employed in the development of a Mancala-like simulation game by the process of the present invention first involves in-depth study of the parameters, rules, and regulations of the subject matter to be treated. Next, the playing fields and structural formats discussed hereintofore must all be evaluated as to the specific procedural requirements and artistic objectives. The artistic design function will involve experimental mock-ups using readily identified symbolic items (playing field, court, balls bats, athletes, charts, etc.) of the subject matter on the center court and/or receptacle areas of the matrix. This procedure is the first part of a series of operations which must be undertaken to establish claims to the simulation. It is called "Establishing the environment or Stage" (see FIGS. 1, 6, 7, etc.). After the setting or stage for the playing field is established, the next step involves the coloring and decoration of the playing pieces (poker chips, counters, tokens, coins, cards, discs, 3-D figures, etc.) with indicia to differentiate each as to class, power, role, and value. See FIGS. 16–29. The classification of pieces is dictated by the requirement of the subject matter. The general classification of pieces are of two kinds, as stated: (1) value pieces (points, monetary designations, etc.) and (2) special pieces which effect or negate captures. These special pieces are of three types: those which effect regular capture (Machs); those which earn a special bonus on effecting captures (Big Machs); and, lastly, those which negate capture (Rex or Killer). The range of values assigned to playing pieces relates to the desired total score at the end of play. Usually a ratio of 1:2:3:4 or 1:2:3 suffices to establish a hierarchy of values which is functional, if other than a 1:1 ratio is required to achieve the desired level of the final score.

The successful design of the playing field (as regards functional as well as esthetic aspects) and the playing pieces represent the two most important operations of the game simulation process. Thereafter, the production of a plurality of playing cards (bearing instructions which impact favorably and unfavorably on the final outcome or score) is undertaken. These instructions introduce an element of "chance" or "luck" into what are, essentially, games of wit and cunning, i.e. intellectual challenges of the mind with possibilities (permutations and combinations) that test quickness of perception and decision-making attributes under severe time pressures. The "chance" factor introduced by the inclusion of cards (which are drawn following each capturing move) is controlled so as not to impact beyond a ±10–20% level of the grand total score for any game.

Carded instructions usually relate to one of these scenarios—time wasting or value reduction or value increase. For example, in the "Stock Exchange" simulation game, a card might instruct a player who has just completed a capturing deal to "call and chair an important board meeting, limited to 30 seconds." Another card might direct the player "to pay off outstanding bank loan of $x." Still another card might direct the player to "collect loan of $x made to opponent two years ago @ 10% per annum, total=$x." And so on. For these and other reasons, another critical step in the Machcala simulation game-making process requires the provision of an adequate quantity of currency notes (play dough) in denominations of $1, $5, $10, $20, $50, $100, $500, $1,000, $5,000, $10,000, $25,000, $50,000, $100,000, $250,000, and $500,000. However, in games where the level of financial transactions is in five or six figures, the lowest denomination is usually $1,000.

The games of the invention usually involve side bets—with play money. In order to initiate and increase wagers, a doubling device is necessary. The "wheel-of-fortune" illustrated is highly recommended in that it is capable of increasing bets from 2 to 256 times the initial amount. When the doubler is not in play it is placed flat on its face. When it is in play it is placed on its side with the number uppermost representing the level of doubling attained. Betting is not compulsory in most games and no penalties are imposed if a player declines an offer to "double up."

These procedures complete the initial set of operations which must be performed before a simulation or scenario game may be created. The next steps of the process relate to "test-runs" leading to the establishment of "time-frames" for Mach-1 speed of performance, and compilation of rules of play. Notation of each move and outcome of test games must be made (via usage of a description notation system) with a view to evaluating and reevaluating various set-ups, moves, and outcomes. See Notation System.

The objects of the test runs are to establish the following: best method for the initial set-up; level of fines; level of Big Mach bonus; Mach-1 time frame and levels of "speed-of-play" bonus; mode of dealing and capturing; usage of captures (for value accumulation as money or points, to form attainments, suits, suites, sequences, etc., method of settling transactions, evaluating scores (including attainment and speed bonuses) and the like.

Where Mach-1 time recording is concerned the game case of the process with its separate built-in timing devices, is most appropriate. This feature, along with the four-way storage capability, makes it one of the best (though not the only) method of embodying Mancala and Mancala-like games. Similar games, as well as other non-Mancala-like games; e.g., Chess and Checkers, may also be embodied in this game case via the use of the so-called game-overlays. In sum, an analysis of the simulation/scenario process will reveal the following critical variables:

1. The structural embodiment—game case, cardboard, table top and the like
2. The Matrix
(i) Size
(ii) Center field: design graphics
(iii) Cells: design graphics
3. Playing Pieces
(i) Value Pieces: design, coloration and valuation assignment of (amount and range)
(ii) Special Pieces: Mac's empowered to capture
(iii) Special Power Pieces:
Positive Force and role
Negative Force and role
4. Focus of the Scenario
(i) Advertisement
(ii) Entertainment
(iii) Enter-Trainment/Educational
(iv) Other
5. Q & A/Chance Cards—selection of questions and answers
6. Mach Factor—establishment of Mach-1 time frames and bonus level
7. Method of Play—rules of the game to ensure realistic reference points vis-a-vis co-relationships between the game and subject matter treated.

It will be seen then, that the games of the invention may be rendered as generic "divertisements" on as so-called simulated/scenarios (sim/scens). The latter may be classified under four main headings:

1. Entertainments—This term relates to all forms of sim/scen games which focus primarily on the entertainment function. Other functions and objectives may be achieved but the raison d'etre is to entertain. This category includes all sim/scen games depicting sports, other board or card games, hobbies, happenings, the arts, novels and the like. (See Examples A–Z)

2. Advertisements—In this grouping the primary focus of the game is to promote its corporate or institutional sponsor(s). A game developed for a restaurant chain like McDonald's would fall into this category. Obviously, "advertisements" include all the qualities of "Entertainments" (See Examples A–Z)

3. Enter-Trainments—'Cala sim/scen games in this category focus on the training function while entertaining players. A game developed for say a bank on life insurance company would fall in this category. The educational or training function is primarily achieved by including of Q & A cards with penalties or bonuses earned for incorrectly/correctly answering questions *on making captures.* Information of these Q & A cards relate to pertinent aspects of the subject matter. Several sets are usually provided. Classroom Group: Q & A games and simulations (junior high, military schools, etc.) all fall under this category.

4. Other—This group includes TV game shows, cheerleader's formations, military drills and the like. In these instances the structural elements and behavioral dimensions are adapted to meet the constraints and objects of the medium. 'Cala-worksheets providing for practice exercises also fall under this group.

These various forms of sim/scen games—as well as the generic or vectorial versions—may be embodied in the aforementioned game case of the invention, wood, plastic, cardboards, table tops, and the like; or may be computerized and reduced to electro-mechanical formats. In order to master the diverse applications of the process the language of Machcala must be mastered. (See definitions of technical terms as stated hereintofore)

GLOSSARY

Structural Elements

1. Matrices: Vectorials, Regular or Generic, Simulated/Scenarios, as illustrated and defined.
2. Elements of the Matrix: The cells, switch cells, centerfield or transactions area, pay-off or value-line, as illustrated and defined.
3. Game Case: Stage or field of play, bar point or ridge, left and right homeboard, storage units, timers, as illustrated and defined.
4. Playing Pieces: Value or point pieces, special pieces (Mac's) special "power" pieces ('Cala/Big Mac, Rex/Killer) as defined.
5. Doubler and Wagering: as defined.
6. Question and Answer Cards and Role: as defined.
7. Chance Cards and Role: as defined.
8. Play Money (bank roll/credit line): as defined.
9. Game-Overlays: as defined.
10. 'Cala Worksheets: as defined.

The structural and behavioral flexibilities of the process led to perfection of its capability to "simulate" innumerable "scenarios." In due course we concluded that the scope of the process was limitless. Any subject involving dramatic confrontation (conflict or antagonist/protagonist roles) could be successfully treated. For example:

0 Dramas and novels
0 Religion and mythology
0 Motion pictures
0 Historical events
0 Astrological subjects
0 Folklores and legends
0 The environment
0 The professionals and Big Business
0 Economic and financial subjects
0 Hobbies and crafts
0 Space and sea exploration
0 Government and Institutions
0 The arts, sciences and technologies
0 Educational subjects: Enter-Trainment Games
0 Promotions and advertisements
0 Board and Card game adaptations
0 National and ethnic games
0 War games
0 So-called "big" events and happenings (as games)
0 Major sports and track/field/court games: Entertainments The following examples are provided to show how the principles and procedures of the process were used in respect to the above-cited claim. They serve to exemplify the limitless scope of the invention without in any way limiting its possibilities.

EXAMPLE "A"

Figure 6A:
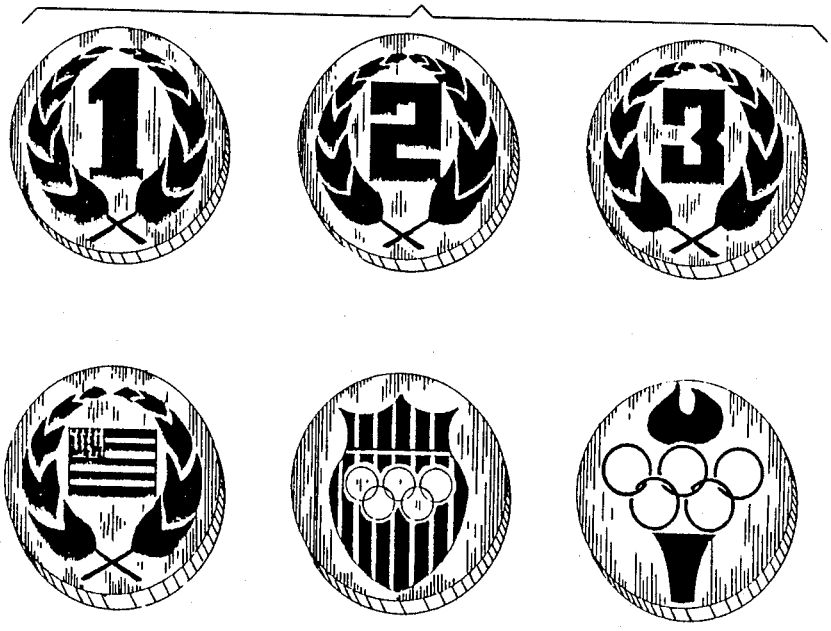
FIG. 6*a* is a set of the pieces used to play the game of FIG. 6.

FIG. 6 is an illustration of an MCIII/8 cell simulation game representing a major international event: The OLYMPIC GAMES. The scenario depicted relates to competition for medals during the course of the Olympics. There are graphics of selected major events in each cell of the receptacle areas, together with the five rings representing the official Olympic symbol. The first two horizontal rows on either side of the center court area represent the front or "Winter" Olympics; the third row represents the back or "Summer" Olympics. The initial set-up calls for four value pieces (Gold, Silver, Bronze, and White) worth 3, 2, 1, and 0 points respectively), in the designated set-up cells of the front and back games. Each player then places one athlete (Mach) in each loaded cell. Rex in this game is called "The Judge" and Big Mach the "Spirit of Olympia". Special pieces are then entered in both games and placed in any loaded cell of the player's choice. When the set-up is completed there will be 16 loaded cells with a total of 84 point and special pieces on each side. See FIG. 6*a*.

In that only the athletes and the Spirit of Olympia can effect capture, the front game is played in the usual Machala MRII mode with one player lifting all the pieces in any cell of the first two rows and dealing one in successive cells moving clockwise. Capture is made whenever the last piece dealt is an athlete or Spirit-of-Olympia which lands in a *loaded front row cell* with opponent's front cell directly opposite loaded with 2, 3 or 4 pieces. All value pieces captured are taken off and stored. Bonus captures are earned as described hereintofore for the Stock Xchange game. The first capture, however, must be an enprise pair of 2, 3 or 4 pieces. All cells are "in competition".

The back game is played in the usual MXI manner with captures of one, two, or three medals by athletes and the Spirit-of-Olympia. If the last chip dealt on the opponent's home court is a "special" and if said chip is deposited in a cell with one, two, or three pieces in it (medals or specials), then capture is made by removing all the chips from the captured cell. If the cell next to the captured cell is loaded with a total of two, three, or four chips and if there are other cells contiguous to and continuous with that cell also loaded with two, three, or four chips, all these conjoined cells are captured in addition to the cell from which capture was first made. Captured special pieces may be "re-deployed" and/or re-entered as described hereintofore. Mach-1 and Mach-0 bonus at fifty/twenty-five percent level is added to the total point score of medals won at the end of the game. The game ends when all value pieces have been captured even if specials are still in play. Mach-1 time frame is fifteen minutes, based on the level of proficiency achieved by above-average players. Although this game has been rendered on the three-row matrix (MC-III), similar to the basic game of the invention, it may also be depicted on one, two, or four row (MXI, MRII or MRIV) matrices and in various structural formats.

EXAMPLE "B"

Figure 7A:
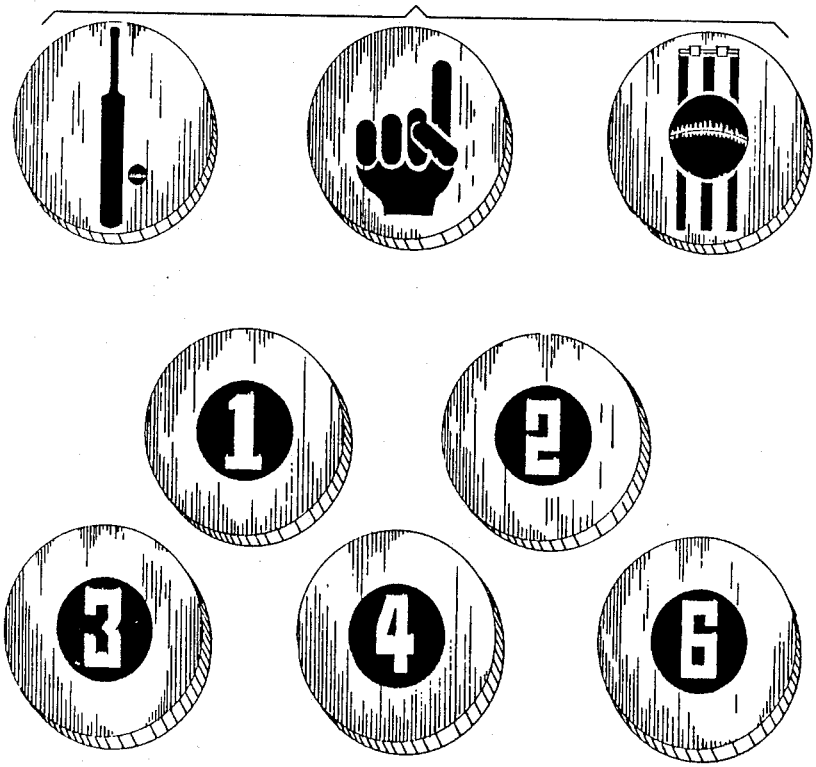
FIG. 7*a* is a set of the pieces used to play the game of FIG. 7.

FIG. 7 is a MRII-10 cell game simulating the well-known British Commonwealth game of Cricket; FIG. 7A is a set of pieces used to play this game. Numbers on the chips represent runs scorable (1, 2, 3, 4, and 6) in this game. The scenario depicted involves two teams competing at "test" or "speed" cricket to ascertain which will be the higher scorer when the match (one or two innings) ends. The "batting" team sets up with five value (runs) pieces and one Mach (Batsman) in each of the ten back row cells. The Rex, called "The Umpire" and Big Mach, called "The Centurion," are then entered in any loaded cell. The "fielding" team places five "runs" chips and one Mach ("Bowler") in each of the ten back row cells. The Rex (Umpire) and Big Mach (Mr. Hat-Trick) are then entered in any two loaded cells. When each "team" completes the initial set-up there will be a total of 124 pieces in the game—eight back cells with six pieces and two with seven pieces on each player's "side".

Rules for moving and capturing are similar to above-described Machcala "Relay" two-row (front) games. However, the limitation rule is waived and all captures made are scored before their respective wicket (numbered 1–10). The object of the game for the team at bat is to score as many runs per wicket as possible before the team fielding captures ten wickets, which is to say, ten special batsmen pieces, and "outs" the opponent. If the team fielding fails to capture ten wickets before all the runs (value chips) have been "scored" (captured), then the game is set up again and continued until the fielding team has captured ten wickets. The fielding team then "goes to bat" and the winning side is that which scores most runs. Redeployment and re-entry rules apply. Runs (value chips) captured are disregarded by the "fielding side". Mach-1 is ten minutes when played at above-average speed.

Although the game is rendered on the two-row matrix, it may also be depicted on MX1/8, MRIV/8 matrices and in all the feasible structural embodiments discussed hereintofore.

EXAMPLE "C"

FIG. 8 is an illustration of a Machcala Xchange (MXI-8) game depicting Lawn Tennis. The Scenario involves two players competing in a one set club match (six suits). Colored poker chips are used as playing pieces (not shown) and bear indicia representing a tennis ball with the respective point won in the center of the chip. Thus, the red chip represents "15", the value of the first point scored in tennis; the blue chip represents "30", the second point scored; the silver chip represents "40", the third point scored; and the gold chip represents "game", the fourth and last point scored.

The initial set-up calls for four point chips to be placed in each cell together with one Mach ("player"). Big Mach is called "Ace", Rex is the Umpire. Only "players" may score points, i.e., capture. The object of the game is to capture pieces and use them to form four-pieces suits of "15/30/40/game". Each suit counts as one game toward the total of six for the set. Method of capturing in this game is similar to that for MXI games, i.e., players can "score" (capture) 1, 2, or 3 pieces. More than one round may be required to complete the set. This is so because captured pieces which were not able to complete "incomplete games" and/or form full suits (games) are "discarded". Each player is allowed to retain four pieces as "hand" and also to "hit" opponent's incomplete suits and "raid" said opponent's "hand". Mach-1 time frame is 10 minutes and earns no bonus. Mach-0 earns a penalty of minus one game.

EXAMPLE "D"

Figure 9:
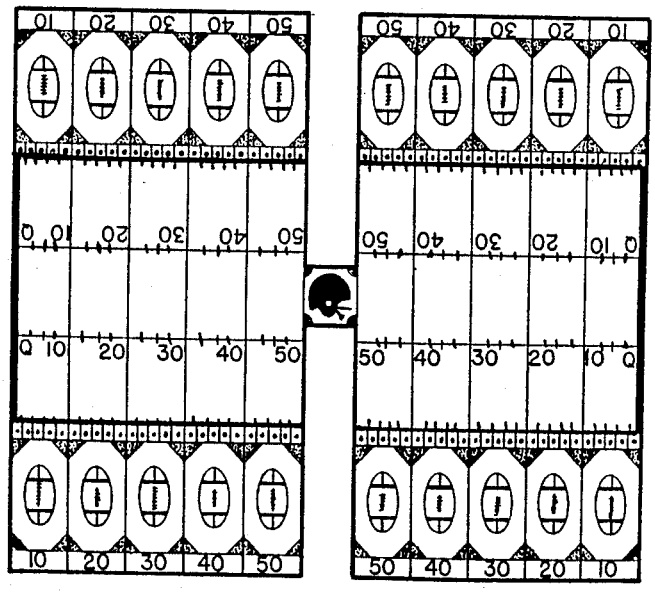
FIG. 9 is an illustration of a game overlay-matrix designed to simulate the playing field for 'CALA-FOOTBALL.

FIG. 9 depicts a MXI-10 Machcala Football game on a typical two-piece Machcala game overlay. The scenario involves "rushing stars" of a National Football League team attempting to break "the record" of 300 yards in a game. Each of the 100 "point" pieces represents the number of yards gained or lost on a rush, as follows: Each gold chip represents a "first down" or 10 yards; the silver chip represents a "good gain" of 5 yards; the blue chip represents a "short gain" of 3 yards; the white chip represents a "gain" of 2 yards; and the red chip represents "no gain or loss". The total number of yardage in a game is 400, which, when increased by the Mach-1 bonus of 50% extends the possible "grand total yardage" (score) to 600 yards. A player would therefore have to win at least one half of the total yardage in the game at M-1 speed in order to equal the record of 300 yards. There are 20 Machs in this game. Big Mach is called "Superstar" and Rex is the "referee". Mach-1 time frame for this game is 10 minutes and capture is made in MX-I mode, as prescribed. "Machcala Football" may be played by two, three, four, or more players. The game may also be rendered on the MRII/10 matrix and in various kinds of embodiments.

EXAMPLE "E"

Figure 10:
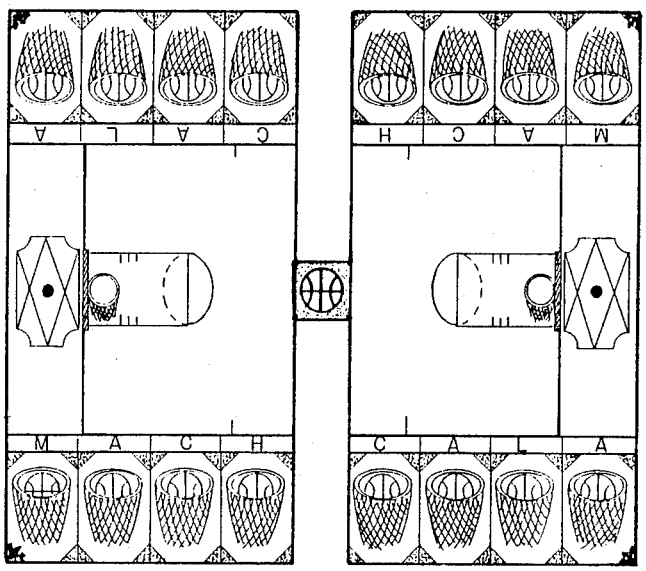
FIG. 10 is an illustration of a Machcala game simulation overlay-matrix for 'CALA-BASKETBALL.

FIG. 10 is a Machcala MXI-8 cell game simulating NBA basketball, and involves two professional basketball teams in an NBA play-off game for the championship title. The chips are three, two, and one point baskets. The initial set-up may be three two-pointers and one three-pointer per cell, or two "two-pointers", one "three-pointer", and one "one-pointer" chip in each cell. Players (Machs) and Big Mach (Player-Coach) capture. Rex is the referee. There is a total of 128–144 points, depending on set-up used. When this total is increased by M-1 bonus a grand total score of 192–216 points for both teams is possible. Design variations (used to simulate) College and "NBA" professional basketball teams) were made on both MXI-8 and MXI-10 matrices. The game is played in the MXI mode described.

EXAMPLE "F"

Figure 11:
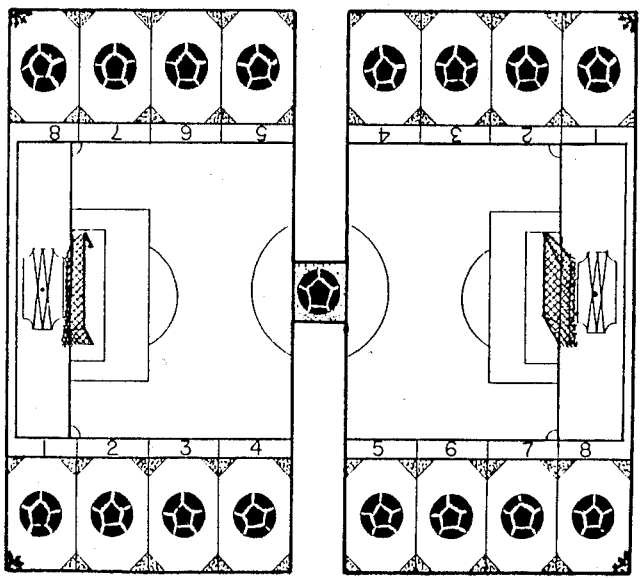
FiG. 11 is an illustration of the game simulation overlay-matrix for a game called 'CALA-SOCCER.

FIG. 11 depicts a Machcala Xchange MXI-8 cell game on a two-piece "Machcala Xchange" overlay. The game depicted is American Soccer. The scenario involves two teams ("Home" and "Away") engaged in a series of 8 matches during the course of the entire season. The eight games played by each team is indicated on the value-line area. There are three different kinds of point chips—"shots" which are worth zero point; "assists" worth zero point; and goals worth two points. The initial set up calls for one "shot", one "assist" and "two goals" in each cell (Match). There are ten Machs (players) per team plus Big Mach called "Captain Striker" and Rex called "Ref". All chips captured from numbered cells on the opposite side are accumulated before the same numbered cells on the player's side. Shots and assists pieces taken may be discarded seeing that they have no value. At the end of the game (with all point chips captured) a determination is made as to the winner or loser of each of the 8 matches in what is called the "face-off" or "show-down" phase of play. The team with most goals scored in a match wind that match and scores two points. Thus, if X had captured 4 goals in his 8th (h) match as against 3 in Y's first (a) match, X would win this "face-off" and score 2 points. If the number of goals scored is the same for both sides, the match is said to be drawn and scores one point each. A match in which no goal is scored by either side is disregarded. Capture in this game is from any of the eight cells (games) per MX-1 rules. Mach-1 and Mach-0 bonus at the usual 25% and 50% level is then added to the total number of points to determine "grand total" for the season's competition. Mach-1 time frame (determined by testing above-average-level players) was established at 10 minutes.

EXAMPLE "G"

Figure 12:
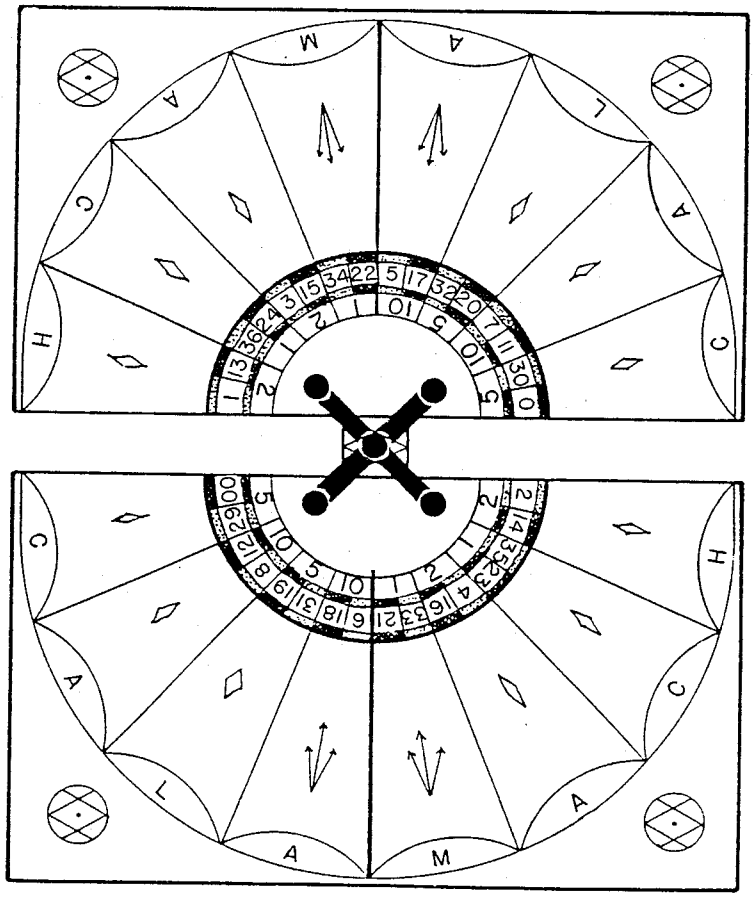
FIG. 12 is an illustration of a circular game overlay-matrix for a mancala-like simulation game called 'CALA-ROULETTE.

FIG. 12 is a rendition of a Machcala Xchange game variation on circular MXI/8 game overlay. The game simulated is Casino Roulette. Captures have varying pay-off values as indicated by the value-line compartments with "pay-off" of 1–10 times the amount captured. The pieces in this game are gold, silver, blue, and red poker chips with indicia fixing value of chips at $100, $75, $50, and $25 respectively. There are 16 Machs in this game. The Big Mach is called "Lucky Lady" and Rex is call "killer". The object of the game is to win as much money as possible with transactions settled with play dough after each capture. Mode of play as per MX-1 rules. Mach-1 speed is 10 minutes.

EXAMPLE "H"

Figure 13:
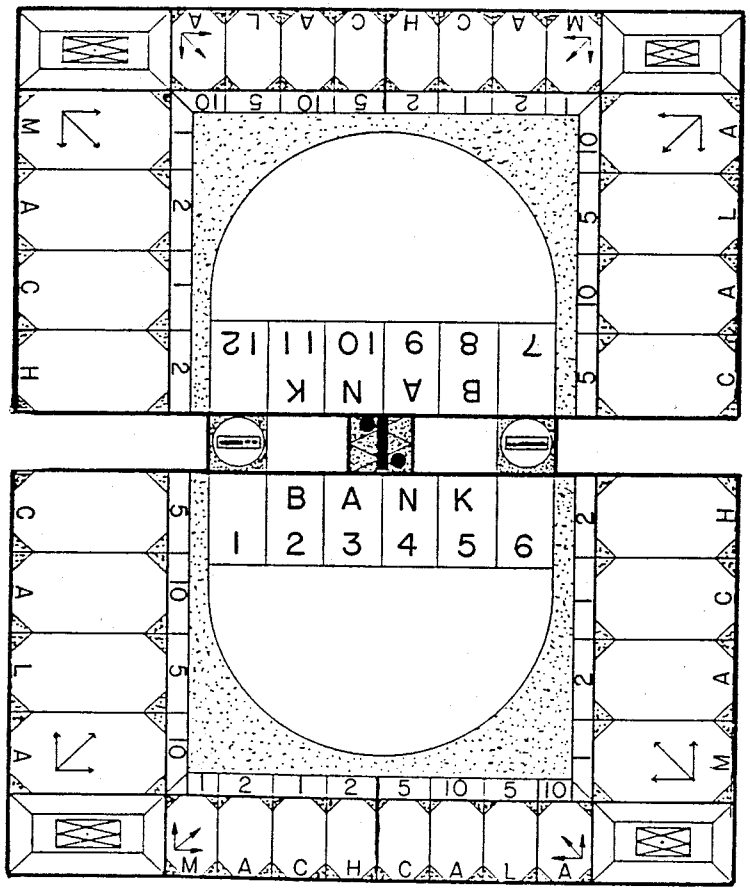
FIG. 13 is an illustration of a quadratic game simulation overlay-matrix for a well-known casino card game called BACCARAT.

FIG. 13 is a special Machcala Xchange game variation with home boards to the north, south, each and west of the matrix. The game simulated is the well-known casino game Baccarat. The 108 pieces are polar chips or Machcala cards with symbolic indicia representing two decks of playing cards (imprinted on only one face). At the start the cards are shuffled and dealt four per cell. Machs are optional in this game. Big Mach is the Joker and Rex is a special card with the designated RX sign. Captures, in usual MXI mode, are used to form "hands" in accordance with the established rules which govern play for baccarat and chemin-de-fer. When scoring the value of a hand (two or three cards), tens are ignored. Thus, the highest possible score for a hand is 9 since face cards and tens are scored as 0, aces as 1, and any other numerical card at its face value. Since each capture is used to form a hand, several hands would have been formed and put aside when all the point cards have been captured and the game ends. Hands are then "shown" (one set at a time) and compared in a "showdown" phase. The player with the best hands in each "show down" scores 3 points for a win (natural 8 or 9 count), 2 points for a regular win and one point for a "stand-off". The player who has captured most cards would therefore have hands which cannot be "played-off" against by his/her opponent in the show-down. These hands would be scored as "automatic" winners when shown, Mach-1 time frame is set at ten minutes. Mach-1 and -0 bonus—at the 50% and 25% level—apply. Up to eight players may participate in this Machcala Xchange card game variation.

EXAMPLE "I"

FIG. 14 is an illustration of a plan view of an educational game variation developed on the Machcala Xchange (MXI-10) matrix. The name of the game rendered is "PrepCenter". This game was created as a device to drill the pre-school child in the basic fundamentals of two of the three R's: reading, and 'rithmetic.

FIGS. 14*a* and 14*b* are illustrations of a keyboard (blown up) with characters on both sides indicating the subject matter of 2 available drills. Several of these keyboard with different "subject-drills" are included in each "set to form a program and this enables the teacher or parent to drill the child in numerous and diverse areas, e.g., the chisenbop method of counting, Roman numerals, musical scale, mathematical signs, etc. Playing counters are different colored chips (FIG. 14*c*) with particularized indicia on each face. The players use these chips, once captured, to "scramble" words or number sequences on the "Scrambleboard" indicated in the center court area (FIG. 14). The method of play is the same as prescribed for MXI Machcala Xchange games. The game's initial set-up calls for five pieces in each cell. There are 20 Machs (students) in play. Big Mach is called "Wiz Kid" and Rex, "Teach". Play money and questions and answers cards are included as accessories. The student is always rewarded for captures whenever the correct answers are given.

A special feature of this game is its two-face keyboard. It may be seen from FIGS. 14*a* and 14*b* (representing both faces of one such keyboard) that diverse forms of qualitative and quantitative drills may be accomplished by use of said keyboards in this game setting. In all such cases indicia on the faces of the keys represent unitary measures of the subject matter depicted. The student always "goes against" the drill master (teacher, parent, or fellow student).

In addition, one variation of PrepCenter lends itself to the use of the fingers as "pieces". In this variation which depicts Chisenbop methods (top row of FIG. 14*a*) the ten fingers are used to teach the child to count up to 99. Payment is made (with play money) by the losing 'caller' to the winner. It should be noted that although this rendering of "PrepCenter" (a Machcala Xchange educational game) is on a flat (plastic or cardboard) surface, it may also be encased (FIG. 75).

EXAMPLE "J"

Figure 15:
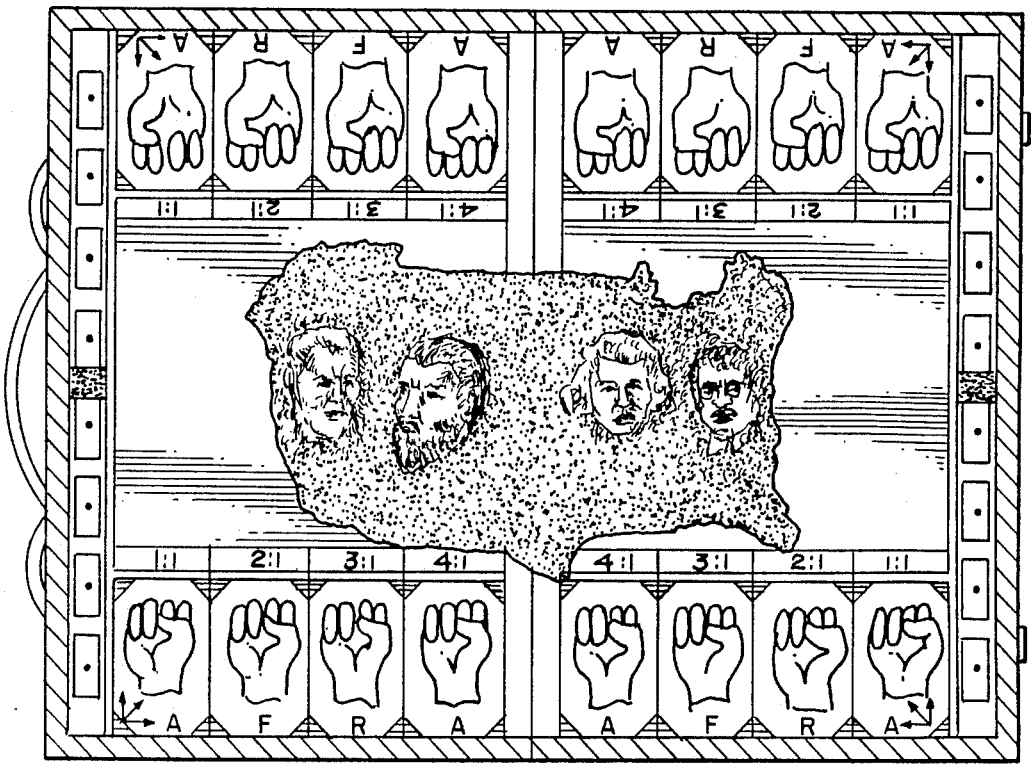
FIG. 15 is a plan view of the game called "AFRA": Afro-America's Fight for Freedom 1619–1969.
Figure 15B:
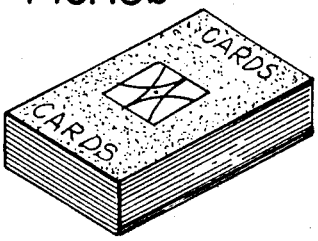
FIGS. 15*a*–15*f* show a configuration of accessories (game case, cards, doubler, chip, timer, etc.) used to play the game of FIG. 15 and other games as well.
Figure 15A:
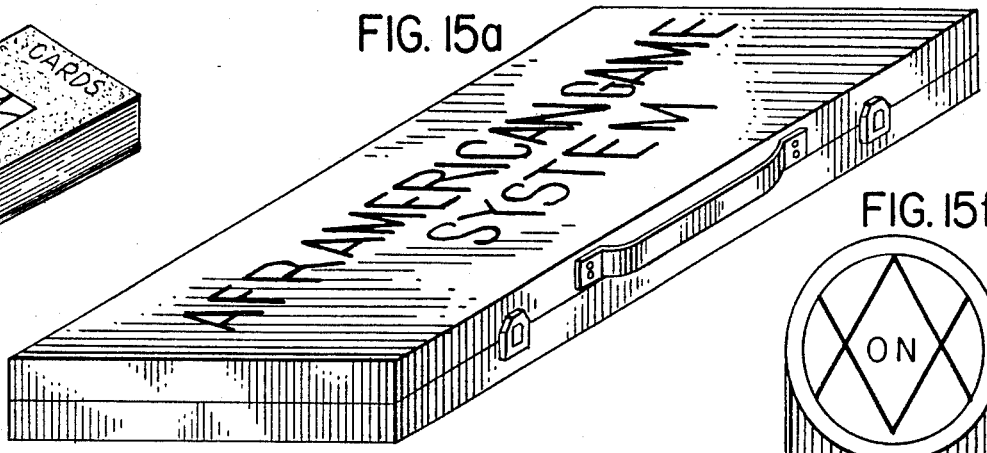
Figure 15F:
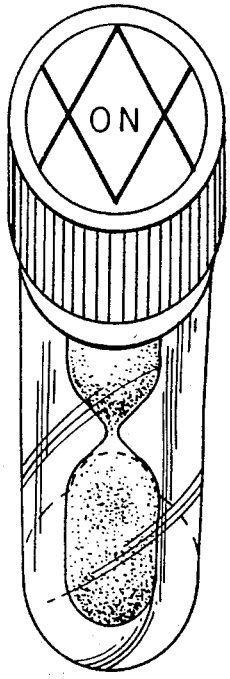
Figure 15C:
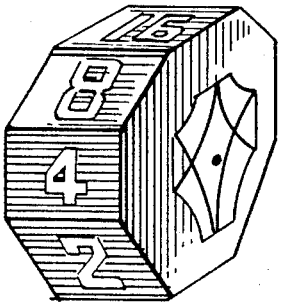
Figure 15D:
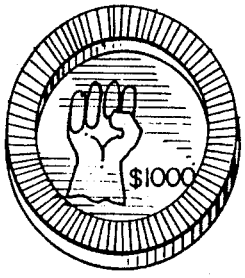
Figure 15E:
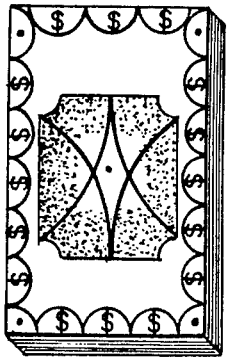
Figure 16:
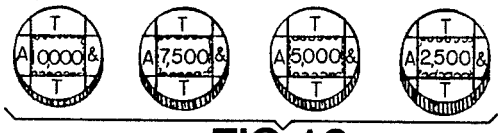
FIGS. 16–29 are illustrations of various playing pieces and other devices for the games of the invention.
Figure 17:
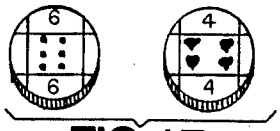
Figure 18:
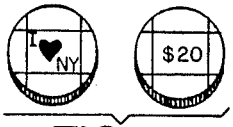
Figure 19:
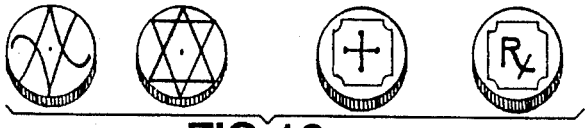
Figure 20:
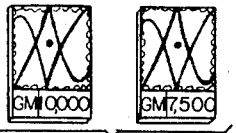
Figure 21:
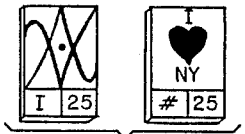
Figure 22:
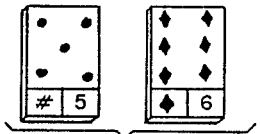
Figure 23:
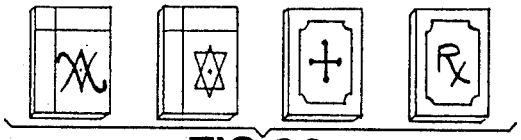
Figure 24:
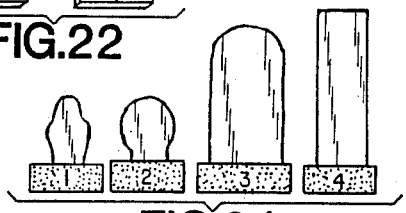
Figure 25:
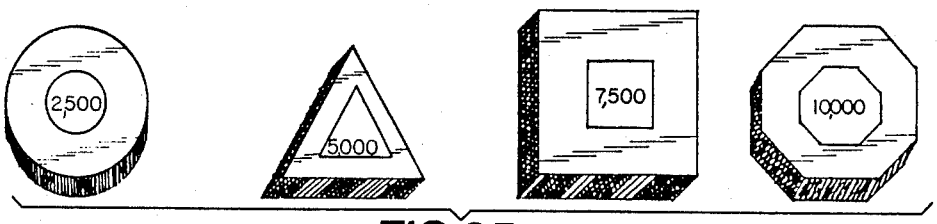
Figure 26:
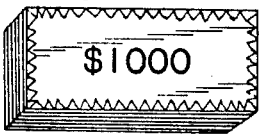
Figure 27:
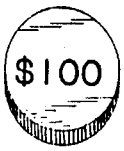

FIG. 15 is an illustration of a Machcala Xchange MXI-8 game developed from the process. The game illustrated is one in a series of national and ethnic game simulations which was especially created to focus on the rising expectations and aspirations of minorities in this country. The name of the game illustrated is "Aframerica" and was specifically developed for 25,000,000 Americans of African descent. The game simulation scenario relates to the concerted and often tragic efforts of these people—from 1619 to 1969—to secure full and equal civil rights and economic and social parity. Two different versions of play were created with each relating to the so-called Black Revolution: In the first version civil rights activists attempt to raise "bread" (funds) for the furtherance of The Cause; and, in the second, a message ("We Shall Overcome") is formed with captured pieces for highest point score.

FIGS. 15*a*–15*f* illustrate a sample of the pieces and other apparatuses used to play the game. Pieces are chips or small machcala cards bearing photographs of well-known black heroes. Educational material providing additional information on each hero is included on one face of the chance cards. Playing pieces are of different colors (gold, silver, blue, red) and numbered to indicate different values of similar colored pieces. They are also "lettered" to facilitate playing the scrambled-message variation called "We shall overcome". The set-up requires four point pieces and one special called "Civil Rights Activist" in each cell. Big Mach is called "Leader" and Rex is called "Klan". Capture is in the usual Machcala one-row mode with the winner being the player (a) to collect the most money ("bread") for The Cause or (b) formation of the message "We shall overcome." Points scored are as per value of each piece captured and placed in formation. Play money is used to settle transactions and the chance cards are drawn following a move that ends in capture. These chance cards contain questions of historical moment, the answers to which earn the player extra points or cash, if correct, or cause him/her to sustain a loss, if incorrect. The educational value of the game is thus tremendously enhanced by this rich, historical feature.

It is of interest to note that this game set (FIG. 15*a*) is usually packaged with two or three additional game-overlays which create a "system" or "superset" offering multiple games capability. In that all games included in said system are of African origin, the appeal to millions of Black families in this country and abroad will be extremely high and socially significant. The packaging approach also results in prospective owners securing a wide range of first-rate games (up to six) at tremendous savings in costs.

Although this game is rendered on the Machcala one-row matrix, it may also be depicted on the MRII, MCIII, and MRIV matrices. It also lends itself to structural variations in the various formats discussed hereintofore.

In order to further illustrate the merits of the inventions, I will now describe subject matters which have been treated as "Series" seeing that several depictions were required to adequately cover their diversity. These Simulation series (as against single subject treatment) would, of course, include several of the above game products, e.g., sports, casino games, business and finances. Although these further examples are not illustrated, it will be readily seen that they evidence the successful application of the game design and simulation process to a potentially limitless range of subject matters. Like the basic game of the invention, Machcala Stock Exchange and its variations hereintofore described, these further examples do not in any way depart from the scope of my invention but only serve to exemplify it:

EXAMPLE "K": ANTHEM: NATIONAL GAME SERIES

This series include patriotic games which are usually encased on the MXI-6 thru MXI-12 matrices with center court design depicting the geo-physical map outline of the target nation and playing pieces representing four or more major national monuments, symbols or heroes. Point pieces have monetary value—usually $10,000, $7,500, and $2,500 (4:3:2:1 ratio) with patriotic symbols on one side and are used to form suits worth *twice* face value. Accumulation is regarded as "funds raised for one's country." Discarded pieces are scored at face value. The MACH-1 time frame is ten minutes. A special feature of these games is the inclusion of advertising spots and musical buttons which play the "anthem" after a designated number of suits have been formed. In particular, a version called "American Anthem: A Machcala Xchange Game" is encased on the MXI-8 matrix with different colored pieces bearing representation of four great monuments: (1) The Map ("country") (gold) worth $100,000 each; (2) The Flag (silver) worth $75,000 each; (3) The National Emblem, the eagle, (blue) worth $50,000 each; and (4) The Currency "$" (red) worth $25,000 each. The object of the game is to capture pieces and form four-piece suits—trios, pairs or quads. A "hand" of four pieces is allowed. Opponent's spread can be hit and hand raided. Captured pieces not so used are discarded. MACH-1 is 10 minutes. Similar games have been developed for each major nation, including Canada, England, China, Japan, Russia, France, Italy, West Germany, Brazil, Mexico, Africa, India, etc.

EXAMPLE "L": MACHCALA SIMULATION: METROPOLIS SERIES

Subject depicted is a big city of a great nation. Game is encased on MX-6 thru MX-12 matrices with center court design depicting the sky line or map of the city treated. Each cell of the receptacle area is decorated with a photograph of one of the city's most well-known monuments. The value-line's pay-off factors indicate pay-off levels per cell (block). Value pieces are of different colors, lettered and numbered as to value, and bear photographs of monuments of the city. Value of pieces: gold=$10,000; silver=$7,500; blue=$5,000; and red=$2,500. Machs are City Lovers; Big Mach is the Mayor and Rex is the Governor. All captured pieces are used to spell out the sentimental statement: "I love ____" (name of city) for value as per $-designations. In particular, the game called "I Love New York: A Machcala Xchange Game" is encased on a MXI-8 cell matrix with the magnificent skyline of the city in the center court area and a "Big Apple" at the center of the ridge. The 64 value chips or cards bear letter and value designations below photographs of four of the city's most well-known monuments (Statue of Liberty, World Trade Center, United Nations, and Times Square), which are worth $10,000; $7,500, $5,000, and $2,500 respectively. Letter designations represent all the twelve letters in the statement: "I—L-o-v-e—N-e-w—Y-o-r-k". The object of the game is to capture pieces and spell out the sentiment "I Love New York", with said captured pieces' accumulated value regarded as funds raised as charitable contributions to help the loved city. MACH-1 time frame is ten minutes. Regular bonus, fines, and rules apply substantially as described for MXI games. Similar versions of this game have been successfully developed for all major American and foreign cities with population in excess of 100,000, e.g., Chicago; Los Angeles; San Francisco; Washington, D.C.; Dallas; Houston; Miami; Tokyo; Peking; Moscow; Paris; London; Rome; etc.

EXAMPLE "M": MACHCALA SIMULATION: RELIGIOUS GAME SERIES

This series of Machcala Xchange games simulate religious subjects. Usually the center court depicts a critical imagery of the subject treated. Pieces are machcala-cards or chips bearing indicia relating to the subject matter with designated values, powers and roles. In particular, the game called "The Ten Commandments: A Machcala Xchange Game" is treated on an MXI-10 cell matrix with a montage of the ten commandments covering the center court area and a crucifix over the center of the case's ridge. The pieces in the game are machcala-cards of four different colors (gold, silver, blue, white) with one of the ten commandments and its particular value on each face. The initial set-up requires five point pieces (commandments) in each cell. The Machs are called Believers, Big Mach is called Moses and Rex, The Sinner. The object of the game is to capture pieces and form one or more ten-piece suit spread representing the ten commandments—to earn highest score. The game ends when all value pieces have been captured. Chance cards are included (with Biblical questions) and are picked after each capture. MACH-1 is ten minutes. Play (moving, capturing, etc.) is substantially as described for MXI Machcala Xchange games, with pieces ensuit worth twice face value. Several other religious subjects have been treated, e.g., The 12 Disciples, Quest for The Holy Grail, Judgment Day, Exodus, Armageddon, The Creation, The Last Supper, etc.

EXAMPLE "N": MACHCALA SIMULATION: WAR GAME SERIES

The games of this series are directed primarily to students of military strategy and war games buffs. Various sized matrices may be used with the entire playing area or center court only decorated to represent the field of battle or negotiation. The point pieces depict the objects or goals being fought for and specials are soldiers (Machs), Commanders (Big Machs), and Traitor (Rex). In particular, the game called "'Nam: A Machcala Relay Guerilla War Game" is encased on an MRII/8 matrix with center court and receptacles depicting Vietnamese guerilla warfare terrain. Pieces (chips or cards) represent villages whose support is being sought by Machs and Viet Cong forces: Gold pieces represent villages of 1,000 natives; silver=750; blue=500; and red=250. The method of play is substantially as described for MRII games. The object of the game is to command majority support. MACH-1 is ten minutes. Another subject treated relates to the efforts of several enlightened world leaders to reduce the threats of nuclear warfare. The game is called "S.A.L.T.: A Machcala Xchange Disarmament Game". In this version, the center court is a "negotiating" table (MXI-8 cell matrix) and different colored pieces represent ICBMs, bombers, submarines, and tanks valued at 1,000, 750, 500, 250 points each. Capture is in the usual mode by the Machs (negotiators) and are used to form four-piece suits which can then be "withdrawn" at twice face value. The object of the game is to withdraw as much material as possible and so reduce the threat of nuclear warfare. Big Mach is called "The Chief Negotiator", Rex is called "The Hawk". The game is played substantially as described for MXI games. Various other war-related subjects are treated by games in this series, including America's War of Independence: 1776; "; WWI; WWII; Dunkirk; Korea; Suez; Israel in Egypt; D-Day; Blitzkrieg; etc.

EXAMPLE "O": MACHCALA SIMULATION: SPORTS GAME SERIES

Games in this series depict well-known field and court games substantially as described hereintofore. See FIGS. 6–11. In addition to these examples, a game called "Baseball: A Machcala sports "simulation", is treated as follows: The scenario depicted is one of five playoff games in the World Series. The game is encased on a MRII-9 cell matrix with the entire playing area decorated to depict a section of the baseball field (first, second, and third bases, and also home plate). The nine cells represent a stylized scoreboard for each inning. Because of the odd number of cells (innings) five are placed on the left side of the game cases' ridge and four on the right. These are called the "long" and the "short" side of each player's home-board. The value-line designates these cells as first thru ninth innings. There are 72 point pieces in the game: approximately 50% represent singles, doubles, three-base hits, and home runs; the remainder are strikeouts and errors. The 22 specials are players (Machs), player-coach (Big Mach), and umpire (Rex). The initial set-up calls for four point pieces and one player in each cell. All captures are effected in the prescribed MRII manner and are accumulated directly before the respective innings in which "hits" were made. The object of the game is to score most runs (4 hits=1 run) in the 9 innings of play.

Another well-known sport depicted in this series is "Grand Prix" Racing. In this sports simulation game—rendered on the MXI-10 cell matrix, the center court design depicts part of a race track. The 80-point pieces (colored gold, silver, blue, red) are first, second, third, and fourth place finishes worth 4, 3, 2, and 1 points respectively. Machs are called "Drivers", Big Mach is called "Champ", and Rex is "The Judge." The object of the game is to score most points and become the "champion driver" of the season. MACH-1 is 10 minutes with the game being played substantially as prescribed for MXI games hereintofore.

Other well-known sports and sporting events which lend themselves to similar treatment are Horseracing, Golf, Bowling, Ice Hockey, Boxing, Wrestling, Handball, Squash, etc. Some depictions are represented by two renditions: one which depicts "Play-offs" scenarios; and another which is particularized as an "ad game" for respective teams.

EXAMPLE "P": MACHCALA SIMULATION: POLITICAL GAME SERIES

These games depict national and statewide campaigns, congressional debates, and other politically-related subjects on various matrices. In particular, a game called "Presidential Campaign: A Machcala (Relay) Game" simulates U.S. Presidential campaign, which occurs every four years, on an MRIV-12 matrix. The value-line is not in play and the total playing field is a montage of the 50 states. Value pieces represent "registration" for each state and bear indicia stating percentage and number of total votes cast in that state in the last presidential election. Percentages of votes cast are approximated as follows: gold chips=40%, silver=30%; blue=20%, and red=10%. The game is played substantially as described in the MRIV game (FIG. 3). Big Mach is called "Democratic/Republican Party Leader" and Rex is called "The Opposing Candidate" and Machs are "Presidential Candidates." There are 248 pieces on play. The object of the game is to win the majority state votes and get elected "President of the United States." Electoral votes are disregarded. MACH-1 is 15 minutes. Chance cards are used which inerease or decrease number of votes won. All other election campaigns are treated in this series—senatorial, congressional, gubernatorial, county and local—for this and other nations.

EXAMPLE "Q": MACHCALA SIMULATION: CLASSICAL "DUETS" SERIES

Games in this series pay homage to the greatest classical games of all times, incorporating their essential features with the "relay" and "Xchange" methods. The focus is on games which were once popular in ancient civilizations dating back as far as 3000 B.C. Some of the games included in this series are: Senet, Tables (Backgammon), Tab, Pachisi, Morris, Chess, Go, Mora, etc. In particular, a game in this series called "Hana-Cala: A Machcala Xchange game", successfully incorporates the methods of a popular Japanese flower-card game, "Hana-Awase" or "Hache-Hache" with those of Machcala games. Hana-Cala is rendered on an encased MXI-6 circular matrix with an extended center court or "boneyard" area which is colored red and white. There is no value line and the twelve cells (representing months of the year) are decorated with replicas of the glory, life, pennant and nature cards. Game pieces are a plurality of Japanese "flower cards", two Big Machs (Suns) and two Rexes (Emperors). There are no Machs in the game. The 48-point cards in the deck are divided into twelve suits of 4 cards each. There are 5 glory cards worth 20 points each; 9 life cards worth 10 points each; 10 pennant cards worth 5 points each; and 24 nature cards worth 1 point each. The 12 suits represent the 12 months of the year and are called Pine (January), Plum (February), Cherry (March), Wisteria (April), Iris (May), Peony (June), Clover (July), Hillcrest (August), Chrysanthemum (September), Maple (October), Willow (November), Paulownia (December). The sum of the values of the 48 point cards in each deck is 264. The initial set-up calls for 4 cards in each cell (after shuffling both decks). In addition, 4 cards are dealt as "hand" to each player, 8 cards as "Table", and the remainder put aside as "Stock". The object of the game is to capture cards in the usual MXI mode and use said cards to "take" from the table in the manner of the well-known card game of Casino. Captured cards are used to "take", improve the player's "hand" or put aside as "discards."

The first player to make "takes" with a total value of 264 or more points (MACH-1 Bonus points of 50% of value accumulation) wins the game for the first season of the year. A game usually consists of four seasons. MACH-1 time frame is ten minutes. The "Khan" method of scoring, as well as Attainment and Revelation Honors (Teyaku and Dekiyaku) are disregarded. Hana-Cala is a beautiful family game and is recommended for two to four players.

Another game in this "Duets" series is called "Gammoncala: A Machcala Xchange game. It is rendered on a MXI-12 backgammon-type playing field with gold/silver pips in each cell. Phase I (Entry) calls for each player "entering" 120 color-coded value pieces (chips with values of $100, $75, $50, $25) and 28 special pieces. Cells are numbered 1–12 and pieces are entered based on the outcome of rolling 2 dice. Phase II (dealing) moves are also determined by the roll of 2 dice (as in Phase I). Rolls—in both Phases I and II determine the cell or set of chips therein and may be read in several different ways: added, subtracted, divided, or multiplied. Capture is in the regular MX-1 mode. Mach-1 is 15 minutes and earns 50% bonus. Mach-0 earns only 25%.

Another rendition in this series is called Cala-Chess. A MRII/8 mat six is used and playing pieces are 4 sets of small magnetic chessmen. Each player enters 4 pieces in each designated set-up cell and capture whenever his/her last piece lands in a loaded cell-in-competition with opponent's cell-in-competition directly opposite containing 2, 3, or 4 pieces with value less than 16 points. Value allocation is as follows: King=10 points each; Queen=9; Rooks=4; Bishops=3; Knights=2, and Pawns=1. Mach-1 is 15 minutes and earns a bonus of 10 points. Mach-0 earns no bonus.

EXAMPLE "R": MACHCALA EDUCATIONAL GAME SERIES

Games in this series depict academic or instructional subject matters. In particular, a game called LAUDE: Class of (Year) is rendered on a MXI18 or MRII/8 Matrix. The value-line assigns grades earned as follows: D=1; C=2; B=3; A=4 (Quality points). The scenario depicted relates to the academic efforts of college (or high school) students to graduate with "Laude'-'—Summa, Magna, or Cum. There are 32 value pieces per player and these represent the 32 subjects required to earn the Bachelor's Degree over 8 semesters (cells). Quality point average is based on a 4-point grading system in which A's are worth 4 quality points; B's, 3 quality points; C's, 2 quality points; and D's, 1 quality point. Machs are called "Students", Big Mach is called "Laude", and Rex is the "Dean." A special scoring feature is a fixed divisor of 32, representing the number of courses in the 4-year curriculum leading to the Bachelor's degree. Capture is in the usual MXI or MXII mode. MACH-1 time frame is 10 minutes and earns a bonus of 10% of accumulated points. It is of interest to note that several game authorities call Maneda games "African Chess."

Other games in this series address the problem of improving teaching and training methods and devices in game-related scenarios. For instance, a game called "Components: A Machcala Xchange Game" (aka "Comparts") is played on various sized and shaped MX matrices with point pieces (poker chips or machcala-cards) bearing indicia which represent pictures of various component parts of the subject matter. Only technical subjects are treated in the series e.g. the human body, motor car engines, T.V. and radio sets, etc. Players capture and form "sets" comprising inter-related parts for points score as prescribed. The teaching value of games in this series is extremely significant in view of the pleasure brought to the learning process during or after formal training hours.

EXAMPLE "S": MACHCALA SIMULATION: CASINO GAMING SERIES

This Machcala game series simulate popular casino gambling games on various (MXI-IV) matrices. See FIGS. 12 and 13. Bingo, lotto, slot machine, craps, blackjack, and other games are treated in this series. Particularly, a MXI-8 version, called "Bingo-Banko: A Machcala Xchange Game", includes a dualistic playing procedure in which pieces captured in the "Xchange" exercises are used to "mark" various "numbers" on bingo cards (two per player) which are drawn on the center court of the game case's playing field. The 64 point pieces are numbered 1 to 75. Captured pieces are used to "mark" the bingo cards. Machs are called "players", Big Mach is the "Banker", and Rex, the "Barker". Object of the game is to get "5-in-a-row" on both cards. A "short" game requires only two such formations; a "long" game may require four or more such, as decided upon by the players. MACH-1 for the "short" game is 5 minutes. Each player scores 5 points per "Bingo" plus Mach bonus at 25 or 50%. The game is suitable for 2 or more players with "Banko" settlement at $1 per point differential.

Another game in this series-depicted on a MXI-8 cell matrix—is called "Slot Machine: A Machcala Xchange Game." The pieces are different colored poker chips with indicia representing oranges, apples, cherries, and grapes. The object of the game is to capture value pieces and use said captures to form three of four-piece suits for cash pay-off at twice face value of suits formed. MACH-1 is 10 minutes and the usual bonus for speed applies. This game may also be rendered in electronic (computer-based) formats as described hereintofore.

Another game in this series, called "Casino-cala: A Mancala Xchange card game," successfully adapts Machcala Xchange methods to the playing of this well-known card game. We used the MXI-8 matrix—without value-line. The cells are decorated with picture cards' faces—King, Queen, Jack and Ace—and the center court has markings for 16 cards. A miniature deck of regular playing cards is used. The initial set-up calls for 4 cards in each of the 16 cells. Four extra cards are added to the deck: two decorated with crosses represent Big Mach, and 2 others decorated with $R_x$ represented Rex. Capture is in the usual MKI manner with cards won used to "take" from the "Table" in simular manner to the traditional card game. MACH-1 is ten minutes and the regular 50% or 25% "speed" bonuses and other MXI rules apply.

EXAMPLE "T": CORPORATE AND INSTRUCTIONAL AD-GAME SERIES

Games in this series depict the operations of corporate and eleemosynary institutions. Operations of major firms or organizations are depicted for advertising/promotional/goodwill purposes, with logos or products used to establish the required scenarios.

In particular, a game called "MA'BELL" (aka "AT&T") is rendered on a MXI/8 cell matrix in which the center court is a montage of AT&T's corporate symbol (a bell) and the cells are decorated with telephones and communication system's component parts. The value-line indicates value of "Bell systems" ($1,000, $2,000, $3,000 and $4,000/year) which form the "solution" to clients' communications problems. Playing pieces are different colored chips bearing indicia which represent 1, 2, 3, or 4 such systems sold by reps. Machs are "Systems Analysts"; Big Mach is "Ma' Bell"; and Rex is "The Competition." The object of the game is to maximize earnings for Ma' Bell by setting up as many systems as possible at the highest price. MACH-1 is ten minutes and the game is played substantially as described for MXI accumulation games including accessories—chance cards and play money.

Another corporate variation depicts the operations of General Motors as a Machcala Xchange Game. This is done on an MXI/8 cell matrix with a montage of the company's cars on the center court and the GM logo in each cell. In this scenario, two dealers compete to sell more GM cars for the year. Machs are "Dealers"; Big Mach is "GM"; and Rex is "The Competition." Point pieces are 64 machcala-cards, representing luxury models at approximate "suggested" retail prices. The object of the game is to maximize sales. Chance cards bear instructions impacting favorably or unfavorably on the financial position of players. MACH-1 is ten minutes. The game is played substantially as prescribed for MXI games.

Another game in this series is called "Big Mac: A Machcala Xchange Game" (rendered on the MXI/6 matrix). The center court is decorated with a pair of stylized Big Mac hamburgers and cells with the famous MacDonald's Golden Arches. Point pieces are specially designed cards or chips with various items of McDonald's menu imprinted on one face. Gold chips are Big Macs worth 4 points; silver chips are french fries worth 3 points; blue chips are apple pies worth 2 points; and red chips are Coca Colas® or milkshakes worth 1 point. Machs are "Customers"; Big Mach is called "Manager", and Rex is "The Dietitian". The game is aimed at your players and the object is to capture point pieces and attempt to form 2, 3, and 4 piece suits representing a full "meal". Each "meal" must have a Coke® or milkshake to qualify for score at twice the face value. Discarded pieces are scored at face value. MACH-1 is ten minutes. The game is played substantially as described for MXI games. Chance cards are optional.

EXAMPLE "U": "FEVER" (FADS & HOLIDAYS) GAME SERIES

These games depict very popular fads and hobbies on various MX game matrices and illustrate additional utilization of the MX simulation process. Book reading, theatre, dancing, jogging, birthdays, Christmas season, philately, numismatics, and other hobbies-related subjects are all treated in this series. In particular, the game called "Xmas Fever: A Machcala Xchange Game" is depicted on an MXI/8 cell matrix without value-line. The center court is decorated with a montage of desirable Christmas presents. The 64 point pieces are colored gold, silver, blue, and red with the photo of an attractive gift imprinted on one face. The value of each gift is determined by the color of the chip: gold=$100 value; silver=$75 value; blue=$50 value; and red=$25. These are 16 Machs in play. Big Mach is called "Santa" and Rex is called "Scrooge". The object of the game is to accumulate the most valuable set of gifts. MACH-1 is ten minutes. The game is played substantially as described for MXI games.

Another game called "Disco Fever: A Machcala Xchange Game" is depicted on a MXI-8 matrix without value-line. The center court is designed to represent a dance floor with several dancers executing popular steps. The point pieces are gold, silver, blue, and red machcala-cards with different types of dances depicted. Gold cards are worth 4 points for "best dancing"; silver=3; blue=2; and red=1. There are 16 Machs in this game (dancers); Big Mach is called "Disco King" or "Disco Queen," and Rex is called "Disc Jockey. The object is to capture cards and form 4-piece "dance suites" for double face value. MACH-1 is 10 minutes with the usual 50% bonus. The game is usually played to loud dance music and with conviviality.

EXAMPLE "V": ASTROLOGICAL GAME SERIES

Games in this series depict occult, astrological, and psychic subject matters. In particular, a game called "Zodiac Power: A Machcala Xchange Game" is depicted on a circular MXI-6 matrix decorated with the 12 signs of the zodiac, one in each cell (house). There is no value line. The 48 point pieces (chips or cards) represent the 12 signs of the zodiac and all pieces are of equal face value. There are 16 Machs in this game ("persons"); Big Mach is called "The Sun," and Rex is "The Element". The point cards are of four different colors with a zodiac sign imprinted on the face of each card. Red cards are Fire signs (Aries, Leo, Sagittarius); Gold cards are Earth signs (Taurus, Virgo, Capricorn); Blue cards are Water signs (Cancer, Scorpio, Pisces); and Silver cards are Air signs (Gemini, Libra, Aquarius). The object of the game is to capture cards and form 4-piece suits for most points. Suits are scored at twice face value. Chance cards are used for questions and answers which bring about reversals or advantages. relating to astrology. Correct answers result in extra points and incorrect answers in reduction. MACH-1 is set at ten minutes. Methods and rules of play are essentially as described for MXI games.

EXAMPLE "W": ENVIRONMENTAL GAME SERIES

Games of this series relate to the ecological subjects: sea and space exploration, inner earth, the great deserts and jungles, energy conservation, water pollution, etc. In particular, a game called "Energism: A Machcala Xchange Game" is encased on an MXI-8 cell matrix, without value-line. The center court is decorated with a montage of the major sources of energy-atomic power, electricity, oil, coal, solar power, etc. The 16 cells are decorated with oil-guzzling equipment and devices. The 64 point pieces are different colored poker chips with indicia symbolizing alternative sources of energy. Black chips, representing oil, are worth no points; white chips representing atomic power, are worth 5 points, red chips, representing electricity, are worth 10 points; and gold chips, representing solar power, are worth 20 points. The Machs are called "consumers"; Big Mach is called the "Energy Czar" and Rex is called "OPEC". The object of the game is to score as many points as possible for energy conservation. MACH-1 time frame is ten minutes and the game is played with chance cards relating to energy conservation.

Another game in this series called "UFO Encounterama: A Machcala Xchange Game" is depicted on the MXI-10 matrix which is decorated to represent the sky at night. The value-line is not in play. The scenario relates to UFO sky-watchers scoring points for various kinds of "encounters" experienced. The chips are of four different colors (gold, silver, white, red) and bear indicia representing flying saucers. Value assigned for "first level" sightings (red chips) is 1 point; second level sightings (white) 2 points each, third level encounter sightings (silver) 3 points each; and fourth level sightings (gold) at 4 points each. Machs are called "Watchers"; Big Mach is called "Blue Book"; and Rex is called "NASA Command." The object of the game is to score most points for sightings. MACH-1 time frame, 15 minutes, earns 50% bonus.

Another game, "Spacewar: A Machcala Relay Game," further illustrates the application of the machcala simulation process. In this variation, the scenario pits space troopers of planet Earth against evil invaders from Gamma Andromeda (the Milky Way's twin galaxy). These aliens are bent on conquering Earth before their own planet is destroyed by the plaque." The matrix used to render this game is a non-value-lined MRIV-10 duly decorated to represent near space. Point pieces are 100 different colored space ships (gold, silver, green, brown, red) of equal value. Each piece is assigned the role of a "gunner" ship so there are no Machs. Big Mach is called "Squadron Leader" and Rex is called "The Force." One player (X) plays the role of the Andromedans and the other (Y) represents Earth. This game is essentially a test of wits and cunning and the objective is to incapacitate or totally wipeout opponent forces. In this variation of play, all captures are *re-entered* and not recovered from the field of battle. MACH-1 is 15 minutes and the game ends when one side is reduced to singletons or "totally wiped out."

Moves and captures are made as prescribed for MRIV games hereintofore.

EXAMPLE "X": ETHNICITY & GENEALOGICAL GAME SERIES

Games in this series were inspired by the phenomenal response to Alex Haley's magnum opus, Roots I and II. The scenario depicted relates to all major ethnic groups' country of origin, family trees and genealogical history. (FIG. 15 illustrates a game classified under this category.) In addition, another game called "Family Tree: A Machcala Xchange Game" is depicted on a MXI-8 matrix, the center court of the field is designed to represent a genealogical chart. The value line is not required. The pieces are machcala-cards (gold/silver/blue/red) representing ancestry as follows: gold pieces are Honorable Ancestors worth 10 years, silver are Great, Great Grandparents worth 5 years; blue are Great Grandparents worth 3 years; and, red are Grandparents worth 2 years. Machs are called "Bloods" or "Family Members"; Big Mach is called "Tracer"; and Rex is called "Black Sheep." The object of the game is to capture cards and form 4-piece suits (sets or runs) for *double* face value in years. The total possible number of years represented by the 64 value cards in suits is 320 tracer-years. With the MACH-1 bonus of 50% it is therefore possible for very astute players to "complete" a five hundred year "tracing" of his/her family roots. Chance cards are drawn following each capture and impact score with pro/con effects. Pieces captured, if not utilized to form suits, may be used to build hands or "hit and raid" opponent's spreads, as described hereintofore. Discards (cards not in suit) are valued at face. MACH-1 is 15 minutes and earns a bonus of 10% of accumulation. MACH-0 earns nothing.

EXAMPLE "Y": OBJECT D'ART SERIES

Games in this series depict subject matters relating to the arts, e.g., music, painting, sculpture, architecture, dance, literature, etc. Various MX matrices may be used. In particular, a game called "Art Collection: A Machcala Xchange Game" is encased on a MXI-8 matrix without value-line. Center court depicts an art-auction and cells are decorated with representations of well-known paintings and sculptures. Playing pieces are 64 colored machcala-cards bearing photographs of famous works of art. These pieces are values as follows: gold cards=work valued at $100,000; silver cards=$75,000; blue cards=$50,000; and red cards=$25,000. The object of the game is to acquire and "build-up" the most expensive art collection. Chance cards and play money are optional. MACH-1 is 10 minutes.

An unusual feature of the Object d'art line is its focus on the aesthetic aspects. In a MXI-10 game called "Numismatix", for instance, the playing court is, in fact, an expensive display case, with the field made of red velvet material. The playing pieces are replicas of 100 of the world's most famous coins with value indicated on each coin. For convenience the coins are classified under five different categories—$1,000, $2,000, $3,000, $4,000, and $5,000. Initial set-up calls for 5 coins per cell. There are 20 Machs. Big Mach is called "The Collector"; Rex is the Auctioneer. The game is played for value accumulation substantially as prescribed by MXI games hereintofore. MACH-1 is 10 minutes.

EXAMPLE "Z": MACHCALA SIMULATION: SHOW BIZ SERIES

Games in this series depict Broadway shows, movies, TV networks, dramas, novels, comic strips, spectacular events, etc. In particular, a game called "TV Network: A Machcala Xchange Game" is rendered on an MXI-7 cell matrix with the value-line used to designate the seven days of the week. Center court is a montage of the three major networks' (ABC, CBS, NBC) most popular shows and the cells are stylized with TV screens. The 56-point pieces represent Neilsen Ratings" with indicia stating name of show and ratings as follows: gold chips=Neilsen rating of 30 points; silver=20 points; blue=15 points, and red=10 points. Machs are called "Fans"; Big Mach is called "Network"; and Rex is called "Critic". Competing players attempt to maximize ratings during one week of the monthly which determine advertising rates and ranking. The final score is the average audience per "prime time" show over the seven-day week. The divisor is constant at 28 shows per player. The MACH-1 bonus is 50% with 25% for MACH-0. Captures and rules are as described for MXI games. MACH-1 is 10-minutes.

EXAMPLE "AA": BUSINESS AND FINANCIAL GAME SERIES

Games in this series relate to the acquisition and accumulation of property of diverse nature, the operations of business, budget planning, etc. The "parent" simulation game belongs to this particular series. In addition, a game called "Tax Revolt: A Machcala Xchange Game" is rendered on an MCIII/10 cell matrix. The center court depicts people of several states demonstrating against the "burden" of rising taxes. Value-line designations represent various levels of taxation (10%, 20%, 30%, 40%, and 50) for "unearned income" in the front game, and "Private Property" in the back. Cells decorated with a montage of entitlements relating to income producing assets—stocks, certificates, bank accounts, property deeds, trust documents, etc. The 200 different colored point pieces (machcala-cards in the backgame and poker chips in the front game) bear indicia stipulating values as follows: "unearned" income chips: gold—$5,000 per year; silver=$2,500, blue=$1,500; and red=$1,000. For "private property" cards: gold=$100,000 assessed value, silver=$75,000, blue=$50,000; and red=$25,000. Machs are called "Taxpayers"; Big Mach is called "Travis", and Rex is called "IRS." Moves and captures are essentially the same as described for other MCIII games and the basic game of the invention. However, all front game cells are "in competition" and all captures are compulsory. The object of the game is to maximize wealth and minimize taxes. Tax levy on captures is stated on the value-line: 10%, 20%, 30%, 40% and 50%. Chance cards are drawn after capturing moves. These cards contain tax-related information and instructions which impact favorably or unfavorably on the players' income position. Play money is used to settle all transactions. MACH-1 is set at 15 or 20 minutes—depending on the level of proficiency attained by the players. An interesting variation of this game is played with two teams of three or four players, with one player acting as "Captain" and the other players as "Advisors". The role of the captain changes after each tax season is completed. Four seasons are played.

In view of the evidence provided by way of these non-limitative examples, it must be accepted that the objectives of the invention have been achieved vis-a-vis the application of the process to simulate numerous and diverse subject matters. The resultant variety of "Machcala" simulations and variations will vastly increase the potential appeal to the special interests of large number of people. To that extent, the popularity of the games of the invention—as well as Mancala games—will be greatly enhanced in this country and all over the world. By purchasing additional *game overlays* and playing pieces, prospective owners will also be able to acquire several versions (MX, MR & MC matrices) at tremendous cost savings.

DETAILED DESCRIPTION OF THE PRESENT INVENTION

Part VI: Methods of Play & Rules of the Game

One of the most important aspects of the present invention is its new and improved playing methods. These are extended to form the basis for a standardized set of rules, glossary and body of procedural guidelines vis-a-vis preferred methods of play. These rules may be applied to Mancala games in general and the games of the invention in particular. Together with the notation system hereinafter described, they suffice to provide the necessary bases for professional (national and international) competition. A vast improvement in the popularity and quality of play of Mancala and Mancala-like games could, therefore, come about as a direct result of this particular aspect of the invention.

A. GENERAL RULES & REGULATIONS (1) The basic vectorial, generic or any simulated/scenario format may be used for professional play. These include games in any embodiment—computerized, table top, cardboard, or encasement.

(2) Recommended Matrices: The MPX1/2, MX1/2², MX1/3, MR11/3 and MR11/4 are recommended for professional level play. For Cala (generic or sim/scen play) the following matrices may be used: MXI/8, MRII/8, MCIII/8 and MRIV/8. In this respect the MCIII/8 matrix is ideally suited because of its combinatorial structure.

(3) Levels of Play: There are four levels of play based on the level of mastery achieved:

a. Beginners or novitiate level—called Level I.
b. Intermediate or Junior—called Level II
c. Senior or Advanced Level
d. Professional Level At the novitiate level, only the MXI/6 or MXI/8 matrix should be used. Machs are not in play and the Value-line and "switching" are disregarded. MACH-1 speed bonus (though usually unattainable) is included. See Levels of Play.

(4) Levels of Professional Attainment: There are three levels of professional attainment based on pro-points accumulations at the most advanced stages, as stipulated by the attainment rules of The International Machcala Federation (IMF)—formation pending.

a. Pro-I—Master
b. Pro-II—Grand Master
c. Pro-III—International Grand Master (5) Calls: Certain "calls" or "announcements" are usually used—á la "check" and "checkmate." These calls are not mandatory.

a. "Empowering" or "powering"—to indicate a power play i.e., a swap or re-entry of a special or power piece; (see empowerment)
b. "Mach"—to remind opponent to start or stop timer. A fine is imposed for *not* starting timer—usually the lowest value piece in play on opponent's side.
c. "Cala"—to indicate that capture has been made.
d. "Error"—to indicate an error and need for correction. Fine may be imposed or waived, as stipulated.
e. "Switching"—to indicate a change in direction of the next drop. (Optional)
f. "Foul"—to indicate that an attempt to cheat has been detected. Fine is compulsory, as defined by rules of play.
g. "Doubling"—to indicate that the player wishes to increase the stakes by use of the doubling device.
h. "Feed"—to indicate (in MXI games) that the player's homeboard is empty and that he/she needs to be fed at least one piece so that the endgame may be played out to its conclusion.

(6) Playing Pieces: a game must include at least two classes of pieces:

a. Value pieces—color coded and otherwise identified as to respective values. Usually in the ratio of 1:2:3:4.
b. Special pieces—Machs and Big Machs which are empowered to capture; and Rex which negates capture.

(7) Mach Time Frames—there are two "Mach" or "speed-of-performance" time frames and related bonus levels for each game. MACH-1 "performance", as defined for respective games, earns 10–50% bonus of total score for the game. MACH-0 performance is defined as any rate of play slower than MACH-1 and earns a reduced bonus of 0–25%. As the name of the game indicates, Mach'Cala is more fun played as fast—and as skillfully—as possible.

(8) Doubles Play—in doubles play opponents alternate turns. Thus, if the first deal is made by $X_1$, $Y_1$ follows; then $X_2/Y_2$, $X_1/Y_1$, and so on. Verbal and written forms of communication are not allowed. Sign language and body language may be used.

(9) Team Play—In team play, defined as more than two players per side, one player may act as "Chairman of the Board" and make all the moves based on *verbal or written* advice of his "board members".

(10) Homeboard Sections—the receptacle area or areas represent the player's homeboard. The "bar" of the game case separates left from right (inner/outer) homeboard. For all MCIII games, the upper (MXII) homeboard is called the front game and the lower homeboard, the back game.

B. RULES OF PLAY (1) MXI/8 Initial Set-up Rules: The initial set-up requirements for standard MXI/8 matrixed games are as follows:

a. Number of Point Pieces—four (as differentiated) in each of the 8 cells.
b. Entry of Special Pieces—enter one Mach (as called) in each loaded cell.
c. Entry of Special "Power" Pieces—Enter 'Cala (as called) and "Killer" (as called) in two loaded cells.
d. Audit—check to ensure that there are 42 pieces on each homeboard—32 point pieces and 10 special pieces.

(2) MRII/8 Initial Set-up Rules: The initial set-up rules for standard MRII/8 matrixed games are as follows:

a. Identification of "designated set-up" cells—as defined. Usually plain, non-shaded cells, as shown in the drawings.
b. Identification of "In-Competition" cells. Usually shaded or logoed cells, as shown.
c. Number of Point Pieces—four (as differentiated) in each of the 8 designated set-up cells.
d. Entry or Special Pieces—enter one Mach (as called) in each of the 8 loaded cells.
e. Entry of Special "Power" Pieces—enter 'Cala and Killer (as called) in two loaded cells.
f. Audit—check to ensure that there are 42 playing pieces—32 point pieces and 10 specials—on each homeboard.

(3) MCIII/8 Initial Set-up Rules—Note: The MCIII matrix is a combination of the MXI and MRII and the rules governing both these forms apply. Thus, in an MCIII/8 game, there must be 84 pieces in each player's front and back game: 32 point pieces and 10 specials in the front game; and 32 point pieces and 10 specials in the back game.

(4) MRIV/8 Initial Set-up Rules—The initial set-up requirements for the standard MRIV/8 matrixed games merely double up on the MRII/8 requirements. Thus, there are 84 pieces per player in an MRIV/8 game—32 point pieces and 10 specials in the "front" game (played on the first two rows); and 32 point pieces and 10 specials in the "back" game which is played on the 3rd and 4th rows.

(5) General Initial Set-up Guideline—In general the maximum number of point pieces in each initial set-up cell is approximately 50% of the number of cells per row. Thus, in an MXI/6 game, there would be three point pieces per cell, not including the special pieces.

((6) Rules of Play—Determination of First Move: First move is determined by palming Killer and 'Cala. The player correctly indicating which hand has 'Cala wins first play. He/she may forego the honor and allow opponent to make the first move—called "deal" in "Xchange" games and "run" in "Relay" games.

(7) Initial Rearrangement Option—Any player in any form of the game (except vectorial variants) may elect to play with the initial arrangement "as is" or rearrange it, as he sees fit. There must be, however, at least two loaded cells in play. The opponent need not respond to a rearrangement.

(8) First Contract Bid—Both players must negotiate an "opening contract" as to the number and/or value (as factored by the pay-off odds) of the *first* capture. For most Xchange games ≧2 pieces are required. After the first "contract" has been fulfilled, all further captures are "open", as defined by the rules of play. The object of the first contract limitation is to eliminate easy ("sitting duck") capture of 2's, if capturing is not limited to 3's and 4's. (See Capturing)

(9) Dealing— a. MXI games—The deal is counterclockwise from Ia–Ih on to opponent's Ia and in each successive cell. No cell is to be skipped in double-circuit deals which extend back to starting cell or beyond.
b. MRII—clockwise in successive cells of player's two rows. The deal in an MR "Relay" game may consist of one or more "runs" since the deal does not end until capture is made or the last piece is dropped in an empty cell.
c. MCIII games—same as a. and b. above. The front game (MRII) is always played first.
d. MRIV—Two methods of dealing are allowed: (i) direction is clockwise on the 4th row, counterclockwise on the 3rd, clockwise on the 2nd and counterclockwise on the 1st; (ii) optional direction—for each of the four rows—clockwise or counterclockwise.

(10) Switching: The official name of the moves and switch moves for regular and vectorial variations are as follows: FORWARD (1st and 2nd); REVERSE; DIAGONAL-up left; DIAGONAL-up right; DIAGONAL-down-left; DIAGONAL-down-right; VERTICAL-up; VERTICAL-down.

a. Vectorial Xchange: The forward counterclockwise placement maybe followed by a switch in any of 3–8 directions indicated by the vectors and . A player may initiate the first switch from his/her own side, as per the vectorial options indicated by the arrows.
b. Switching—Standard Xchange Games. A switch move must be *initiated* from opponent's side as indicated by the vectors. Usually limited to first and last "corner" cells or last and penultimate cells at both ends (see FIGS. 30–65). After the first initiation-switch has been made, other switch moves may be from any cell, as per vectorial options indicated by the arrows.
c. Switching-Relay Games. In MRII and MRIV games, switch moves are made from any of vectored cells on players 2–4 rows. Each new pick-up begins a new "run" with new "switch" options availability.

(11) Switch Limitation: No player may "double-switch"; i.e., repeat the same switch move twice in the same deal. A reverse-switch cannot be followed by another reverse-switch nor a diagonal-switch by another diagonal switch. In MRIV games a player may switch from any level to another, as indicated by the vectored cells.

(12) Switch Capture Limitation: At levels II and III (Xchange games) switch capture in only one cell may be voided. Thus capture resulting from a switch move must be of ≧2 sets.

(13) Switch-In-Motion: A player must be "in motion", i.e. having made one or more drops, before a switch move can be made. A set in a vectored cell when lifted must therefore be dealt in the regular forward direction, as prescribed, with the switch option exercisable only after the first drop has been made. This rule applies to any and all forms and formats.

(14) Xchange Capture Rule: Capture is said to be "made" on the last drop, being a value piece, Mach or 'Cala (as called in the game) which lands in a loaded cell on opponent's homeboard containing 1, 2, or 3 pieces. The drop will increase total contents of the cell captured to 2, 3, or 4 pieces. Captures may be limited to 3 or 4 pieces at advanced levels of play.

(15) Relay Capture Rules: Captures ("hits") in relay games are usually limited to "en prise" sets of 2's, 3's or 4's, except in the "endgame" when a pair of singles may be "hit". A set is en prise when both the in-competition cell and the cell before or behind it contain 2, 3, or 4 pieces. Capture is made if the player's last piece is a VP, Mach or Big Mach which lands in a loaded in-competition cell directly opposite (in the same file) on his/her homeboard.

(16) Capturing in MCIII games—Capture rules are same as for MXI and MRII above in respect to the "front" and "back" game.

(17) Capturing in MRIV games—Capture rules are same as MRII with two differences: (i) en prise sets must be in In-competition cells; (ii) two, three, or four cells of any file may be regarded as an "en prise" duo, trio, quad, and can be hit if they contain 2, 3, or 4 pieces.

(18) Initial capture limitation—See Initial Contract bid. Usually, in Xchange games, the first capture must be of ≧3 pieces. First capture is always "declared" as to number of pieces and value. Bonus capture rules apply. See Opening Contract bid and multiple capture rules.

(19) 'Cala Bonus—In some games, as stipulated by the particular rules, player earns a bonus of (a) 100% of pieces/value captured; (b) highest value-piece on opponent's side—at pay-off value; or, (c) a *credit* re (a) or (b) without pieces. (See Particular Bonus prescribed for each game, if any)

(20) Multiple or Bonus Capture: Whenever capture is made in a MXI game and the cell to the left of that from which capture has been made also contains 2, 3, or 4 pieces, this set is taken as bonus capture—called multiple capture. If the other cell immediately adjacent to the "bonus" cell is loaded with 2, 3, or 4, this set is also taken. Player can only capture a "chain" of 2's, 3's and 4's on one side (left of right) of opponent's homeboard. Thus in MXI/8 games, the maximum number sets capturable is 4.

(21) Total Wipe out or Clean-Sweep Capture—if a player makes 2's, 3's, and/or 4's in each cell of opponent's left and right homeboard, all are taken as a clean sweep bonus. The player must then feed at least one piece to opponent, if he/she can, so that the game may continue.

(22) Settling Transactions—all captures are settled at "Pay-Off" value indicated by the value-line ratio. Settlement time may be excluded from Mach (speed-of-moving) time frame.

(23) Q and A/Chance Cards: These provide learning-/risk dimensions but the maximum number that can be drawn after making capture is two. Bonus or forfeiture apply, as prescribed, for right/wrong answers.

(24) Post Capture Transactions: There are three modes, as described: Straight Accumulation Method (SAM); Factored Accumulation Method (FAM); and Transactional Accumulation Method (TAM). See Levels I, II, and III restrictions.

(25) Betting—Bets may be made on any aspect of play. Any player at any time may offer to increase such bets by use of the doubler. The numbers on the doubler are 2, 4, 16, 32, 64, 128, and 256. To double a bet, the player places "2" uppermost and says "doubling". Then "four, then "sixteen". A player is not penalized for refusing to accept a bet or increase it.

(26) Calculus/Non-Calculus Method of Play—Players may select either methods. Usually non-calculus except at beginner's level. If calculus method of play is being used, a player may count number of pieces in any cell and also request count by opponent. Thus, a player may know the exact count of each cell before making a deal. In non-calculus play, players cannot *lift* and count sets. Nor can opponent be asked for a count. Once a set is lifted, it must be dealt. Players must master the techniques of "sight" counting (splitting and measuring or rearranging the order of the pieces) to ascertain the numbers. All such covert methods of counting are allowed.

(27) Handicapping—Players of superior skill may neutralize or reduce advantage by increasing opponent's Mach-1 time frame and/or "spotting" opponent a given number of points.

(28) Opening/Middle/Endgame Classifications—All Machcala games have three phases:

a. the "opening game" is that phase of play before the first capture is made. See first capture contract.
b. the "middle game" is the thick of battle when both players wage war and exchange captures.
c. the "endgame" begins when all the special and special power pieces have been captured or when no set/cell contains more than two pieces. For "relay" games this situation permits 1/1 or single set (2,3, or 4) capture from in-competition cells.

(29) Empowerments: Whenever a player is about to deal a set consisting of only value pieces, he/she may bring in a special or special power piece if "capture" or "kill" will result from the deal. The set so "empowered" or "Mached-up" must be dealt immediately. This procedure introduces what are called "Power Plays".

(30) Exchange Rule of Empowerment: If the set to be dealt consists of only value pieces, the player may exchange any of said value pieces for a Mach, Big Mach or Rex in any set/cell on his/her homeboard. Capture or kill must result from the deal. The Exchange may be made for any special or special power piece in any set/cell on opponent's homeboard, if the player has no Machs, Big Machs or Rex on his/her side. See level I, II and III restrictions.

(31) Endgame Conversion: In non-vectorial games the "endgame" begins when all special pieces are out of play *or* when no cell contains 2 pieces. Given this, a player may then "convert" a value piece for a Mac, 'Cala, or Killer in his or opponent's possession. The value piece so converted is called a "convertible." As stated for transfers (exchanges) capture or kill must result from the deal of such an empowered set.

(32) Mached-Moves/Mached-Game/Mached Moves & Game: All three methods may be used. Mached-moves-time is usually restricted to 10–30 seconds; Mached-games, as per matrix, are restricted to 1.5–15 minutes, as prescribed. See fines for speed/fault and Mach bonus.

(33) Errors/Faults/Fines: All such are to be paid for as they occur. See Bonus situations.

(34) Turnaround Situation: As described hereintofore a player may elect to turn the game around instead of accepting payment from opponent when he/she errs or faults. In sucn cases X plays Y's board.

(35) Annotation: The descriptive annotation system of the invention is to be used to record all moves and outcomes in the game. See Notation System.

(36) Scoring: (a) In Straight Accumulation games when captures and fines are collected or paid for as they occur, the score for the game is the sum of cash-on-hand or points *plus* Mach (speed-of-performance) bonus earned; (b) In Factored Accumulation games a score pad must be used to record pay-off value of captures, fines and bonuses if the embodiment is not capable of performing those functions. See computerization Section. The total score, again, is the sum of values accumulated plus Mach bonus earned. (c) In Transactional Accumulation games the attainments formed are scored as prescribed; usually as follows: 3× of face value of pieces in full attainment suits or suites; 2× for partial attainments formed—parts of full suits; and 1× for non-attainments (value pieces not in full or partial attainment). (d) Miscellaneous Methods of Scoring: TV game shows, classroom exercises, and casino gaming variants are as prescribed for special situations.

Because of the wide range of games, variations and embodiments, implicit in the various aspects of the invention, it is not practical to state all the rules and modifications. Each game has its own particularized set of rules derived from the detailed specifications stated hereintofore. This is so especially for vectorial variations, Sem/Scen entertainments, advertisements, entertainments, computerizations, and electro-mechanicals.

These rules are, in the main, comparatively easy to learn, unlike the complicated rules for Go, Chess, Bridge and other classics. Thus, anyone with the ability to make simple logical decisions—from a child of 5-7 to a mathematician or computer scientist—can play most of the games of the invention within an hour or so. This ease of learning the fundamental of play, however, is deceptive. For although the basic ways to play are easily grasped, it is far more difficult to master the strategies that mark play at advanced or professional levels. Among these are various kinds of combination switch moves, power plays, and speed plays which only come from long practice and study.

In general, the strategic aspects of most forms of the game relate to the following considerations:

1. Developing a repertoire of best opening/middle/endgame plays;
2. Sacrificing and setting traps;
3. Playing the "inner" board vs. the "outer" board;
4. Playing the "corners" or "switches";
5. Reducing losses when losses are unavoidable;
6. Sight counting or memorization of the numbers;
7. Gaining time by accelerating compulsory or "book" moves;
8. Multiple traps—setting up two or more capture options;
9. Defense Deployment of Pieces and/or use of "Killer" to upset opponent's plans;
10. Maximizing values—playing the value-line or pay-off odds;
11. Power plays—creating and utilizing power plays via exchange and conversion strategies.
12. Wagering—when and how to bet (and use the Machcala "Wheel-of-Fortune" Doubler); and
13. Protecting against cheating and illegal plays.

A few words regarding cheating: Machcala games are a gambler's and cheater's delight. All attempts to cheat, if discovered, are subject to fine as stipulated by the rules of play for the game or variation See Fines. In addition to its speed, skill and "cold cash" orientation the "facility" to cheat successfully is one of the game's most interesting and vicarious aspects. Hence, the advice to all players of Machcala games is "Caveat Dealer." More: Let both dealer and non-dealer beware. (It is said that in many Arabian and African countries a great player's reputation is based as much on memory, skills and speed of play as it is on his ability to cheat—successfully).

Some of the most prevalent cheating techniques and practices are as follows:

1. Lifting a set but not dealing or *returning* all the pieces thereof;
2. Counting but claiming to be rearranging or "stacking" the pieces;
3. Double dropping—depositing two chips in a cell instead of one, as required;
4. Short-drop capture—palming or concealing a piece and capturing
5. Ghosting or faking—not depositing a piece in a set/cell.
6. Off-time play—"forgetting" to start timer;
7. Underpaying when "settling" transaction, incorrectly recording or totalling score;
8. Illegal empowerment—incorrectly exchanging or converting value pieces;
9. Smuggling—illegally "easing" or "nudging" a chip from one cell to an adjacent cell;
10. Illegal switch—initiating switch from own side (in non-vectorial variation or repeating switch drop during course of same deal.)
11. Communicating when forbidden in doubles or team play; and
12. The Big Spill or Earthquake: This is the ultimate cheat and is usually done when scorecards are not used. The player fakes an accident or illness and spills all the pieces.

A good player soon learns to spot and protect himself against there and other cheating techniques. The possibilities are many. It must be admitted, however, that even the most honest player will make "mistakes" from time to time. All such mistakes are treated and interpreted as attempts to cheat and are subject to fine imposition as prescribed by the rules of play for that particular game.

MACHCALA NOTATION SYSTEM

Several new moves and procedures that are involved in the vectorial variations and multi-tiered matrices could not be adequately described by state of the art notation systems. New symbols had to be developed to describe most of the vectorial options, fines, bonuses, MCIII (Combinatorials) games, computerizations, etc.

My new and improved method of notation may be used to describe not only the myriad games of the invention but also any form of Mancala or Mancala-like game. The notation system can be used to record and/or describe any move or outcome which might arise in the course of play.

Diagram "A": Designation of Rows and Cells and Players:

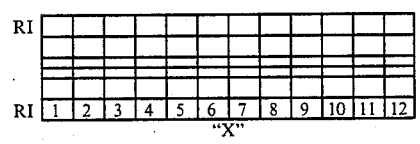

-continued

Diagram "A": Designation of Rows and Cells and Players:

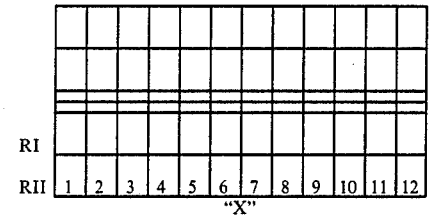

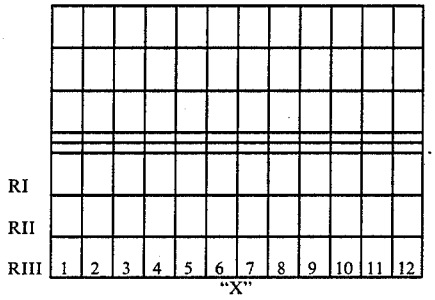

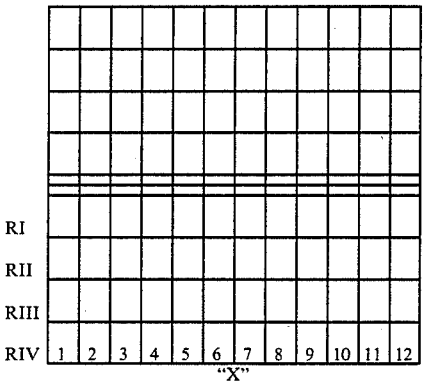

| Symbols: | Description |
|---|---|
| X: | Player (Black) |
| Y: | Player (White) |
| RI–RIV | Roman numerals: RI, RII, RIII, and RIV indicate number of rows on each player's homeboard. |
| X1–X12/Y1–Y12 | Letters and small numbers designate cells. |
| — | Dash sign indicates move in forward direction (clockwise or counterclockwise) |
| < or ← | Reverse left switch |
| > or → | Reverse right switch |
| / or \ | Diagonal move is indicated by a slash |
| \| | Vertical-up/vertical-down switch |
| \|\| or , | Capture separation sign |
| * | Asterisk - another capture indication sign placed after the number indicating the capture |
| 1–4 | Arabic numerals describe number and/or value of pieces captured, number of pieces in a cell, and value of captures |
| V= or S= | Signs used to indicate value of capture made |
| C or | Sign for 'Cala or Big Mac |
| MC | Sign for Machs |
| $R_x$ & | Prescription sign used to represent Rex |
| M | Letter "M" represents Maching-up move or Mach |
| M1 & M2 | Mach time frames |
| DW | Letters "DW" represent Wheel-of-Fortune Doubler (used to increase wager) |
| C | Letter "C" represents Q & A of "Chance" card (with pro/con effect) on position attained. |

-continued

| Diagram "A": Designation of Rows and Cells and Players: | |
|---|---|
| Σ | Sigma represents grand total score |

Example of Application of Notation System

An example of the usage of the notation system will suffice to illustrate the scope of its capabilities:

Situation: In a Machcala match (on an MXI/8 matrix), the following moves and captures were made by two players, called X and Y, during the 9th turn of the middle game:

(a) X lifts a set containing 12 pieces from the 4th cell on his left homeboard and deals them, switching diagonally from Y's first switch cell and then reversing to capture two sets of 3 and 4 with Big Mach; Value-line pay-off is 1:3/1:4 and value of total point pieces captured is $1500.

(b) Y deals 8 pieces from his 7th cell and does not capture. However, the last piece dealt is Rex in X's 7th cell which contained 14 point pieces (including Big Mach).

Annotation: The above moves and outcomes would be annotated as follows:

$$9.X{:}X_4\text{-}Y_1/X_1 \leftarrow Y_{12}\text{-}Y_4 \;\|\; Y_3\,3^*,\ Y_4\,4^{*+},\ V=\$1500$$

$$Y{:}Y_7 = X_7\,14^{+K}$$

It will be clear to anyone with skills in this area of notation systems that my new descriptive system may be used to describe any situation which may arise during the course of any Mancala or Mancala-like (count and capture) game. See Computerization-moves Program.

LEVEL OF PLAYS: ALL VARIATIONS

| No. | Structural Or Behavioral Aspect | Level I (Novice) | Level II (Intermediate) | Level III (Advanced) |
|---|---|---|---|---|
| 1. | Matrix: MXI/2-MXI/5 | x | x | |
| 2. | Initial Set-up (ISU): 1 Value Piece/Cell | x | | |
| 3. | Initial Set-up (ISU): Value Pieces/2/Cell | | x | x |
| 4. | Initial Set-up (ISU): 2 Value Pieces/Cell + Positive & Negative Force | | x | x |
| 5. | Mach-Factor | x | x | x |
| 6. | Mach-Moves Method | | x | x |
| 7. | Mach-Game Method | x | | |
| 8. | Mach-Moves/Game Method | | x | x |
| 9. | Bank Roll/Credit Line | x | x | x |
| 10. | Empowering (Macs) | | x | x |
| 11. | Moving/Placement: Forward only | x | | |
| 12. | Moving: Switching | | x | x |
| 13. | Switch Moves Limitation | x | x | x |
| 14. | Switch Capture Limitation | | x | x |
| 15. | Feeding Opponent when "empty" | x | x | x |
| 16. | Errors & Faults/Money Fine | | x | x |
| 17. | Errors & Faults/Turn-around Situation Option | | x | x |
| 18. | Betting/Doubler Usage | | x | x |
| 19. | Post Capture-Transactions-Settlements | x | x | x |
| 20. | Post Capture Transactions-Attainments | | x | x |
| 21. | Scoring/Pay-off Valuation Basis | | x | x |
| 22. | Annotation | | | x |
| 23. | Straight Accumulation Method (SAM) | x | | |
| 24. | Factored Accumulation Method (FAM) | | x | x |
| 25. | Transactional Accumulated Method (TAM) | | x | x |
| 26. | Posing of the Foundation | | x | x |
| 27. | Hand | | x | x |
| 28. | Stock | | x | x |
| 29. | Discard | | x | x |
| 30. | Attainments: Full(3× Face Value) | | x | x |
| 31. | Attainments: Partial (2× Face Value) | | x | x |
| 32. | Non-Attainments: (1× Face Value) | | x | x |
| 33. | Building-Up Position | | x | x |
| 34. | Trading-Up | | x | x |
| 35. | Raiding Opponent's Side | | x | x |
| 36. | Capturing (Vectorial) Pair of VP's on Opponent's Own Side | x | x | x |
| 37. | Capturing (Vectorial) Pair of on Opponent's Side Own VP | x | x | x |
| 38. | Capturing (Vectorial) Pair of Power Pieces | | x | x |
| 39. | Capturing (Vectorial) Mixed (Power/VP) Pairing | | x | x |
| 40. | Capturing (Vectorial) Power Pairing | | x | x |
| 41. | Capturing (Xchange): Making 2, 3 or 4 | x | x | x |
| 42. | Capturing (Xchange): Making 3 or 4 | | x | x |
| 43. | Capturing (Relay): Hitting or any combination En Prise thereof "Pair" 2, 3, or 4 | x | x | x |
| 44. | Capturing (Relay): Hitting Single Set of 2,3, or 4 | x | x | x |
| 45. | Capturing (Double-Relay): Hitting En Prise sets of 2, 3, 4 in 1, 2, or 3 cells | x | x | x |
| 46. | Capturing (Double Relay): Hitting ≧ 2 sets of 2, 3, 4 | | x | x |
| 47. | Capturing (Combinatorial): See #41-#44 | x | x | x |
| 48. | Non-limitation on Multiple/Bonus Captures, as defined | x | x | x |
| 49. | Multiple Capture Limitation (See also Switch/Capture Limitation) as defined | | x | x |
| 50. | Mach-1 Bonus/Mach-0 Bonus at 2:1 Ratio | x | x | x |

The above represents selected standardization of methods of playing the games of the invention. Since no standard set of rules exists for Mancula games, these methods serve to facilitate professional level play in this country and abroad. Naturally, rules for each sim/scen or other variant would be particularized in the accompanying instructions.

DETAILED DESCRIPTION OF THE PRESENT INVENTION

Part VII: Evaluation Framework

Structural elements and behavioral dimensions have been established by experts, e.g., Bell, Murray, Stewart, Von Neumann, Redl, Gump, Sutton-Smith et. al., vis-a-vis criteria for establishing a framework for evaluating significant, skill-related games. The basic game and variations of the present invention were successfully evaluated against several of said criteria, as follows:

1. Skill requirements—thinking and creative imagination underpin several decisions during the course of a deal;

2. Activity and locomotion—manipulative opportunities in stacking, lifting and dealing pieces, depressing keys, activating timing devices, handling play money, etc.

3. Competitive Factor—the game structure demands aggressive intellectual competition. It has a win/lose centrality; it is goal directed; it is self-enhancing; it lends itself to team or individual play.

4. Speed-of-Performance Factor—rewards are based on speed as well as skill; speed of play can decide the final outcome of the game.

5. Chance or Luck Factor limitation—although the game is logical and judgmental, an element (±20%) of luck is represented by question and answer or chance cards drawn after capturing move; said cards contain pro/con instructions which can cause unexpected advances or reversals.

6. Use of space and props—restricted receptacle areas with cells having different pay-off values. Play money, timer, chance cards, Q and A cards, doubler and other devices are used.

7. Rule complexity—basic rules regarding the set up, switching moving, capturing, fines, bonuses, scoring, etc. serve to increase demands on comprehension and so enrich the intelligence quotient and experience of the game.

8. Suspense/Dynamics factors—the games of the invention are among world's finest in these regards. The dynamics of reversals and advances are greater than they are for Backgammon, Parchisi or Monopoly. Suspense builds from the "opening game" and is sustained through the "end game".

9. Pleasure/Pain content of Winning/Losing—implication of inadequacy or that destiny is against one; loss of dignity and loss of valuable (symbolic and/or real) property.

10. Body of Theory—relating to strategic moves, traps, sacrifices, etc. A set of official rules has been developed, as well as a descriptive notation system, glossary of terms, etc.

11. Cheating opportunities—the game is a gambler's and cheater's delight. Myriad opportunities exist—subject to loss of face or loss of property (fines) if caught.

12. Direct mirroring of life themes—the scenario and simulation games treat diverse real-life subject matters of high education and/or entertainment interest to children and adults alike: contemporary events, fads, culture, sports, advertising and promotions, educational subjects, the arts, etc.

All the above elements and dimensions are present in my invention—its games and methods of play. Thus, from a syntactical and qualitative point of view, the games of the invention succeed in meeting the most stringent criteria and significantly enhance the prior art.

The games of the invention are skill-oriented—logical and judgmental. An analysis of the methods of playing the basic simulation game of the invention, the MCIII/8 STOCK EXCHANGE game will reveal that there are, essentially, only three crucial sets of decisions involved:

1. Set Selection—Which set of pieces in which cell should be lifted and dealt? How many pieces are there in the set selected?

2. Direction of the Deal—Should the regular forward direction, clockwise or counter-clockwise, be maintained? If not, should a "switch" move be considered? If so, from which of opponent's switch cells? Remember: caveat vector What direction should the switch move take? Vertical or Reverse or Diagonal switch? Should the initial switch be followed by the regular forward move and/or another switch?

3. Maximization/optimization—will captures result? If so, will value be maximized as to pay-off? If not, what of "exposures"?

Once these basic "tactical" decisions have been made regarding the deal, the others are qualitative or strategic and relate, in the main, to evaluation of capture/exposure trade-offs, valuation, tempo, space, and assessment of opponent's response options. Given the time constraint—Mach-1 for the MCIII/8 Stock Exchange game is only 15 minutes—player has to complete thinking, planning, and implementation for the average deal within ten to twelve seconds. This is tough. There are some 80–100 decisions involved (about equally divided between "front" and "back" game.) Speed is, therefore, of essence, but so, too, is skill.

In view of the difficulty implicit in evaluating the variables involved in the decision-making process, most players find that their intuitive powers have to be brought into play. It is therefore fair to say that the subconscious element plays an important—though not a dominant—role, along with logic and judgment. The facts for decision-making are there, but time is a pressing constraint. A priori "risk/reward" planning cannot be relied upon, given the "kill" powers of Rex. Finally, the 50% Mach-1 bonus (as against Mach-0 of 25%) is an objective worth striving for—one that could make a difference in the final outcome of the game. Players have to evaluate and implement "maximum effective" strategies for each deal.

These and other aspects described hereintofore account for the significant improvements my inventions bring to the prior art relating to both the structural and qualitative aspects of Mancala and Mancala-like games.

A comparison of the various elements of my invention with those achieved by several inventions (U.S. and foreign) relating to Mancala games reveals the following improvements which, I contend, greatly enhance the state of the prior art:

(1) New apparatus for improving structural embodiments; refer, in particular, to the game case of the invention, electromechanical and computerized embodiments.

(2) New formats and layouts—as evidenced by the range of playing field matrices and modifications and variations thereof; significant improvements of the conventional forms of mancala boards, playing fields and playing fields matrices, with regard to shape and size, as evidenced by the drawings and examples.

(3) The invention of the Value-line feature whereby cells of each file are differentiated as to value.

(4) New and improved kinds of playing pieces—chips, miniature cards, 3-D figures, discs, etc.

(5) The differentiation of playing pieces as to class—"value" pieces; "specials" which capture; and a subset of "power" pieces which capture and earn a bonus or negate capture.

(6) The differentiation of color-coded playing pieces as to range of value—usually in the ratio of 1:2:3:4, as prescribed for the respective game.

(7) The differentiation of playing pieces as to powers and roles; e.g., Macs which are empowered to capture.

(8) The creation of Rex (aka "Killer", Chairman of the 'Xchange, Judge, etc.). This is a negative force, one which prevents a capturing deal from any cell it occupies.

(9) The creation of Big Mach which earns a bonus on making capture. This is a counterveiling positive force vis-a-vis Killer.

(10) The creation of vectorial, simulation/scenario games—as entertainments, advertisements, "enter-trainments" as defined.

(11) New and improved methods of play including:

a. Standardization of official "Initial Set-Ups" rules which limits this procedure as to number of pieces per cell and the designated set-up cells, as described hereintofore.
b. Creation of Mach-1 (Speed-of-Performance) time frames and bonus levels.
c. Creation of the Initial Rearrangement option, as described.
d. Creation of the opening contract bid rule, as described.
e. Creation of four different levels of play—Novice, Junior, Senior, and Professional—and requirements for each of these levels.
f. Creation of new "switch" moves—vertical, diagonal, reverse—and combinatorial switch moves, as described.
g. Creation of new capture rules, bonus capture rules and limitation of capture rules, as described hereintofore.
h. Creation of post-capture transactions—usage of pieces captured to form "attainments" (suits, runs, messages or catch-phrases, themes, etc) to accumulate as valuable property as per Value-line designations and valuation rules.
i. The use of Question and Answer and "Chance" cards which are designed to reinforce learning and/or affect score.
j. The use of play money to settle financially-related transactions arising from capturing moves and/or Q and A or chance cards selection.
k. Use of a doubling device to initiate and increase bets on "best speed", points spread, etc.
l. Creation of a system of fines and bonuses, as described.
m. Creation of the empowerment (exchange and conversion) rules for middle and endgame phases, as prescribed.
n. Creation of a set of cheating techniques and fines.
o. Creation of a new, descriptive notation system to record moves and outcomes and so facilitate review, analyses, and communication.

(12) Creation of a new Mancala and Mancala-like simulation process and the games and variations thereof which depict an extensive range of subject matters.

(13) Improved embodiments—electro-mechanicals computerizations "casinoizations", encasements, table tops, TV tops and the like.

(14) The socio-cultural and intellectual broadening of appeal of Mancala and Mancala-like games—as a direct result of the above-listed and other improvements.

(15) Improvement in the overall dynamics and quality of play of Mancala (count and capture) games—brought about by the pressure and challenge of the Mach time frames, the switch moves, the special "power" pieces; the newness involved in all aspects of the basic vectorial game and variants, as described.

(16) Acculturation and aesthetic features have been significantly improved by the "sim/scen" feature and "backgammonization" of the structural elements, i.e., the advantages of encasing the game; the ease of handling, stacking and dealing; the various types of playing pieces; and usage of various accessories.

(17) Improvement of the utility and economic value to purchasers of "supersets" with $\geqq 2$ overlays and 3–5 game variations.

(18) Utilization of the games and variations as training and educational devices in classroom situations, as military exercises, TV game-show and in various other ways, as described.

As a direct result of these improvements, I feel that Mancala games in general and the games of the invention in particular, will gain a new, increased level of appeal to peoples of diverse cultural, educational, and ethnic backgrounds, locally and abroad. Perhaps, the best features of Mancala and Mancala-like games, however, are speed and intellectual appeal features which have been significantly enhanced by the various improvements and inventions described. Surviving from the halcyon days of the Sumer-Mesopotamia Empire, which peaked some 5,000 years ago (several boards were found in the Ur excavations), Mancala may well be the oldest game extant. Many expects agree on this claim. As improved by my invention, it may well become, in the next decade, one of America's favorite board and computer games. To data, Mancala has failed to excite local appeal because of the cited limitations.

From the foregoing description, it should become apparent that I have disclosed new inventions and significant improvements and shown how same may be used to make and play a system of Mancala-like games. The overall result is a significant heightening of the quality of Mancala games, in general, and Mancala-like simulation games, in particular. Furthermore, the inventions meet all the established criteria for furthering the state of the prior art in the field of invention relating to games of skill.

Thus, in respect to utility and economic value, quality of play, esthetic and diverse other aspects, my inventions have significantly improved upon the state of the prior art relating to the structural and behavioral dimensions of Mancala and Mancala and Mancala-like games.

It is, of course, understood that the examples of the games and apparatus of the process, as heretofore described and illustrated, are presented to exemplify my invention rather than to limit it in any way. Accordingly, such modifications, variations, alterations, and adaptations as may readily occur to skilled practioners when confronted with this disclosure, are to be regarded as included within the spirit of the invention as defined by the scope of the specifications and claims appended hereto. This would, of course, include but would not be limited to usage of the game process, apparatuses and products to make or play similar games with significantly the same materials and methods toward achieving significantly the same end.

In these regards, based on my knowledge and a careful examination of the prior art and various U.S. and foreign patents cited hereintofore, I believe I am the first to discover, anywhere in the world, these new and improved Mancala-like generic, scenerio, simulation, vectorial variations and computer-based embodiments as described herein. See also a previous submission under the U.S. Patent Office Disclosure Document Program No. 080426, dated Apr. 30, 1979.

Therefore, having fully described and illustrated the game process, the preferred embodiments of its products and playing methods; and, also, having specified the numerous improvements to the prior art brought about by said inventions, your petitioner requests that Letters Patent be granted to him in accordance with the related claims.

I claim:

1. Apparatus for making and playing Vectorial, Mancala-like and other types of direction, formation and transfer-oriented games wherein the structural dimensions include a playing field matrix with 1, 2, 3, 4, 5, 6, 7, or 8 rows of cells in which a plurality of playing pieces are deposited, lifted and transferred to successive cells with a view to strategically establishing certain capturing positions, as defined, said apparatus comprising:

a. a board or game case with one or more built-in timing devices for recording time used by each player in completing the games; two or more storage compartments for storing a plurality of differentiated playing pieces; and a centrally-located ridge which divides the receptacle areas into left and right homeboards;

b. a geometrically and graphically designed game matrix which forms the playing field for the particularized game, with said matrix consisting of two separate receptacle areas with a plurality of cells on either side of a centrally-located transactions and/or value line area;

c. a plurality of color-coded and otherwise differentiated playing pieces of diverse shapes and forms, as required, and of sufficiency to allow for each player placing a set in each designated initial set-up cell, as prescribed by the rules governing play;

d. a plurality of "question and answer" cards containing instructions which cause unexpected advances or reversals and which are picked after each capturing move, as defined by the rules governing play;

e. a stack of play money notes, or chips, of varying denominations, which is used to settle financially-related transactions arising from capture and/or question and answer cards selection;

f. a doubling device which is used to initiate and increase bets before and during the course of play;

g. a tabulated scoring pad on which each player records moves, value of captures, fines, and bonuses; and h. a set of rules and regulations governing all aspects of play from the initial set-up requirements to usage of a descriptive notation system to record moves and outcomes.

* * * * *